US006868247B2

(12) United States Patent
Sato et al.

(10) Patent No.: US 6,868,247 B2
(45) Date of Patent: Mar. 15, 2005

(54) DEVELOPING UNIT, DEVELOPING DEVICE, IMAGE-FORMING APPARATUS, AND COMPUTER SYSTEM

(75) Inventors: Makoto Sato, Nagano-ken (JP); Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 5 days.

(21) Appl. No.: 10/387,219

(22) Filed: Mar. 13, 2003

(65) Prior Publication Data

US 2003/0219276 A1 Nov. 27, 2003

(30) Foreign Application Priority Data

| | | |
|---|---|---|
| Mar. 13, 2002 | (JP) | 2002-068743 |
| Mar. 15, 2002 | (JP) | 2002-073184 |
| Mar. 20, 2002 | (JP) | 2002-079483 |
| Mar. 20, 2002 | (JP) | 2002-079484 |
| Mar. 20, 2002 | (JP) | 2002-079485 |
| Mar. 20, 2002 | (JP) | 2002-079486 |
| Mar. 20, 2002 | (JP) | 2002-079487 |
| Mar. 25, 2002 | (JP) | 2002-083178 |

(51) Int. Cl.[7] ..... G03G 15/08
(52) U.S. Cl. ..... 399/281; 399/119; 399/284
(58) Field of Search ..... 399/111, 119, 399/227, 274, 281, 284, 286

(56) References Cited

U.S. PATENT DOCUMENTS

| | | | | |
|---|---|---|---|---|
| 4,378,158 A | | 3/1983 | Kanbe | |
| 5,424,817 A | * | 6/1995 | Imamiya et al. | 399/281 |
| 5,995,791 A | | 11/1999 | Kawasaki | |
| 6,671,480 B2 | * | 12/2003 | Sugiyama | 399/227 |

FOREIGN PATENT DOCUMENTS

JP 5-158331 A 6/1993

* cited by examiner

*Primary Examiner*—Hoang Ngo
(74) *Attorney, Agent, or Firm*—Sughrue Mion, PLLC

(57) ABSTRACT

A developing device comprises: a developer container for containing developer; a developer bearing member that is provided at a lower section of the developer container and is capable of bearing and carrying the developer; a developer supplying member that is provided at a lower section of the developer container, is capable of abutting against the developer bearing member at an abutting section, and is capable of supplying the developer to the developer bearing member; and a flow-path restricting member that is capable of restricting a flow path of the developer contained in the developer container. The flow path leads from right above the abutting section to the abutting section.

98 Claims, 31 Drawing Sheets

6580
h
6550

(ENLARGED)
6582
6580
T
6584
B
IV
I
III
II
6510
A
6550
6592
6560

6550
6592
d (ENLARGED)

DEVELOPING UNIT, DEVELOPING DEVICE, IMAGE-FORMING APPARATUS, AND COMPUTER SYSTEM

CROSS-REFERENCE TO RELATED APPLICATIONS

The present application claims priority upon Japanese Patent Application No. 2002-68743 filed Mar. 13, 2002, Japanese Patent Application No. 2002-73184 filed Mar. 15, 2002, Japanese Patent Application No. 2002-79483 filed Mar. 20, 2002, Japanese Patent Application No. 2002-79484 filed Mar. 20, 2002, Japanese Patent Application No. 2002-79485 filed Mar. 20, 2002, Japanese Patent Application No. 2002-79486 filed Mar. 20, 2002, Japanese Patent Application No. 2002-79487 filed Mar. 20, 2002, and Japanese Patent Application No. 2002-83178 filed Mar. 25, 2002, which are herein incorporated by reference.

BACKGROUND OF THE INVENTION

1. Field of the Invention

The present invention relates to a developing unit, a developing device, an image-forming apparatus, and a computer system.

2. Description of the Related Art

As one type of an image-forming apparatus, there is known an apparatus comprising a plurality of developing devices (which are also called "developing units") arranged radially about an axis of rotation. The developing devices are capable of developing a latent image formed on a photoconductor using a developer, such as toner. When an image signal is transmitted from an external device such as a host computer, the image-forming apparatus makes the developing device rotate about the axis of rotation in order to locate one of the plurality of developing devices in a developing position opposing the photoconductor. A toner image is created by developing the latent image formed on the photoconductor, and the image is transferred to an intermediate medium. A color image is formed by superimposing the plurality of toner images, by sequentially changing the plurality of developing devices and repeating the above-mentioned developing and transferring processes.

(1) One type of developing device comprises: a container for containing the toner; a developing roller that serves as a developer bearing member and is rotatably supported on the container by a shaft; and a toner supplying roller that is also rotatably supported on the container by a shaft. The toner supplying roller is made from an elastic body and serves as a developer supplying member that can supply toner onto the surface of the developing roller by pressing against it.

Toner must stably be supplied to a "abutting section" (which is also called a nip) where the toner supplying roller elastically abuts against the developing roller. However, in the above-mentioned image-forming apparatus, there are cases in which variations arise in the amount of toner supplied to the abutting section or in pressure applied to the abutting section, due to the difference in the amount of toner remaining in the container. As a result of such a variation, changes may be brought about, for example, in the charging characteristic of the toner supplied to the developing roller, thereby causing reduction in the quality of the formed image.

(2) Another type of developing unit comprises: a container for containing the toner; a developing roller that serves as a developer bearing member and is rotatably supported on the container by a shaft; and a toner supplying roller that is also rotatably supported on the container by a shaft. The toner supplying roller is made from an elastic body and serves as a developer supplying member that can supply toner onto the surface of the developing roller by pressing against it. Further, the developing unit comprises a sealing member for preventing the toner from passing by the circumference of the developing roller and escaping from the container. Further, the developing unit may comprise a thickness-restricting member for restricting the thickness of the toner bore by the developer bearing member. The thickness-restricting member may serve as the sealing member.

In the above-mentioned image-forming apparatus, when the developing unit is made to rotate at high speed in order to allow faster image forming, there is a possibility that the toner will surge at a high pressure upon a section between the developing roller and the sealing member or a section between the developing roller and the thickness-restricting member as if it were colliding against those sections, escape from a gap at the sealing section, and contaminate the image-forming apparatus.

(3) Another type of developing unit comprises: a container for containing the toner; a developing roller that serves as a developer bearing member and is rotatably supported on the container by a shaft; and a toner supplying roller that is also rotatably supported on the container by a shaft. The toner supplying roller is made from an elastic body and serves as a developer supplying member that can supply toner onto the surface of the developing roller by pressing against it.

Toner must stably be supplied to an "abutting section" (which is also called a nip) where the toner supplying roller elastically abuts against the developing roller. However, in the above-mentioned image-forming apparatus, when the developing unit is made to rotate at high speed in order to allow faster image forming, there is a possibility that the toner will flow with great force and surge upon the abutting section at a high pressure as if it were colliding against the abutting section. If the toner is not stably supplied to the abutting section, changes may be brought about in, for example, the charging characteristic of the toner supplied to the developing roller, thereby causing reduction in the quality of the formed image.

(4) Another type of developing device comprises: a container for containing the toner; a developing roller that serves as a developer bearing member and is rotatably supported on the container by a shaft; and a toner supplying roller that is also rotatably supported on the container by a shaft. The toner supplying roller is made from an elastic body and serves as a developer supplying member that can supply toner onto the surface of the developing roller by pressing against it. Further, the developing device comprises a sealing member for preventing the toner from passing by the circumference of the developing roller and escaping from the container. Further, the developing device may comprise a thickness-restricting member for restricting the thickness of the toner bore by the developer bearing member. The thickness-restricting member may serve as the sealing member.

Toner must stably be supplied to a "abutting section" (which is also called a nip) where the toner supplying roller elastically abuts against the developing roller. However, there are cases in which a variation arises in the downward pressure of the toner supplied to the abutting section caused by gravitation, due to the difference in the amount of toner remaining in the container. As a result of such a variation, changes may be brought about in, for example, the charging characteristic of the toner supplied to the developing roller, thereby causing reduction in the quality of the formed image.

Further, due to the difference in the amount of toner remaining in the container, there is a possibility that the toner will surge at a high pressure upon a section where the sealing member abuts against the developing roller or a section where the thickness-restricting member abuts against the developing roller, escape from a gap at the sealing section, and contaminate the image-forming apparatus.

Further, in the above-mentioned image-forming apparatus, when the developing device is made to rotate at high speed in order to allow faster image forming, there is a possibility that the toner will flow with great force and surge upon the abutting section at a high pressure as if it were colliding against the abutting section. This may prevent the toner from being stably supplied to the abutting section. Further, due to the flow caused by rotation, there is a possibility that the toner will surge at a high pressure upon a section between the developing roller and the sealing member or a section between the developing roller and the thickness-restricting member, escape from a gap at the sealing section, and contaminate the image-forming apparatus.

(5) Another type of developing device is shown in FIG. 30. The developing device shown in FIG. 30 comprises a toner container 62 for containing toner 61. In the toner container is provided a toner supplying roller 63 rotatably supported by a shaft. A rotatably-supported developing roller 64 is provided right outside the developing device and abuts against the toner supplying roller 63 through an opening of the developing device. Outside the developing device, the developing roller 64 abuts against a photoconductor 65.

In such a developing device, the toner supplying roller 63 rotates clockwise in FIG. 30, carrying the toner 61 in the toner container 62 to the developing roller 64. The developing roller 64 rotates counterclockwise in FIG. 30, receives the toner at a contacting surface (contacting section) at which it abuts against the toner supplying roller 63, and carries the toner 61 to the photoconductor 65. During this process, some of the toner 61 bore by the developing roller 64 is scraped off by a restriction blade 6, and the amount of the toner 61 is restricted. After development, the toner 61 remaining on the developing roller 64 is stripped off by the toner supplying roller 63.

In the above-mentioned developing device, by setting the circumferential velocity of the toner supplying roller 63, which supplies the toner 61 (developer), larger than that of the developing roller 64, which carries the toner 61, the toner supplying roller 63 will be able to stably supply the toner 61 to the developing roller 64. However, in this case, it becomes necessary to collect the toner 61 that has passed the contacting surface without adhering to the developing roller 64, the toner 61 that has been scraped off by the restriction blade 66 after being supplied to the developing roller 64, and the toner 61 that has been stripped off from the developing roller 64 after development by the toner supplying roller 63. If the toner 61 is not duly removed, the toner 61 will pile up after passing the contacting surface, and as a result, the toner will not be supplied stably to the developing roller 64.

(6) Another type of developing device is shown in FIG. 31. FIG. 31 shows some main structural components of a developing device. The developing device shown in FIG. 31 comprises: a first container 71 and a second container 72 for containing toner T; a developing roller 73 that serves as a developer bearing member and is rotatably supported in the first container 71 by a shaft; and a toner supplying roller 74 that is also rotatably supported in the first container 71 by a shaft. The toner supplying roller 74 is made from an elastic body and serves as a developer supplying member that can supply the toner T onto the surface of the developing roller 73 by pressing against it.

In FIG. 31, a gap that (i) exists on a plane that passes through the center of rotation of the toner supplying roller 74 and forms an angle θ with a horizontal plane, which is taken as a reference and extends from the center of rotation of the toner supplying roller 74 towards the opposite side of the photoconductor 5, in a direction opposite to the rotating direction of the toner supplying roller 74 and (ii) exists between the toner supplying roller 74 and the inner wall of the first container 71 is assumed to be Δd'. In the developing device shown in the figure, Δd' has a constant value throughout the range of $0° \leqq \theta \leqq 90°$, taking the above-mentioned horizontal plane as the reference. The toner T is shoved into a narrow space during the range of $0° \leqq \theta \leqq 90°$ and pressed by the rotation (clockwise in FIG. 31) of the toner supplying roller 4. As a result, the inner pressure of the toner increases. Then, as the toner T reaches the point of the above-mentioned horizontal plane ($\theta=0°$), its inner pressure is suddenly relaxed. As a result, the toner T bursts forth in a direction perpendicular to the above-mentioned horizontal plane. The toner T having burst forth is carried by the toner supplying roller 74 and flows towards a gap between the developing roller 73 and the container 76.

In such a developing device, if the rotating speed of the developing roller and the toner supplying roller is increased in order to allow faster image forming and/or the flowability of the toner is enhanced in order to ensure suppliability of the toner, the toner will escape from the gap between the developing roller and the container as the developing roller and the toner supplying roller are driven. This may cause contamination of the image-forming apparatus or defective images due the toner adhering to the image-forming section.

(7) Another type of developing device comprises a container for containing the toner, which is a magnetic substance, and a developing roller, which serves as a developer bearing member. The developing roller is rotatably supported on the container by a shaft, and has a magnet inside.

In such an image-forming apparatus, when the developing device is rotated about the axis of rotation, a situation occurs in which a gap between the developing roller and the toner container of the developing device is located beneath the toner. In such a situation, there is a possibility that the toner will escape through the gap by gravitation and contaminate the image-forming apparatus.

SUMMARY OF THE INVENTION (1) The present invention has been contrived in view of the above and other problems, and an object of the present invention is to provide a developing device, an image-forming apparatus and a computer system, which are capable of stabilizing supplying of a developer to an abutting section where a developer bearing member and a developer supplying member abut against each other.

According to an aspect of the present invention, a developing device comprises: a developer container for containing developer; a developer bearing member that is provided at a lower section of the developer container and is capable of bearing and carrying the developer; a developer supplying member that is provided at a lower section of the developer container, is capable of abutting against the developer bearing member at an abutting section, and is capable of supplying the developer to the developer bearing member; and a flow-path restricting member that is capable of restricting a flow path of the developer contained in the developer container, the flow path leading from right above the abutting section to the abutting section.

(2) Another object of the present invention is to provide a developing unit, an image-forming apparatus, and a computer system, which are capable of preventing a developer from escaping.

According to an aspect of the present invention, a developing unit comprises: a developer container for containing developer; a developer bearing member for bearing and carrying the developer contained in the developer container; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts at an abutting section against an upper section of the developer bearing member from above the developer bearing member, and the developing unit comprises a wall portion that extends from above to a position located beyond an upper end of the abutting section.

Further, another aspect of the present invention is a developing unit comprising: a developer container for containing developer; a developer bearing member for bearing and carrying the developer contained in the developer container; a developer supplying member for supplying the developer to the developer bearing member; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts against the developer bearing member from above the developer bearing member, and an uppermost section of the developer supplying member is located above a lower end of the sealing member.

(3) Another object of the present invention is to provide a developing unit, an image-forming apparatus and a computer system, which are capable of stabilizing supplying of a developer to an abutting section where a developer supplying member abuts against a developer bearing member.

According to an aspect of the present invention, a developing unit comprises: a developer container for containing developer; a developer bearing member for bearing and carrying the developer; and a developer supplying member being capable of abutting against the developer bearing member at an abutting section and supplying the developer contained in the developer container to the developer bearing member, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, a wall portion having a predetermined length in the vertical direction is provided above the developer supplying member and on the developer supplying member side of the abutting section.

(4) Another object of the present invention is to provide a developing device, an image-forming apparatus, and a computer system, which are capable of preventing escaping of a developer and stabilizing supplying of the developer to an abutting section (nip) where a developer bearing member and a developer supplying member abut against each other.

Another aspect of the present invention is a developing device comprising: a developer container for containing developer; a developer bearing member that is provided at a lower section of the developer container and is capable of bearing and carrying the developer; a developer supplying member that is provided at a lower section of the developer container, is capable of abutting against the developer bearing member at a first abutting section, and is capable of supplying the developer to the developer bearing member; a sealing member that is capable of abutting against an upper section of the developer bearing member at a second abutting section and preventing the developer from escaping from the developer container; and a flow-path restricting member that is capable of restricting a flow path of the developer contained in the developer container and comprises a first wall portion that covers an area above the first abutting section, and a second wall portion that extends from above to a position located beyond an upper end of the second abutting section.

(5) Another object of the present invention is to provide a developing device in which a developer supplying member can stably supply a developer to a developer bearing member, an image-forming apparatus comprising such a developing device, and a computer system.

Another aspect of the present invention is A developing device comprising: a developer container for containing developer; a rotatable developer bearing member for bearing the developer; a developer supplying member that is provided in the container, is capable of contacting the developer bearing member, and is capable of supplying the developer to the developer bearing member by rotating downwards, passing by a contacting section where the developer supplying member contacts the developer bearing member; a supply-amount restricting member that is provided in the container and is capable of restricting an amount of the developer supplied from above to the contacting section where the developer supplying member and the developer bearing member contact each other; and a developer passage that is structured by an inner wall surface of the container and an outer surface of the developer supplying member and through which the developer having passed the contacting section in the downward direction passes, wherein, a shortest distance between the outer surface of the developer supplying member and the supply-amount restricting member is shorter than a shortest distance between the outer surface of the developer supplying member and the inner wall surface of the container, which structures the developer passage.

(6) Another object of the present invention is to provide a developing device that is capable of preventing escaping of a developer, an image-forming apparatus comprising such a developing device, and a computer system.

Another aspect of the present invention is a developing device comprising: a first container for containing developer; a second container for containing the developer; a restriction wall that is capable of restricting movement of the developer between the first container and the second container and in which one side of the wall structures a part of an inner wall of the first container and another side of the wall structures a part of an inner wall of the second container; a developer bearing member provided in the first container; a rotatable developer supplying member that is provided in the first container and is capable of supplying the developer to the developer bearing member; and a sealing member that is provided above a center of rotation of the developer supplying member and is capable of preventing the developer from escaping from the first container, wherein, in a state where the developing device can develop a latent image formed on a photoconductor, a gap existing on a plane that passes through a center of rotation of the developer supplying member and forms an angle θ with a horizontal plane in a direction opposite to the rotating direction of the developer supplying member, the horizontal plane being taken as a reference and extending from the center of rotation of the developer supplying member towards the opposite side of the photoconductor, and existing between the developer supplying member and the inner wall of the first container takes a maximum value when $\theta=0°$ within a range of $0° \leqq \theta \leqq 90°$.

(7) Another object thereof is to provide an image-forming apparatus and a computer system, which are capable of preventing escaping of a developer.

According to an aspect of the present invention, an image-forming apparatus comprises: a photoconductor; and a rotating device that is capable of making a plurality of developing devices attached to the rotating device rotate and locating each of the developing devices at a position where the developing device opposes the photoconductor, each of the developing devices comprising: a first container for containing developer; a second container for containing the developer; a restriction wall for restricting movement of the developer between the first container and the second container; a developer bearing member for bearing the developer; and a sealing member that is capable of abutting against the developer bearing member and preventing the developer from escaping from the first container, wherein, in a state where the developing device has been rotated by the rotating device and is located at a position opposing the photoconductor, an uppermost end of the restriction wall is located above a tip end of the sealing member.

Features of the present invention other than the above will become clear by the description of the present specification with reference to the accompanying drawings.

BRIEF DESCRIPTION OF THE DRAWINGS

For a more complete understanding of the present invention and the advantages thereof, reference is now made to the following description taken in conjunction with the accompanying drawings wherein.

DETAILED DESCRIPTION OF THE INVENTION

Figure 1:
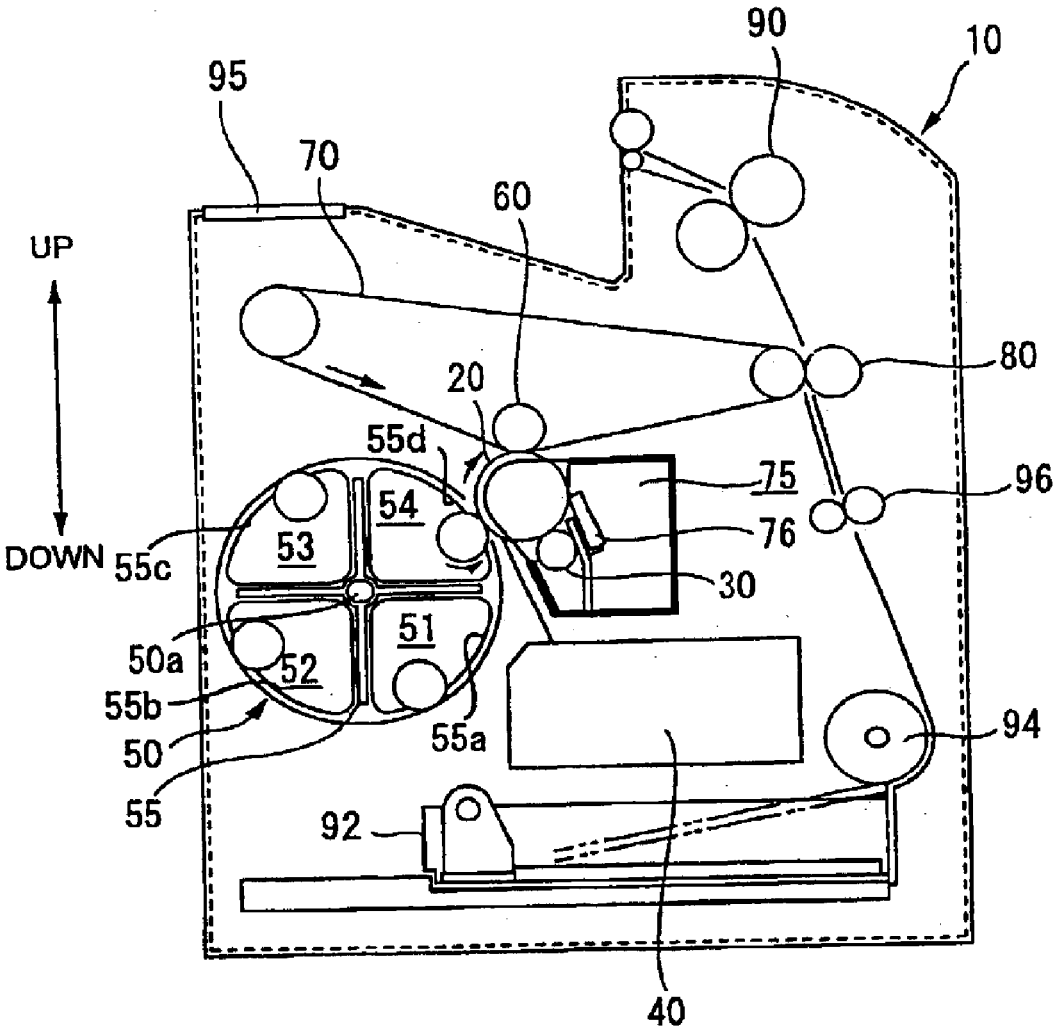
FIG. 1 is a diagram showing some main structural components constructing an image-forming apparatus according to embodiments of the present invention.

At least the following matters will be made clear by the explanation in the present specification and the description of the accompanying drawings.

One aspect of the present invention is a developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at an abutting section, and is capable of supplying the developer to the developer bearing member; and a flow-path restricting member that is capable of restricting a flow path of the developer contained in the developer container, the flow path leading from right above the abutting section to the abutting section.

According to such a developing device, by providing a flow-path restricting member for restricting a flow path leading from right above the abutting section to the abutting section, it is possible to prevent variations in the pressure applied on the abutting section that would be caused by, for example, the difference in the amount of the developer existing above the abutting section. As a result, supplying of the developer to the developer bearing member with the developer supplying member will become stable.

The flow-path restricting member may extend in a direction from the developer bearing member to the developer supplying member, and a gap may exist between a tip end of the flow-path restricting member and the developer supplying member.

With such a structure, it becomes possible to prevent variations in the pressure of the developer applied to the abutting section that would be caused by, for example, the difference in the amount of the developer existing above the abutting section and also carry the developer from the developer supplying member to the abutting section by making the developer pass the gap.

The tip end of the flow-path restricting member may be located between the abutting section and a center of rotation of the developer supplying member in a horizontal direction.

With such a structure, by locating the tip end of the flow-path restricting member between the abutting section and a center of rotation of the developer supplying member in a horizontal direction, it becomes possible to prevent variations in the pressure applied to the abutting section that would be caused by, for example, the difference in the amount of the developer existing above the abutting section and also effectively carry the developer to the abutting section by making the developer pass the gap with the developer supplying member.

The flow-path restricting member may be a part of a frame that structures the developer container.

This structure would be advantageous in terms of both strength of the wall portion and manufacturability.

By rotating, the developer supplying member may be capable of carrying the developer from above the abutting section towards the abutting section.

With such a structure, it becomes possible to prevent variations in the pressure applied to the abutting section that would be caused by, for example, the difference in the amount of the developer existing above the abutting section and also effectively carry the developer from above the abutting section towards the abutting section through rotation of the developer supplying member.

The rotating direction of the developer bearing member and the rotating direction of the developer supplying member may be opposite to each other.

With such a structure, it becomes possible to prevent variations in the pressure applied to the abutting section that would be caused by, for example, the difference in the amount of the developer existing above the abutting section, effectively carry the developer from above the abutting section towards the abutting section through rotation of the developer supplying member, and also supply the developer to the developer bearing member that rotates in the opposite direction.

The developing device may comprise an electrical charging member that is capable of abutting against the developer bearing member and charging the developer that has passed the abutting section.

With such a structure, it becomes possible to stably supply the developer to the developer bearing member at the abutting section, which is made possible by rotating the developer supplying member and carrying the developer from above the abutting section towards the abutting section with the rotation. Further, the amount of electric charge applied to the developer, which has been so stably supplied, with the electrical charging member will also be stabilized.

A sealing member that is capable of abutting against the developer bearing member and preventing the developer from escaping from the developer container may be provided above the tip end of the flow-path restricting member and on the developer bearing member side.

With such a structure, it becomes possible to prevent variations in the pressure applied to the abutting section that would be caused by, for example, the difference in the amount of the developer existing above the abutting section, and carry the developer from the developer supplying member towards the abutting section by making the developer pass the above-mentioned gap. Further, it is also possible to restrict variations in the pressure applied to the sealing member that would be caused by, for example, the difference in the amount of the developer existing above the abutting section and prevent the developer from escaping.

Another aspect of the present invention is a developing device comprising:

a developer container for containing developer;

a developer bearing member that is provided at a lower section of the developer container and is capable of bearing and carrying the developer; and a developer supplying member that is provided at a lower section of the developer container, is capable of abutting against the developer bearing member at an abutting section, and is capable of supplying the developer to the developer bearing member;

wherein, a flow-path restricting member for covering the abutting section is provided above the abutting section, the flow-path restricting member extends in a direction from the developer bearing member to the developer supplying member, a gap exists between a tip end of the flow-path restricting member and the developer supplying member, the tip end of the flow-path restricting member is located between the abutting section and a center of rotation of the developer supplying member in a horizontal direction, the flow-path restricting member is a part of a frame that structures the developer container, by rotating, the developer supplying member is capable of carrying the developer from above the abutting section towards the abutting section, the rotating direction of the developer bearing member and the rotating direction of the developer supplying member are opposite to each other, the developing device comprises an electrical charging member that is capable of abutting against the developer bearing member and charging the developer that has passed the abutting section, and a sealing member that is capable of abutting against the developer bearing member and preventing the developer from escaping from the developer container is provided above the tip end of the flow-path restricting member and on the developer bearing member side.

According to such a developing device, the flow-path restricting member will most effectively restrict the flow of the developer that would otherwise collide, at high pressure, against the abutting section between the developer bearing member and the developer supplying member from above; therefore, the developer will be supplied to the abutting section in the most stable manner.

Another aspect of the present invention is an image-forming apparatus comprising a developing device, the developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at an abutting section, and is capable of supplying the developer to the developer bearing member; and a flow-path restricting member that is capable of restricting a flow path of the developer contained in the developer container, the flow path leading from right above the abutting section to the abutting section.

Such an image-forming apparatus is superior to a conventional image-forming apparatus as a whole.

Another aspect of the present invention is a computer system comprising:

a computer;

a display device that can be connected to the computer; and an image-forming apparatus that can be connected to the computer and comprises a developing device, the developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at an abutting section, and is capable of supplying the developer to the developer bearing member; and a flow-path restricting member that is capable of restricting a flow path of the developer contained in the developer container, the flow path leading from right above the abutting section to the abutting section.

Such a computer system is superior to a conventional computer system as a whole.

Another aspect of the present invention is a developing unit comprising:

a developer container for containing developer;

a developer bearing member for bearing and carrying the developer contained in the developer container; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts at an abutting section against an upper section of the developer bearing member from above the developer bearing member, and the developing unit comprises a wall portion that extends from above to a position located beyond an upper end of the abutting section.

According to such a developing unit, by providing a wall portion, the developer, which is made to flow due to gravitation and centrifugal force caused by rotation of the rotating member, is blocked from colliding against the upper end section of the abutting section of the sealing member, and the developer is prevented from escaping out from the developing unit.

The wall portion may intersect the radial direction of the rotating member.

With this structure, the developer, which is subjected to a force and made to flow due to centrifugal force caused by rotation of the rotating member, is further effectively blocked from colliding against the abutting section by the wall section, and the developer is prevented from escaping out from the developing unit.

In a state where the developing unit is located at the developing position, the wall portion may extend along a substantially vertical direction.

With this structure, the developer, which is subjected to a force and made to flow due to centrifugal force caused by rotation of the rotating member, is effectively blocked from colliding against the abutting section by the wall section, and the developer is prevented from escaping out from the developing unit.

In a state where the developing unit is located at the developing position, the developing unit may comprise a second wall portion that extends upwards in an oblique direction from a lower end of the wall portion, and the sealing member may be provided beneath the second wall portion.

With this structure, the second wall portion arranged above the sealing member will further effectively restrict the developer, which is subjected to a force and made to flow due to centrifugal force caused by rotation of the rotating member, from colliding against the abutting section, and the developer is prevented from escaping out from the developing unit.

The developing unit may comprise a developer supplying member being capable of abutting against the developer bearing member at the abutting section and supplying the developer to the developer bearing member, and in a state where the developing unit is located at the developing position, the wall portion may be provided above the developer supplying member, and the lower end of the wall portion may be located below a line that passes through an uppermost section of the developer bearing member and an uppermost section of the developer supplying member.

With this structure, in a state where the developing unit is rotated 90° from the developing position, that is, in a state where the developer bearing member and the sealing member are located near the lowermost section of the developing unit, both the tip end section of the wall portion and the developer supplying member will prevent the developer, which surges upon the abutting section due to gravitation and rotation of the rotating member, from severely colliding against the abutting section, and it becomes possible to prevent the developer from escaping.

A gap may exist between the lower end of the wall portion and the developer supplying member.

With this structure, because a gap, which may be rather small, is provided between the lower end section of the wall portion and the developer supplying member, the developer, which surges upon the abutting section, is prevented from severely colliding against the abutting section, and is supplied at a stable amount to the developer supplying member.

The wall portion may be a part of a frame that structures the developer container.

This structure would be advantageous in terms of both strength of the wall portion and manufacturability.

Another aspect of the present invention is a developing unit comprising:

a developer container for containing developer;

a developer bearing member for bearing and carrying the developer contained in the developer container; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein:

in a state where the developing unit is located at the developing position, the sealing member abuts at an abutting section against an upper section of the developer bearing member from above the developer bearing member;

the developing unit comprises a wall portion that extends from above to a position located beyond an upper end of the abutting section;

the wall portion extends along a substantially vertical direction;

the developing unit comprises a second wall portion that extends upwards in an oblique direction from a lower end of the wall portion;

the sealing member is provided beneath the second wall portion;

the developing unit comprises a developer supplying member being capable of abutting against the developer bearing member at the abutting section and supplying the developer to the developer bearing member;

the lower end of the wall portion is located below a line that passes through an uppermost section of the developer bearing member and an uppermost section of the developer supplying member;

a gap exists between the lower end of the wall portion and the developer supplying member; and the wall portion is a part of a frame that structures the developer container.

According to such a developing unit, the wall portion will most effectively block the flow of the developer that flows towards the abutting section between the sealing member and the developer bearing member; therefore, the developer will most effectively be prevented from escaping from the developing unit.

Another aspect of the present invention is a developing unit comprising:

a developer container for containing developer;

a developer bearing member for bearing and carrying the developer contained in the developer container; and a thickness restricting member for restricting a thickness of a layer of the developer bore by the developer bearing member, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the thickness restricting member abuts at an abutting section against an upper section of the developer bearing member from above the developer bearing member, and the developing unit comprises a wall portion that extends from above to a position located beyond an upper end of the abutting section.

With this structure, even when a thickness restricting member, and not the sealing member, is made to abut against the upper section of the developer bearing member due to reasons such as the rotating direction of the developer bearing member, by providing a wall portion: the developer in the developer container, which is made to flow due to gravitation and centrifugal force caused by rotation of the rotating member, is blocked from colliding against the upper end section of the abutting section where the thickness restricting member abuts against the developer bearing member; the developer is prevented from escaping out from the developing unit; and the electrical charging of the developer, which is bore by the developer bearing member, by the thickness restricting member will appropriately be protected.

Another aspect of the present invention is an image-forming apparatus comprising a developing unit, the developing unit comprising:

a developer container for containing developer;

a developer bearing member for bearing and carrying the developer contained in the developer container; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts at an abutting section against an upper section of the developer bearing member from above the developer bearing member, and the developing unit comprises a wall portion that extends from above to a position located beyond an upper end of the abutting section.

Such an image-forming apparatus is superior to a conventional image-forming apparatus as a whole.

Another aspect of the present invention is a computer system comprising:

a computer;

a display device that can be connected to the computer; and an image-forming apparatus that can be connected to the computer and comprises a developing unit, the developing unit comprising:

a developer container for containing developer;

a developer bearing member for bearing and carrying the developer contained in the developer container; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts at an abutting section against an upper section of the developer bearing member from above the developer bearing member, and the developing unit comprises a wall portion that extends from above to a position located beyond an upper end of the abutting section.

Such a computer system is superior to a conventional computer system as a whole.

Another aspect of the present invention is a developing unit comprising:

a developer container for containing developer;

a developer bearing member for bearing and carrying the developer; and a developer supplying member being capable of abutting against the developer bearing member at an abutting section and supplying the developer contained in the developer container to the developer bearing member, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, a wall portion having a predetermined length in the vertical direction is provided above the developer supplying member and on the developer supplying member side of the abutting section.

With this structure, the developer, which is made to flow due to gravitation and centrifugal force caused by rotation of the rotating member, will once collide against the wall portion while it travels towards the abutting section. Therefore, it becomes possible to prevent the developer from directly colliding against the abutting section at high pressure, thereby stabilizing the amount of developer supplied to the abutting section.

The wall portion may intersect the radial direction of the rotating member.

With this structure, the developer, which is subjected to a force due to centrifugal force caused by rotation of the rotating member, will once collide at an effective angle against the wall portion while it flows towards the abutting section. Therefore, it becomes possible to prevent the developer from directly colliding against the abutting section at high pressure, thereby stabilizing the amount of developer supplied to the abutting section.

In a state where the developing unit is located at the developing position, the wall portion may extend along a substantially vertical direction.

With this structure, the developer, which is subjected to a force due to centrifugal force caused by rotation of the rotating member, will once collide at an effective angle against the wall portion while it flows towards the abutting section. Therefore, it becomes possible to prevent the developer from directly colliding against the abutting section at high pressure, thereby stabilizing the amount of developer supplied to the abutting section.

In a state where the developing unit is located at the developing position, the wall portion may be provided between the abutting section and a center of rotation of the developer supplying member in a horizontal direction.

With this structure, at a position right before collision, the wall portion is able to effectively prevent the developer from colliding against the abutting section at high pressure, and it becomes possible to stabilize the amount of developer supplied to the abutting section.

In a state where the developing unit is located at the developing position, a lower end of the wall portion may be located below a line that passes through an uppermost section of the developer bearing member and an uppermost section of the developer supplying member.

With this structure, the lower end section of the wall portion is located sufficiently close to the developer supplying member; therefore, it becomes possible to effectively restrict the flow path of the developer surging upon the abutting section at high pressure and stabilize the amount of developer supplied to the abutting section.

A gap may exist between the lower end of the wall portion and the developer supplying member.

With this structure, the lower end of the wall portion and the developer supplying member will effectively restrict the flow path of the developer surging upon the abutting section at high pressure, the developer will be supplied to the abutting section through the gap between the lower end of the wall portion and the developer supplying member at a stable amount.

In a state where the developing unit is located at the developing position, the developing unit may comprise a second wall portion that extends upwards in an oblique direction from the lower end of the wall portion towards the developer bearing member.

With this structure, a space will be formed between the second wall portion, which extends upwards in an oblique direction from the lower end of the wall portion towards the developer bearing member, and the developer bearing member and the developer supplying member, and it is possible to store some of the developer in this space; therefore, the amount of developer supplied to the abutting section will further be stabilized.

The wall portion may be a part of a frame that structures the developer container.

This structure would be advantageous in terms of both strength of the wall portion and manufacturability.

Another aspect of the present invention is a developing unit comprising:

a developer container for containing developer;

a developer bearing member for bearing and carrying the developer; and a developer supplying member being capable of abutting against the developer bearing member at an abutting section and supplying, the developer contained in the developer container to the developer bearing member, the developing unit being capable of being attached to a rotating member having a plurality of unit attaching sections, being rotated by the rotating member, and developing a latent image at a developing position, the latent image being formed on a photoconductor, wherein:

in a state where the developing unit is located at the developing position, a wall portion having a predetermined length in the vertical direction is provided above the developer supplying member and on the developer supplying member side of the abutting section;

the wall portion extends along a substantially vertical direction;

the wall portion is provided between the abutting section and a center of rotation of the developer supplying member in a horizontal direction;

a lower end of the wall portion is located below a line that passes through an uppermost section of the developer bearing member and an uppermost section of the developer supplying member;

a gap exists between the lower end of the wall portion and the developer supplying member;

the developing unit comprises a second wall portion that extends upwards in an oblique direction from the lower end of the wall portion towards the developer bearing member; and the wall portion is a part of a frame that structures the developer container.

According to such a developing unit, the amount of developer supplied to the abutting section will be stabilized in the most effective manner.

Another aspect of the present invention is a image-forming apparatus comprising a developing unit, the developing unit comprising:

a developer container for containing developer;

a developer bearing member for bearing and carrying the developer; and a developer supplying member being capable of abutting against the developer bearing member at an abutting section and supplying the developer contained in the developer container to the developer bearing member, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, a wall portion having a predetermined length in the vertical direction is provided above the developer supplying member and on the developer supplying member side of the abutting section.

Such an image-forming apparatus is superior to a conventional image-forming apparatus as a whole.

Another aspect of the present invention is a computer system comprising:

a computer;

a display device that can be connected to the computer; and an image-forming apparatus that can be connected to the computer and comprises a developing unit, the developing unit comprising:

a developer container for containing developer;

a developer bearing member for bearing and carrying the developer; and a developer supplying member being capable of abutting against the developer bearing member at an abutting section and supplying the developer contained in the developer container to the developer bearing member, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, a wall portion having a predetermined length in the vertical direction is provided above the developer supplying member and on the developer supplying member side of the abutting section.

Such a computer system is superior to a conventional computer system as a whole.

Another aspect of the present invention is a developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at a first abutting section, and is capable of supplying the developer to the developer bearing member;

a sealing member that is capable of abutting against an upper section of the developer bearing member at a second abutting section and preventing the developer from escaping from the developer container; and a flow-path restricting member that is capable of restricting a flow path of the developer contained in the developer container and comprises a first wall portion that covers an area above the first abutting section, and a second wall portion that extends from above to a position located beyond an upper end of the second abutting section.

According to such a developing device, the first wall portion that covers an area above the first abutting section (the so-called nip) is able to block the flow path of developer, which surges at high pressure upon the first abutting section from an upper area of the developer container. Therefore, it becomes possible to restrict variations in developer pressure applied to the first abutting section that is caused by, for example, variations in the amount of the remaining developer, and supply the developer to the first abutting section stably. Further, the second wall portion, which extends from above to a position located beyond an upper end of the second abutting section, is able to prevent the developer from escaping from the second abutting section (which is an abutting section for the sealing member), which would be caused by the pressure of the remaining developer.

The flow-path restricting member may be capable of restricting a flow path of the developer contained in the developer container that leads from right above the first abutting section to the first abutting section.

With this structure, since the flow-path restricting member restricts a flow path that leads from right above the first abutting section to the first abutting section, it is possible to block the flow path of developer, which surges at high pressure upon the first abutting section from a section right above the first abutting section in an upper area of the developer container. Therefore, it becomes possible to restrict variations in developer pressure applied to the first abutting section that is caused by, for example, variations in the amount of the remaining developer, and supply the developer to the first abutting section stably.

A tip end of the flow-path restricting member may be formed by a lower end of the first wall portion and a lower end of the second wall portion, and a gap may exist between the tip end and the developer supplying member.

With this structure, it becomes possible to restrict variations in pressure applied to the first abutting section that is caused by, for example, difference in the amount of the developer remaining above the abutting section, and it also becomes possible to carry the developer from the developer supplying member to the first abutting section by making the developer pass the above-mentioned gap.

The tip end may be located below a line that passes through an uppermost section of the developer bearing member and an uppermost section of the developer supplying member.

With this structure, it becomes possible to effectively restrict variations in developer pressure applied to the first abutting section that is caused by, for example, variations in the amount of the remaining developer, and also, it becomes possible to effectively prevent the developer from escaping from the second abutting section and outside the developing device, which would be caused by, for example, the pressure of the remaining developer.

The first wall portion may be formed extending upwards in an oblique direction from the tip end towards the developer bearing member.

With this structure, a space will be formed between the first wall portion, which is formed extending upwards in an oblique direction from the tip end of the flow-path restricting member towards the developer bearing member, and the developer bearing member, and it is possible to store some of the developer in this space; therefore, the amount of developer supplied to the first abutting section will further be stabilized.

A tip end of the flow-path restricting member may be formed by a lower end of the first wall portion and a lower end of the second wall portion, the first wall portion and the second wall portion may form an acute angle, and a space for storing the developer may be provided between the first wall portion and the developer bearing member.

With this structure, a space will be formed between the first wall portion, which is formed extending upwards in an oblique direction from the acute tip end of the flow-path restricting member towards the developer bearing member, and the developer bearing member, and it is possible to store the developer in this space; therefore, the amount of developer supplied to the first abutting section will further effectively be stabilized.

The tip end of the flow-path restricting member may be located between the first abutting section and a center of rotation of the developer supplying member in a horizontal direction.

With this structure, it is possible to block the flow path of developer, which surges at high pressure upon the first abutting section from an upper area of the developer container, and not only from an area right above the first abutting section, with the flow-path restricting member that covers above the first abutting section up to a position located between the first abutting section and the center of rotation of the developer supplying member. Therefore, it becomes possible to restrict variations in developer pressure applied to the first abutting section that is caused by, for example, variations in the amount of the remaining developer, and further effectively supply the developer to the first abutting section stably.

The flow-path restricting member may be a part of a frame that structures the developer container.

This structure would be advantageous in terms of both strength of the wall portion and manufacturability.

By rotating, the developer supplying member may be capable of carrying the developer from above the first abutting section towards the first abutting section.

With this structure, it is possible to prevent variations in pressure applied to the first abutting section that is caused by, for example, difference in the amount of the developer existing above the first abutting section, and effectively carry the developer from above the first abutting section towards the first abutting section with the rotation of the developer supplying member.

The rotating direction of the developer bearing member and the rotating direction of the developer supplying member may be opposite to each other.

With this structure, it is possible to prevent variations in pressure applied to the first abutting section that is caused by, for example, difference in the amount of the developer existing above the first abutting section, effectively carry the developer from above the first abutting section towards the first abutting section with the rotation of the developer supplying member, and also supply the developer to the developer bearing member that rotates in a direction opposite to the developer supplying member.

The flow-path restricting member may be provided on the developer supplying member side of the sealing member.

With this structure, since the flow-path restricting member blocks the flow path of the developer that leads from the developer supplying member side directly towards the sealing member, it becomes possible to prevent the developer from surging at high pressure onto the section of the sealing member and also prevent the developer from escaping from the section of the sealing member and out of the developing device.

The developing device may be capable of being attached to a rotating member having a plurality of unit attaching sections, being rotated by the rotating member, and developing a latent image at a developing position, the latent image being formed on a photoconductor.

With this structure, the flow-path restricting member is able to effectively prevent occurrence of variations in developer pressure at both the first and second abutting sections, which would occur when the developer, which flows with great force due not only to gravitation but also to centrifugal force caused by rotation of the rotating member, surges at high pressure to both the first and second abutting sections; also, it becomes possible to supply the developer to the first abutting section stably, and prevent the developer from escaping from the second developer.

Another aspect of the present invention is a developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at a first abutting section, and is capable of supplying the developer to the developer bearing member;

a sealing member that is capable of abutting against an upper section of the developer bearing member at a second abutting section and preventing the developer from escaping from the developer container; and a flow-path restricting member that is capable of restricting a flow path of the developer contained in the developer container and comprises a first wall portion that covers an area above the first abutting section, and a second wall portion that extends from above to a position located beyond an upper end of the second abutting section, wherein, the flow-path restricting member is capable of restricting a flow path of the developer contained in the developer container that leads from right above the first abutting section to the first abutting section;

a tip end of the flow-path restricting member is formed by a lower end of the first wall portion and a lower end of the second wall portion;

a gap exists between the tip end and the developer supplying member;

the tip end is located below a line that passes through an uppermost section of the developer bearing member and an uppermost section of the developer supplying member;

the first wall portion is formed extending upwards in an oblique direction from the tip end towards the developer bearing member;

the first wall portion and the second wall portion form an acute angle;

the tip end of the flow-path restricting member is located between the first abutting section and a center of rotation of the developer supplying member in a horizontal direction;

the flow-path restricting member is a part of a frame that structures the developer container;

by rotating, the developer supplying member is capable of carrying the developer from above the first abutting section towards the first abutting section;

the rotating direction of the developer bearing member and the rotating direction of the developer supplying member are opposite to each other;

the flow-path restricting member is provided on the developer supplying member side of the sealing member; and the developing device is capable of being attached to a rotating member having a plurality of unit attaching sections, being rotated by the rotating member, and developing a latent image at a developing position, the latent image being formed on a photoconductor.

According to such a developing device, the flow-path restricting member will most effectively restrict the flow of the developer, which would flow from above and collide at high pressure against the first abutting section where the developer supplying member abuts against the developer bearing member, and as a result, the developer will be supplied to the first abutting section most stably. Further, the flow-path restricting member will most effectively block the movement of the developer, which flows towards the second abutting section where the sealing member abuts against the developer bearing member, and it becomes possible to prevent the developer from escaping from the developing device in the most effective manner.

Another aspect of the present invention is an image-forming apparatus comprising a developing device, the developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at a first abutting section, and is capable of supplying the developer to the developer bearing member;

a sealing member that is capable of abutting against an upper section of the developer bearing member at a second abutting section and preventing the developer from escaping from the developer container; and a flow-path restricting member that is capable of restricting a flow path of the developer contained in the developer container and comprises a first wall portion that covers an area above the first abutting section, and a second wall portion that extends from above to a position located beyond an upper end of the second abutting section.

Such an image-forming apparatus is superior to a conventional image-forming apparatus as a whole.

Another aspect of the present invention is a computer system comprising:

a computer;

a display device that can be connected to the computer; and an image-forming apparatus that can be connected to the computer and comprises a developing device, the developing device comprising:

a developer container for containing developer;

a developer bearing member that is provided at a lower section of the developer container and is capable of bearing and carrying the developer;

a developer supplying member that is provided at a lower section of the developer container, is capable of abutting against the developer bearing member at a first abutting section, and is capable of supplying the developer to the developer bearing member;

a sealing member that is capable of abutting against an upper section of the developer bearing member at a second abutting section and preventing the developer from escaping from the developer container; and a flow-path restricting member that is capable of restricting a flow path of the developer contained in the developer container and comprises a first wall portion that covers an area above the first abutting section, and a second wall portion that extends from above to a position located beyond an upper end of the second abutting section.

Such a computer system is superior to a conventional computer system as a whole.

Another aspect of the present invention is a developing unit comprising:

a developer container for containing developer;

a developer bearing member for bearing and carrying the developer contained in the developer container;

a developer supplying member for supplying the developer to the developer bearing member; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts against the developer bearing member from above the developer bearing member, and an uppermost section of the developer supplying member is located above a lower end of the sealing member.

According to such a developing unit, since the area in the vicinity of the uppermost section of the developer supplying member, which is located above the lower end of the sealing member, blocks the flow path of the developer, which is driven by, for example, the centrifugal force caused by the rotation of the rotating member and surges at high pressure upon the sealing member, it becomes possible to prevent the developer from colliding against the sealing member at high pressure and prevent the developer from escaping out of the developing unit.

In a state where the developing unit is located at the developing position, the sealing member may abut at an abutting section against the developer bearing member from above the developer bearing member, and the uppermost section of the developer supplying member may be located above a lower end of the abutting section.

In this way, since the area in the vicinity of the uppermost section of the developer supplying member, which is located above the lower end of the abutting section, blocks the flow path of the developer, which is driven by, for example, the centrifugal force caused by the rotation of the rotating member and surges at high pressure towards the abutting section between the sealing member and the developer bearing member, it becomes possible to prevent the developer from colliding against the abutting section at high pressure and prevent the developer from escaping out of the developing unit.

The diameter of a developer supplying roller, serving as the developer supplying member, may be larger than the diameter of a developing roller, serving as the developer bearing member.

In this way, a structure in which the area in the vicinity of the uppermost section of the developer supplying member blocks the flow path of the developer can easily be realized in order to prevent the developer from colliding against the sealing member and/or the abutting section.

In a state where the developing unit is located at the developing position, the developing unit may comprise a thickness restricting member that is capable of abutting against a lower section of the developer bearing member from beneath the developer bearing member and restricting a thickness of a layer of the developer bore by the developer bearing member, and a lowermost section of the developer supplying member may be located below an upper end of an abutting section where the developer bearing member and the thickness restricting member abut against each other.

In this way, for example, even in a state where the developing unit is rotated 90° from the developing position, that is, in a state where the developer bearing member and the sealing member are located near the lowermost section of the developing unit, it is possible to block the flow path through which the developer, which is driven due to, for example, gravitation and/or centrifugal force caused by rotation, passes to surge upon the vicinity of the sealing member, and also block the flow path through which the developer passes to surge towards the periphery of the thickness restricting member which abuts against a lower section of the developer bearing member from beneath the developer bearing member. Therefore, it becomes possible to prevent the developer from escaping out of the developing unit.

When the developing unit is attached to the unit attaching section, the developer supplying member may be located closer to a center of rotation of the rotating member than the developer bearing member.

In this way, the developer supplying member will be able to restrict the flow of the developer, which is driven by the centrifugal force caused by the rotation of the rotating member, from surging at high pressure upon the sealing member, the abutting section, the thickness restricting member, etc. Therefore, it becomes possible to prevent the developer from escaping.

In a state where the developing unit is located at the developing position, the developing unit may comprise a wall portion that extends to a position located beyond an upper end of the abutting section where the developer bearing member and the sealing member abut against each other and is arranged on the developer container side of the sealing member.

In this way, both the wall portion and the developer supplying member cooperate to restrict the flow path of the developer, which surges towards the abutting section of the sealing member, and prevent the developer from escaping out of the developing unit.

In a state where the developing unit is located at the developing position, the wall portion may be provided above the developer supplying member and a lower end of the wall portion may be located below a line that passes through an uppermost section of the developer bearing member and the uppermost section of the developer supplying member.

In this way, since the lower end of the wall portion is located relatively close to the developer supplying member, both the wall portion and the developer supplying member cooperate in a more effective manner to restrict the flow path of the developer, which surges towards the abutting section of the sealing member, and prevent the developer from escaping out of the developing unit.

A gap may exist between the lower end of the wall portion and the developer supplying member.

In this way, both the wall portion and the developer supplying member cooperate to effectively restrict the flow path of the developer, which surges towards the abutting section of the sealing member, and also, it becomes possible to supply the developer to the developer supplying member at a stable amount by making the developer pass through the above-mentioned gap.

Another aspect of the present invention is a developing unit comprising:

a developer container for containing developer;

a developer bearing member for bearing and carrying the developer contained in the developer container;

a developer supplying member for supplying the developer to the developer bearing member; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts against the developer bearing member from above the developer bearing member at an abutting section, an uppermost section of the developer supplying member is located above a lower end of the sealing member, the uppermost section of the developer supplying member is located above a lower end of the abutting section, the diameter of a developer supplying roller, serving as the developer supplying member, is larger than the diameter of a developing roller, serving as the developer bearing member, the developing unit comprises a thickness restricting member that is capable of abutting against the lower section of the developer bearing member from below the developer bearing member and restricting a thickness of a layer of the developer bore by the developer bearing member, a lowermost section of the developer supplying member is located below an upper end of the abutting section where the developer bearing member and the thickness restricting member abut against each other, the developer supplying member is located closer to a center of rotation of the rotating member than the developer bearing member, the developing unit comprises a wall portion that extends to a position located beyond an upper end of the abutting section where the developer bearing member and the sealing member abut against each other and is arranged on the developer container side of the sealing member, the wall portion is provided above the developer supplying member, a lower end of the wall portion is located below a line that passes through an uppermost section of the developer bearing member and the uppermost section of the developer supplying member, and a gap exists between the lower end of the wall portion and the developer supplying member.

According to such a developing unit, since the wall section most effectively blocks the movement of the developer, which flows towards the abutting section between the sealing member and the developer bearing member, it is possible to most effectively prevent the developer from escaping from the developing unit.

Another aspect of the present invention is a developing unit comprising:

a developer container for containing developer;

a developer bearing member for bearing and carrying the developer contained in the developer container;

a developer supplying member for supplying the developer to the developer bearing member; and a thickness restricting member for restricting a thickness of a layer of the developer bore by the developer bearing member, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the thickness restricting member abuts against the developer bearing member from above the developer bearing member, and an uppermost section of the developer supplying member is located above a lower end of the thickness restricting member.

With this structure, even when a thickness restricting member, and not the sealing member, is made to abut against the upper section of the developer bearing member due to reasons such as the rotating direction of the developer bearing member, by locating the uppermost section of the developer supplying member above the lower end of the thickness restricting member: the developer in the developer container, which is made to flow due to gravitation and centrifugal force caused by rotation of the rotating member, is blocked from colliding against the upper end section of the abutting section where the thickness restricting member abuts against the developer bearing member; the developer is prevented from escaping out of the developing unit; and the electrical charging of the developer, which is bore by the developer bearing member, by the thickness restricting member will appropriately be protected.

Another aspect of the present invention is an image-forming apparatus comprising a developing unit, the developing unit comprising:

a developer container for containing developer;

a developer bearing member for bearing and carrying the developer contained in the developer container;

a developer supplying member for supplying the developer to the developer bearing member; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts against the developer bearing member from above the developer bearing member, and an uppermost section of the developer supplying member is located above a lower end of the sealing member.

Such an image-forming apparatus is superior to a conventional image-forming apparatus as a whole.

Another aspect of the present invention is a computer system comprising:

a computer;

a display device that can be connected to the computer; and an image-forming apparatus that can be connected to the computer and comprises a developing unit, the developing unit comprising:

a developer container for containing developer;

a developer bearing member for bearing and carrying the developer contained in the developer container;

a developer supplying member for supplying the developer to the developer bearing member; and a sealing member for preventing the developer from escaping from the developer container, the developing unit being capable of being attached to a rotating member having a plurality of unit attaching sections, being rotated by the rotating member, and developing a latent image at a developing position, the latent image being formed on a photoconductor, wherein, in a state where the developing unit is located at the developing position, the sealing member abuts against the developer bearing member from above the developer bearing member, and an uppermost section of the developer supplying member is located above a lower end of the sealing member.

Such a computer system is superior to a conventional computer system as a whole.

Another aspect of the present invention is a developing device comprising:

a developer container for containing developer;

a rotatable developer bearing member for bearing the developer;

a developer supplying member that is provided in the container, is capable of contacting the developer bearing member, and is capable of supplying the developer to the developer bearing member by rotating downwards, passing by a contacting section where the developer supplying member contacts the developer bearing member;

a supply-amount restricting member that is provided in the container and is capable of restricting an amount of the developer supplied from above to the contacting section where the developer supplying member and the developer bearing member contact each other; and a developer passage that is structured by an inner wall surface of the container and an outer surface of the developer supplying member and through which the developer having passed the contacting section in the downward direction passes, wherein, a shortest distance between the outer surface of the developer supplying member and the supply-amount restricting member is shorter than a shortest distance between the outer surface of the developer supplying member and the inner wall surface of the container, which structures the developer passage.

According to this structure, the developer passage will have enough capacity to sufficiently receive the developer that has been restricted by the supply-amount restricting member, been supplied to the contacting section between the developer bearing member and the developer supplying member, and has passed the contacting section without being bore by the developer bearing member, and/or the developer stripped off from the developer bearing member, on which the developer remains after development, by the developer supplying member. Therefore, the developer is ensured to flow steadily.

The rotating direction of the developer bearing member may be in the opposite direction to the rotating direction of the developer supplying member.

Even though the downward developer flow from the contacting section between the developer bearing member and the developer supplying member will increase, according to this aspect of the present invention, it becomes possible to ensure steady flow of the developer.

The circumferential velocity of the developer supplying member may be larger than the circumferential velocity of the developer bearing member.

In this way, the developer will be supplied steadily from the developer supplying member to the developer bearing member.

The supply-amount restricting member may protrude towards the developer supplying member.

In this way, it becomes possible to efficiently restrict the amount of developer supplied to the contacting section between the developer bearing member and the developer supplying member.

The supply-amount restricting member may be a part of a wall of the container.

In this way, the supply-amount restricting member will be able to function more efficiently because it will have a continuous structure with the wall of the container.

The supply-amount restricting member may have a first wall surface on the developer supplying member side and a second wall surface on the developer bearing member side, the first wall surface and the second wall surface may form an acute angle, and a blocking member may be provided between the second wall surface and the developer bearing member, the blocking member being capable of occupying a space between the second wall surface and the developer bearing member.

By forming an acute angle with the two wall surfaces, the supply-amount restricting member will have a further functional structure and will be able to restrict the supply amount of the developer more efficiently. Further, if a blocking member is provided, the developer having passed the supply-amount restricting member will be blocked and the amount of developer flowing to the contacting section will increase. Even in this case, according to this aspect of the present invention, the developer is smoothly collected and the developer is therefore steadily supplied to the contacting surface between the developer supplying member and the developer bearing member.

The blocking member may comprise a sealing member that is capable of contacting the developer bearing member, and an elastic member that is capable of occupying a gap between the second wall surface and the sealing member and pressing the sealing member onto the developer bearing member.

In this way, the sealing member and the elastic member will further efficiently restrict the developer from escaping out of the container.

Among four spaces formed by a horizontal plane and a vertical plane that pass through a center of rotation of the developer supplying member, an end of the supply-amount restricting member exists in a space above the developer bearing member and on the developer bearing member side.

In this way, it becomes possible to efficiently restrict the amount of developer supplied to the contacting section between the developer bearing member and the developer supplying member.

A spacing between an end of the supply-amount restricting member and the outer surface of the developer supplying member may be constant in the direction of an axis of rotation of the developer supplying member.

In this way, the developer will be supplied evenly to the contacting section between the developer bearing member and the developer supplying member.

A shortest distance of the spacing between the end of the supply-amount restricting member and the outer surface of the developer supplying member may be equal to or below 3 mm.

In this way, since the distance between the supply-amount restricting member and the rotating developer supplying member does not become excessively large, it becomes possible to prevent occurrence of a situation in which precipitation and/or deposits are formed on the surface of the supply-amount restricting member, due to stagnation of the developer flow in the vicinity of the supply-amount restricting member.

The developer passage may be provided from below the contacting section, at which the developer bearing member and the developer supplying member contact with each other, along a circumferential direction of the developer supplying member, and towards the opposite side of the developer bearing member in relation to a center of rotation of the developer supplying member.

In this way, it becomes possible to effectively return the developer, which has passed through the contacting section between the developer bearing member and the developer supplying member, back to the developer container.

The inner wall surface of the container that structures in part the developer passage may be provided maintaining a constant spacing with the outer surface of the developer supplying member along a circumferential direction of the developer supplying member.

In this way, the developer will flow steadily in the developer passage.

The constant spacing may be in a range from 0.5 mm to 3 mm.

In this way, since the distance between the inner wall surface of the container and the rotating developer supplying member does not become excessively large, it becomes possible to prevent occurrence of a situation in which precipitation and/or deposits are formed on the inner wall surface, due to stagnation of the developer flow in the vicinity of the inner wall surface of the container.

Another aspect of the present invention is a developing device comprising

- a developer container for containing developer;
- a rotatable developer bearing member for bearing the developer;
- a developer supplying member
  - being provided in the container,
  - being capable of contacting the developer bearing member,
  - being capable of supplying the developer to the developer bearing member by rotating downwards, passing by a contacting section where the developer supplying member contacts the developer bearing member,
  - whose rotating direction is in the opposite direction to the rotating direction of the developer bearing member, and
  - whose circumferential velocity is larger than the circumferential velocity of the developer bearing member; a supply-amount restricting member
  - being provided in the container,
  - being capable of restricting an amount of the developer supplied from above to the contacting section where the developer supplying member and the developer bearing member contact each other,
  - protruding towards the developer supplying member,
  - being a part of a wall of the container,
  - having a first wall surface on the developer supplying member side and a second wall surface on the developer bearing member side, wherein
    - the first wall surface and the second wall surface form an acute angle,
    - a blocking member is provided between the second wall surface and the developer bearing member, the blocking member being capable of occupying a space between the second wall surface and the developer bearing member,
    - the blocking member comprises a sealing member that is capable of contacting the developer bearing member, and an elastic member that is capable of occupying a gap between the second wall surface and the sealing member and pressing the sealing member onto the developer bearing member,
    - an end of the supply-amount restricting member exists in a space above the developer bearing member and on the developer bearing member side among four spaces formed by a horizontal plane and a vertical plane that pass through a center of rotation of the developer supplying member,
    - a spacing between the end of the supply-amount restricting member and an outer surface of the developer supplying member is constant in the direction of an axis of rotation of the developer supplying member, and
    - a shortest distance of the spacing between the end of the supply-amount restricting member and the outer surface of the developer supplying member is equal to or below 3 mm; and
- a developer passage
  - being structured by an inner wall surface of the container and the outer surface of the developer supplying member and through which the developer having passed the contacting section in the downward direction passes,
  - being provided from below the contacting section, at which the developer bearing member and the developer supplying member contact with each other, along a circumferential direction of the developer supplying member, and towards the opposite side of the developer bearing member in relation to the center of rotation of the developer supplying member, wherein the inner wall surface of the container that structures in part the developer passage is provided maintaining a constant spacing with the outer surface of the developer supplying member along the circumferential direction of the developer supplying member, and the constant spacing is in a range from 0.5 mm to 3 mm, wherein, a shortest distance between the outer surface of the developer supplying member and the supply-amount restricting member is shorter than a shortest distance between the outer surface of the developer supplying member and the inner wall surface of the container, which structures the developer passage.

In this way, it is possible to provide a developing device that can supply the developer to the developer bearing member most stably.

Another aspect of the present invention is an image-forming apparatus comprising:

a photoconductor; and a developing device for developing a latent image formed on the photoconductor, the developing device comprising:

a developer container for containing developer;

a rotatable developer bearing member for bearing the developer;

a developer supplying member being provided in the container, being capable of contacting the developer bearing member, being capable of supplying the developer to the developer bearing member by rotating downwards, passing by a contacting section where the developer supplying member contacts the developer bearing member, and whose circumferential velocity is larger than the circumferential velocity of the developer bearing member;

a supply-amount restricting member that is provided in the container and is capable of restricting an amount of the developer supplied from above to the contacting section where the developer supplying member and the developer bearing member contact each other; and a developer passage that is structured by an inner wall surface of the container and an outer surface of the developer supplying member and through which the developer having passed the contacting section in the downward direction passes, wherein, a shortest distance between the outer surface of the developer supplying member and the supply-amount restricting member is shorter than a shortest distance between the outer surface of the developer supplying member and the inner wall surface of the container, which structures the developer passage.

Such an image-forming apparatus is superior to a conventional image-forming apparatus as a whole.

Another aspect of the present invention is a computer system comprising:

a computer; and an image-forming apparatus that can be connected to the computer, the image-forming apparatus comprising:

a photoconductor; and a developing device for developing a latent image formed on the photoconductor, the developing device comprising:

a developer container for containing developer;

a rotatable developer bearing member for bearing the developer;

a developer supplying member being provided in the container, being capable of contacting the developer bearing member, being capable of supplying the developer to the developer bearing member by rotating downwards, passing by a contacting section where the developer supplying member contacts the developer bearing member, and whose circumferential velocity is larger than the circumferential velocity of the developer bearing member;

a supply-amount restricting member that is provided in the container and is capable of restricting an amount of the developer supplied from above to the contacting section where the developer supplying member and the developer bearing member contact each other; and a developer passage that is structured by an inner wall surface of the container and an outer surface of the developer supplying member and through which the developer having passed the contacting section in the downward direction passes, wherein, a shortest distance between the outer surface of the developer supplying member and the supply-amount restricting member is shorter than a shortest distance between the outer surface of the developer supplying member and the inner wall surface of the container, which structures the developer passage.

Such a computer system is superior to a conventional computer system as a whole.

Another aspect of the present invention is a developing device comprising:

a first container for containing developer;

a second container for containing the developer;

a restriction wall that is capable of restricting movement of the developer between the first container and the second container and in which one side of the wall structures a part of an inner wall of the first container and another side of the wall structures a part of an inner wall of the second container;

a developer bearing member provided in the first container;

a rotatable developer supplying member that is provided in the first container and is capable of supplying the developer to the developer bearing member; and a sealing member that is provided above a center of rotation of the developer supplying member and is capable of preventing the developer from escaping from the first container, wherein, in a state where the developing device can develop a latent image formed on a photoconductor, a gap existing on a plane that passes through a center of rotation of the developer supplying member and forms an angle θ with a horizontal plane in a direction opposite to the rotating direction of the developer supplying member, the horizontal plane being taken as a reference and extending from the center of rotation of the developer supplying member towards the opposite side of the photoconductor, and existing between the developer supplying member and the inner wall of the first container takes a maximum value when $\theta=0°$ within a range of $0° \leqq \theta \leqq 90°$.

According to such a developing device, since the velocity of the developer flowing upwards from below along the circumference of the developer supplying member at the above-mentioned horizontal plane decreases, the movement of the developer is restricted from colliding against the sealing member located above the horizontal plane.

An upper end of the restriction wall may be located above an uppermost section of the developer supplying member.

According to such a developing device, even though the restriction wall is high and one side of the reflection wall may reflect the developer towards the sealing member, the movement of the developer is restricted from flowing towards the sealing member.

The restriction wall may extend upwards from below.

According to such a developing device, even though the restriction wall extends upwards from below and one side of the reflection wall may reflect the developer towards the sealing member, the movement of the developer is restricted from flowing towards the sealing member.

The developer supplying member may abut against the developer bearing member, and the rotating direction of the developer supplying member may be the direction going downwards through an abutting position where the developer supplying member and the developer bearing member abut against each other.

According to such a developing device, even though the developer supplying member rotates downwards from the abutting position and the developer may thus have a velocity directed upwards from the above-mentioned horizontal plane along the circumference of the developer supplying member, the movement of the developer is restricted from flowing towards the sealing member.

The developer supplying member may be an elastic member formed by a foamed material.

According to such a developing device, even if the developer supplying member is an elastic member and the velocity of the developer flowing along the circumference of the developer supplying member thus becomes larger than when the developer supplying member is made from a stiff material, the movement of the developer is restricted from flowing towards the sealing member.

As θ increases within the range of $0° \leqq \theta \leqq 90°$, the gap does not become larger in association with the increase of θ.

According to such a developing device, the developer pressure applied on the inner wall of the gap will not increase as θ becomes larger. Therefore, since the pressure is relieved and the velocity of the developer flowing upwards from below along the circumference of the developer supplying member at the above-mentioned horizontal plane decreases, the movement of the developer is restricted from colliding against the sealing member located above the horizontal plane.

Within the range of $0° \leqq \theta \leqq 90°$, while θ increases from 0° up to a predetermined angle, the gap may become gradually smaller in association with the increase of θ, and while θ increases from the predetermined angle up to 90°, the gap may have a constant value.

According to such a developing device, the developer pressure applied on the inner wall of the gap decreases as θ gets smaller from the above-mentioned predetermined angle. Therefore, since the pressure is relieved and the velocity of the developer flowing upwards from below along the circumference of the developer supplying member at the above-mentioned horizontal plane decreases, the movement of the developer is restricted from colliding against the sealing member located above the horizontal plane.

The inner wall of the first container structuring in part the gap may be formed to have a curved section while θ increases from 0° up to the predetermined angle, and a gap structured by the curved section and the developer supplying member may become gradually smaller in association with the increase of θ.

According to such a developing device, the developer pressure applied on the inner wall of the gap decreases as θ gets smaller from the above-mentioned predetermined angle. Therefore, since the pressure is relieved and the velocity of the developer flowing upwards from below along the circumference of the developer supplying member at the above-mentioned horizontal plane decreases, the movement of the developer is further effectively restricted from colliding against the sealing member located above the horizontal plane.

A tip end of the sealing member may be located above the center of rotation of the developer supplying member.

According to such a developing device, the velocity of the developer flowing upwards from below along the circumference of the developer supplying member at the above-mentioned horizontal plane decreases. Therefore, the movement of the developer is restricted from colliding against the tip end of the sealing member located above the horizontal plane.

The sealing member may abut against the developer bearing member with a predetermined breadth, and a lowermost point of the predetermined breadth may be located above the center of rotation of the developer supplying member.

According to such a developing device, the velocity of the developer flowing upwards from below along the circumference of the developer supplying member at the above-mentioned horizontal plane decreases. Therefore, the movement of the developer is restricted from colliding against the lowermost point of the abutment between the sealing member and the developer bearing member with a predetermined breadth, which is located above the horizontal plane.

The sealing member may be a film and abuts against the developer bearing member by being urged by an elastic member.

According to such a developing device, even though the sealing member is soft and the developer may easily escape, since the movement of the developer is restricted from flowing towards the sealing member, it is possible to prevent the developer from escaping from the developing device.

Another aspect of the present invention is a developing device comprising:

a first container for containing developer;

a second container for containing the developer;

a restriction wall that is capable of restricting movement of the developer between the first container and the second container and in which one side of the wall structures a part of an inner wall of the first container and another side of the wall structures a part of an inner wall of the second container;

a developer bearing member provided in the first container;

a rotatable developer supplying member that is provided in the first container and is capable of supplying the developer to the developer bearing member; and a sealing member that is provided above a center of rotation of the developer supplying member and is capable of preventing the developer from escaping from the first container, wherein, in a state where the developing device can develop a latent image formed on a photoconductor, a gap existing on a plane that passes through a center of rotation of the developer supplying member and forms an angle θ with a horizontal plane in a direction opposite to the rotating direction of the developer supplying member, the horizontal plane being taken as a reference and extending from the center of rotation of the developer supplying member towards the opposite side of the photoconductor, and existing between the developer supplying member and the inner wall of the first container takes a maximum value when $\theta=0°$ within a range of $0° \leqq \theta \leqq 90°$;

an upper end of the restriction wall is located above an uppermost section of the developer supplying member;

the restriction wall extends upwards from below;

the developer supplying member abuts against the developer bearing member;

the rotating direction of the developer supplying member is the direction going downwards through an abutting position where the developer supplying member and the developer bearing member abut against each other;

the developer supplying member is an elastic member formed by a foamed material;

within the range of $0° \leqq \theta \leqq 90°$, while θ increases from 0° up to a predetermined angle, the gap becomes gradually smaller in association with the increase of θ, and while θ increases from the predetermined angle up to 90°, the gap has a constant value;

the inner wall of the first container structuring in part the gap is formed to have a curved section while θ increases from 0° up to the predetermined angle;

a gap structured by the curved section and the developer supplying member becomes gradually smaller in association with the increase of θ;

a tip end of the sealing member is located above the center of rotation of the developer supplying member; and the sealing member is a film and abuts against the developer bearing member by being urged by an elastic member.

According to such a developing device, since the movement of the developer is most effectively restricted from flowing towards the sealing member, it is possible to most effectively prevent the developer from escaping from the developing device.

Another aspect of the present invention is an image-forming apparatus comprising:

a photoconductor; and a developing device, the developing device comprising:

a first container for containing developer;

a second container for containing the developer;

a restriction wall that is capable of restricting movement of the developer between the first container and the second container and in which one side of the wall structures a part of an inner wall of the first container and another side of the wall structures a part of an inner wall of the second container;

a developer bearing member provided in the first container;

a rotatable developer supplying member that is provided in the first container and is capable of supplying the developer to the developer bearing member; and a sealing member that is provided above a center of rotation of the developer supplying member and is capable of preventing the developer from escaping from the first container, wherein, in a state where the developing device can develop a latent image formed on the photoconductor, a gap existing on a plane that passes through a center of rotation of the developer supplying member and forms an angle θ with a horizontal plane in a direction opposite to the rotating direction of the developer supplying member, the horizontal plane being taken as a reference and extending from the center of rotation of the developer supplying member towards the opposite side of the photoconductor, and existing between the developer supplying member and the inner wall of the first container takes a maximum value when $\theta=0°$ within a range of $0° \leqq \theta \leqq 90°$.

Such an image-forming apparatus is superior to a conventional image-forming apparatus as a whole.

Another aspect of the present invention is a computer system comprising:

a computer; and an image-forming apparatus that can be connected to the computer, the image-forming apparatus comprising:

a photoconductor; and a developing device, the developing device comprising:

a first container for containing developer;

a second container for containing the developer;

a restriction wall that is capable of restricting movement of the developer between the first container and the second container and in which one side of the wall structures a part of an inner wall of the first container and another side of the wall structures a part of an inner wall of the second container;

a developer bearing member provided in the first container;

a rotatable developer supplying member that is provided in the first container and is capable of supplying the developer to the developer bearing member; and a sealing member that is provided above a center of rotation of the developer supplying member and is capable of preventing the developer from escaping from the first container, wherein, in a state where the developing device can develop a latent image formed on the photoconductor, a gap existing on a plane that passes through a center of rotation of the developer supplying member and forms an angle θ with a horizontal plane in a direction opposite to the rotating direction of the developer supplying member, the horizontal plane being taken as a reference and extending from the center of rotation of the developer supplying member towards the opposite side of the photoconductor, and existing between the developer supplying member and the inner wall of the first container takes a maximum value when $\theta=0°$ within a range of $0° \leqq \theta \leqq 90°$.

Such a computer system is superior to a conventional computer system as a whole.

Another aspect of the present invention is an image-forming apparatus comprising:

a photoconductor; and a rotating device that is capable of making a plurality of developing devices attached to the rotating device rotate and locating each of the developing devices at a position where the developing device opposes the photoconductor, each of the developing devices comprising:

a first container for containing developer;

a second container for containing the developer;

a restriction wall for restricting movement of the developer between the first container and the second container;

a developer bearing member for bearing the developer; and a sealing member that is capable of abutting against the developer bearing member and preventing the developer from escaping from the first container, wherein, in a state where the developing device has been rotated by the rotating device and is located at a position opposing the photoconductor, an uppermost end of the restriction wall is located above a tip end of the sealing member.

According to such an image-forming apparatus, for example, even when the developing device is rotated by the rotating device, and the first container, the restriction wall, and the second container are arranged in this order in the vertical upward direction, since the developer contained in the second container will be retained by the restriction wall, the tip end of the sealing member is prevented from being pressurized.

In a state where the developing device has been rotated by the rotating device and is located at a position opposing the photoconductor, the uppermost end of the restriction wall may be located above an abutting section where the sealing member abuts against the developer bearing member.

According to such an image-forming apparatus, for example, even when the developing device is rotated by the rotating device, and the first container, the restriction wall, and the second container are arranged in this order in the vertical upward direction, since the developer contained in the second container will be retained by the restriction wall, the abutting section, where the sealing member abuts against the developer bearing member, is prevented from being pressurized.

The sealing member may abut against the developer bearing member by being urged by an elastic member, and in a state where the developing device has been rotated by the rotating device and is located at a position opposing the photoconductor, the uppermost end of the restriction wall may be located above the elastic member.

According to such an image-forming apparatus, for example, even when the developing device is rotated by the rotating device, and the first container, the restriction wall, and the second container are arranged in this order in the vertical upward direction, since the developer contained in the second container will be retained by the restriction wall, the elastic member that urges the sealing member is prevented from being pressurized.

In a state where the developing device has been rotated by the rotating device and is located at a position opposing the photoconductor, the uppermost end of the restriction wall may be located above an uppermost end of the sealing member.

According to such an image-forming apparatus, for example, even when the developing device is rotated by the rotating device, and the first container, the restriction wall, and the second container are arranged in this order in the vertical upward direction, since the developer contained in the second container will be retained by the restriction wall, the uppermost end of the sealing member is prevented from being pressurized.

When the developing device is rotated by the rotating device, the developer contained in the second container may be able to go across the restriction wall and move to the first container.

According to such an image-forming apparatus, since the restriction wall is high, the sealing member is prevented from being pressurized by the developer contained in the second container, even when, for example: the developing device is rotated by the rotating device; the first container, the restriction wall, and the second container are arranged in this order in the vertical upward direction; and some of the developer can move across the restriction wall from the second container towards the first container.

In a state where the developing device has been rotated by the rotating device and is located at a position opposing the photoconductor, the second container, the restriction wall, and the developer bearing member may be arranged in this order in a horizontal direction.

According to such an image-forming apparatus, since there is a restriction wall, the sealing member is prevented from being pressurized by the developer contained in the second container, even when: the developing device is rotated by the rotating device; the first container, the restriction wall, and the second container are arranged in this order in the vertical upward direction; and some of the developer can move across the restriction wall from the second container towards the first container.

The tip end of the sealing member may be located above a center of rotation of the developer bearing member.

According to such an image-forming apparatus, since the restriction wall is high, the sealing member is prevented from being pressurized by the developer contained in the second container, even when: the developing device is rotated by the rotating device; the first container, the restriction wall, and the second container are arranged in this order in the vertical upward direction; and the developer that moves across the restriction wall from the second container towards the first container is in a state such that it can easily pressurize the tip end of the sealing member.

The sealing member may be a film and abuts against the developer bearing member by being urged by an elastic member.

According to such an image-forming apparatus, even though the sealing member is soft and the developer that pressurizes the sealing member may easily escape, since the restriction wall restricts the developer from pressurizing the sealing member, it is possible to prevent the developer from escaping from the developing device.

Another aspect of the present invention is an image-forming apparatus comprising:

a photoconductor; and a rotating device that is capable of making a plurality of developing devices attached to the rotating device rotate and locating each of the developing devices at a position where the developing device opposes the photoconductor;

each of the developing devices comprising:

a first container for containing developer;

a second container for containing the developer;

a restriction wall for restricting movement of the developer between the first container and the second container;

a developer bearing member for bearing the developer; and a sealing member that is capable of abutting against the developer bearing member and preventing the developer from escaping from the first container, wherein, when the developing device is rotated by the rotating device, the developer contained in the second container is able to go across the restriction wall and move to the first container; and in a state where the developing device has been rotated by the rotating device and is located at a position opposing the photoconductor, an uppermost end of the restriction wall is located above an uppermost end of the sealing member, the second container, the restriction wall, and the developer bearing member are arranged in this order in a horizontal direction, a tip end of the sealing member is located above a center of rotation of the developer bearing member, and the sealing member is a film and abuts against the developer bearing member by being urged by an elastic member.

According to such an image-forming apparatus, since the developer is most effectively restricted from pressurizing the sealing member, it is possible to prevent the developer from escaping from the developing device in the most effective manner.

Another aspect of the present invention is a computer system comprising:

a computer; and an image-forming apparatus that can be connected to the computer, the image-forming apparatus comprising:

a photoconductor; and a rotating device that is capable of making a plurality of developing devices attached to the rotating device rotate and locating each of the developing devices at a position where the developing device opposes the photoconductor, each of the developing devices comprising:

a first container for containing developer;

a second container for containing the developer;

a restriction wall for restricting movement of the developer between the first container and the second container;

a developer bearing member for bearing the developer; and a sealing member that is capable of abutting against the developer bearing member and preventing the developer from escaping from the first container, wherein, in a state where the developing device has been rotated by the rotating device and is located at a position opposing the photoconductor, an uppermost end of the restriction wall is located above a tip end of the sealing member.

Such a computer system is superior to a conventional computer system as a whole.

Example of Overall Configuration of Image-Forming Apparatus

First, with reference to FIG. 1, explanation will be made of an outline of an image-forming apparatus comprising at least one developing device (which is also called a developing unit), taking a laser-beam printer 10 (hereinafter referred to also as "printer") as an example. FIG. 1 is a diagram showing some main structural components constructing the printer 10. In FIG. 1, the arrow indicates the vertical direction; for example, a paper-feed tray 92 is arranged at a lower section of the printer 10, and a fusing unit 90 is arranged at an upper section of the printer 10.

As shown in FIG. 1, the printer 10 according to the present embodiment comprises the following components in the circumferential (rotating) direction of a photoconductor 20, which serves as an image bearing member (or, latent image bearing member) carrying a latent image: an electrical charging unit 30; an exposing unit 40; a YMCK developing device 50 which serves as a rotating member (or a rotating device); a first transferring unit 60; an intermediate transferring element 70; and a cleaning head 75. The printer 10 further comprises: a second transferring unit 80; a fusing unit 90; a displaying unit 95 comprising a liquid-crystal display and serving as notifying means to a user; and a controlling unit (FIG. 2) for controlling these units and the like and managing the operations as a printer.

The photoconductor 20 comprises a cylindrical, conductive base and a photoconductive layer formed on its outer peripheral surface, and is rotatable about a central axis. In the embodiments explained below, the photoconductor 20 rotates clockwise, as shown by the arrow in FIG. 1.

The electrical charging unit 30 is a device for charging the photoconductor 20. The exposing unit 40 is a device for forming a latent image on the charged photoconductor 20 by radiation of laser. The exposing unit 40 comprises, for example, a semiconductor laser, a polygon mirror, an F-θ lens, and the like, and radiates modulated laser onto the charged photoconductor 20 according to the image signal having been input from the host computer (not shown) such as a personal computer, a word processor, and the like.

The YMCK developing device 50 is a device for developing the latent image formed on the photoconductor 20 using the black (K) toner contained in a black developing device 51, the magenta (M) toner contained in a magenta developing device 52, the cyan (C) toner contained in a cyan developing device 53, and the yellow (Y) toner contained in a yellow developing device 54.

Figure 24:
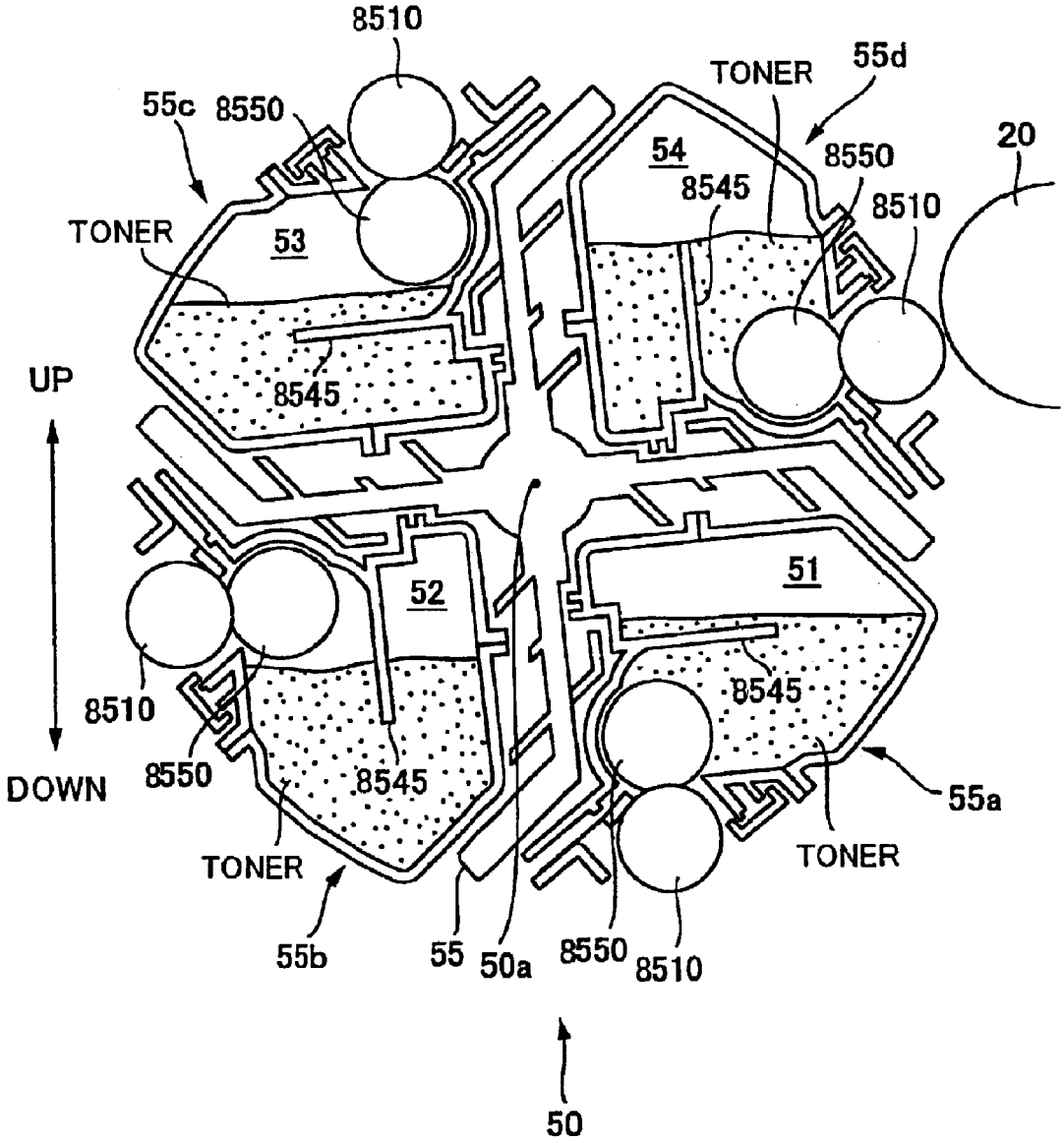
FIG. 24 is a diagram showing some main structural components of a YMCK developing device.

In the present embodiment, the YMCK developing device 50 can move the positions of the four developing devices 51, 52, 53, 54 through rotation. More specifically, the YMCK developing device 50 holds the four developing devices 51, 52, 53, 54 with four holders, or holding sections, 55*a*, 55*b*, 55*c*, 55*d* of a support frame 55. (See FIG. 24 for details.) The four developing devices 51, 52, 53, 54 can be rotated about a rotating shaft 50*a*, which is an axis of rotation, while maintaining their relative positions. Every time the photoconductor 20 finishes forming an image for 1 page, the developing devices 51, 52, 53, 54 selectively oppose the photoconductor 20 and develop the latent image formed on the photoconductor 20 with the toner, which serves as a developer, contained respectively in the developing devices 51, 52, 53, 54. Details on each of the developing devices will be explained later. (Further, by this rotation, the toner will be able to move across a restriction wall 545 that is provided in each of the developing devices 51, 52, 53, 54.)

The first transferring unit 60 is a device for transferring a single-color toner image formed on the photoconductor 20 onto the intermediate transferring element 70. When the toners of all four colors are sequentially transferred in a superimposing manner, a full-color toner image will be formed on the intermediate transferring element 70. The intermediate transferring element 70 is an endless (annular) belt, and is rotatingly driven at substantially the same circumferential speed as the photoconductor 20. The second transferring unit 80 is a device for transferring the single-color toner image or the full-color toner image formed on the intermediate transferring element 70 onto a recording medium, such as paper, film, cloth, and the like.

The fusing unit 90 is a device for fusing, to the recording medium such as paper, the single-color toner image or the full-color toner image which has been transferred onto the recording medium, to make it into a permanent image.

The cleaning unit 75 is a device which is provided between the first transferring unit 60 and the electrical charging unit 30, has a rubber cleaning blade 76 placed in contact with (or, abutting against) the surface of the photoconductor 20, and can remove the toner remaining on the photoconductor 20 by scraping it off with the cleaning blade 76 after the toner image has been transferred onto the intermediate transferring element 70 by the first transferring unit 60.

Figure 2:
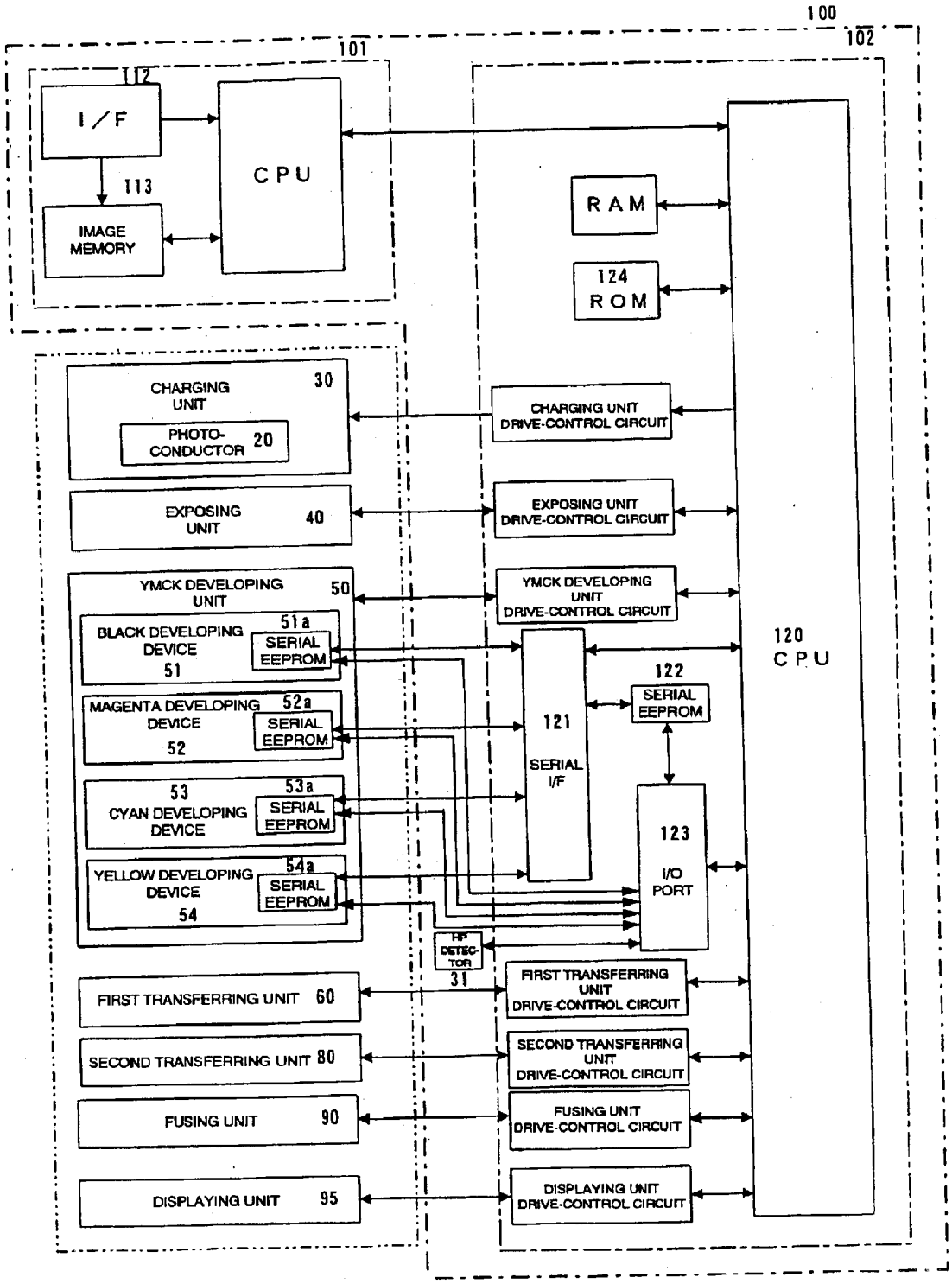
FIG. 2 is a block diagram showing a controlling unit of the image-forming apparatus of FIG. 1.

The controlling unit 100 comprises a main controller 101 and a unit controller 102 as shown in FIG. 2. An image signal is input to the main controller 101; according to instructions based on the image signal, the unit controller 102 controls each of the above-mentioned units and the like, to form an image.

Next, explanation will be made of operations of the printer 10 structured as above, with reference to other structural components.

First, when an image signal is input from the host computer (not shown) to the main controller 101 of the printer 10 through an interface (I/F) 112, the photoconductor 20, a developing roller provided on the developing device as a developer bearing member (or toner carrier), and the intermediate transferring element 70 rotate under the control of the unit controller 102 based on the instructions from the main controller 101. While rotated, the photoconductor 20 is sequentially charged by the electrical charging unit 30 at a charging position.

With the rotation of the photoconductor 20, the charged area of the photoconductor 20 reaches an exposure position. A latent image in accordance with image information about the first color, such as yellow Y, is formed in the charged area by the exposing unit 40. The YMCK developing device 50 locates the yellow developing device 54 containing yellow (Y) toner in a developing position opposing the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring element 70 by the first transferring unit 60.

Here, a first transferring voltage, having an opposite polarity from the charge polarity of the toner, is applied to the first transferring unit 60. During the above, the second transferring unit 80 is kept apart from the intermediate transferring element 70.

By repeating the above-mentioned process for the second, the third, and the fourth colors, toner images in four colors corresponding to the respective image signals are transferred to the intermediate transferring element 70 in a superimposed manner. As a result, a full-color toner image is formed on the intermediate transferring element 70.

With the rotation of the intermediate transferring element 70, the full-color toner image formed on the intermediate transferring element 70 reaches a second transferring position, and is transferred onto a recording medium by the second transferring unit 80. The recording medium is carried from the paper-feed tray 92 to the second transferring unit 80 through the paper-feed roller 94 and resisting rollers 96. While the image is being transferred, a second transferring voltage is applied to the second transferring unit 80 as the unit 80 is pressed against the intermediate transferring element 70.

The full-color toner image transferred onto the recording medium is heated and pressurized by the fusing unit 90 and fused to the recording medium.

On the other hand, after the photoconductor 20 passes the first transferring position, the toner attaching to the surface of the photoconductor 20 is scraped off by the cleaning blade 76 that is supported to the cleaning unit 75, and the photoconductor 20 is prepared for charging for forming a next latent image. The scraped-off toner is collected in a remaining-toner collector that the cleaning unit 75 comprises.

===Outline of Controlling Unit===

Next, with reference to FIG. 2, explanation will be made of the configuration of the controlling unit 100. The main controller 101 of the controlling unit 100 is connected to the host computer through an interface (I/F) 112 and comprises an image memory 113 for storing image signals input from the host computer. The unit controller 102 is electrically connected to each of the units of the printer apparatus (i.e., the electrical charging unit 30, the exposing unit 40, the first transferring unit 60, the cleaning unit 75, the second transferring unit 80, the fusing unit 90, and the displaying unit 95) and to the YMCK developing device 50. By receiving signals from sensors provided on each of the units and the YMCK developing device 50, the unit controller 102 detects the state of each of the units and the YMCK developing device 50; the unit controller 102 also controls each of the units and the YMCK developing device 50 according to the signals input from the main controller 101.

Further, the unit controller 102 has a CPU 120. The CPU 120 is connected to a nonvolatile storing element (hereinafter referred to as "printer-side memory") 122, such as a serial EEPROM, through a serial interface (I/F) 121.

Further, other than the printer-side memory 122, developing-device memories 51*a*, 52*a*, 53*a*, 54*a* provided respectively on the developing devices 51, 52, 53, 54 are also connected to the CPU 120 through the serial interface 121. This enables data transfer among the printer-side memory 122 and the developing-device memories 51*a*, 52*a*, 53*a*, 54*a*; also, it becomes possible to input chip-select signals CS to the respective developing-device memories 51*a*, 52*a*, 53*a*, 54*a* through an input/output port 123. Further, the CPU 120 is connected to an HP detector 31 through the input/output port 123.

===Outline of the First Embodiment of the Developing Device===

Figure 3:
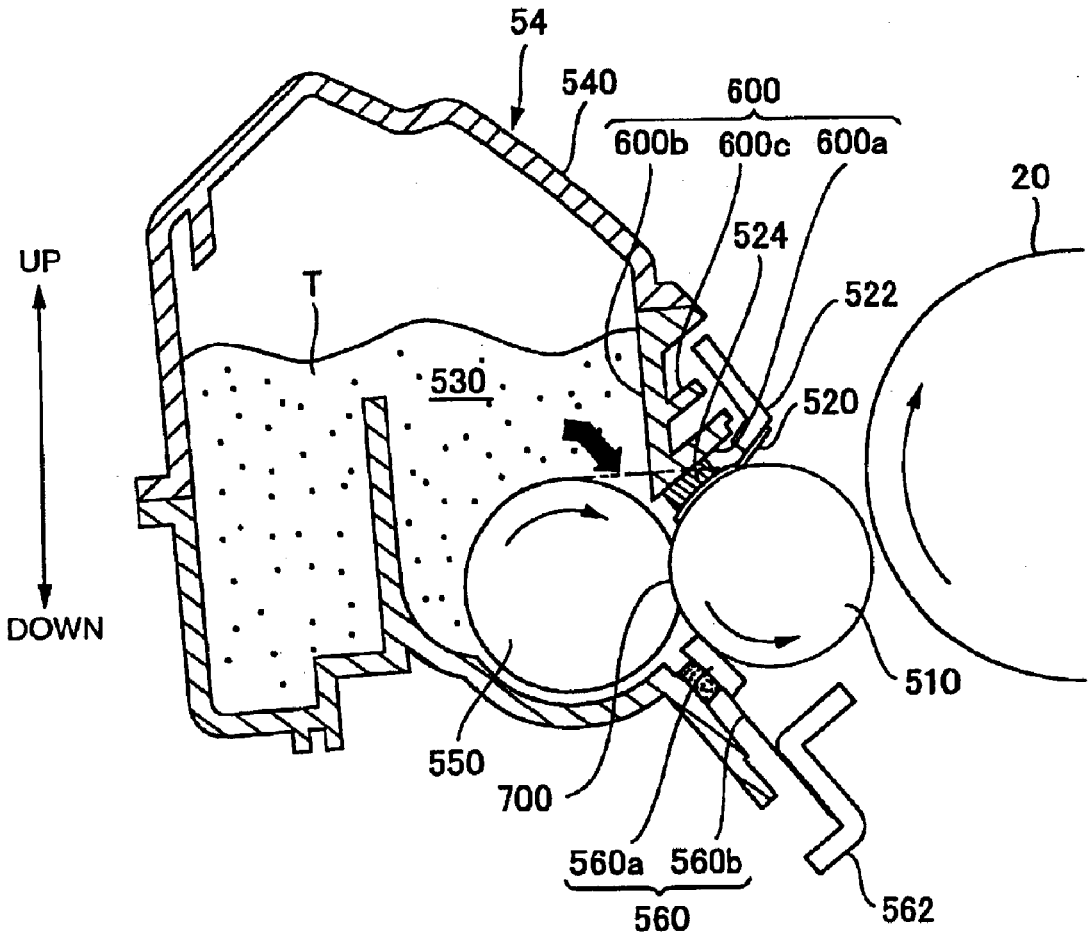
FIG. 3 is a section view showing some main structural components of a developing device according to a first embodiment.

Next, with reference to FIG. 3, explanation will be made of an outline of a configuration of the developing device. FIG. 3 is a section view showing some main structural components of the developing device. As in FIG. 1, in FIG. 3, the arrow indicates the vertical directions; for example, the central axis of the developing roller 510 is located below the central axis of the photoconductor 20. Further, FIG. 3 shows a state in which the yellow developing device 54 is located in the developing position opposing the photoconductor 20.

The YMCK developing device 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made of only the yellow developing device 54.

The yellow developing device 54 comprises, for example: the developing roller 510, which serves as a developer bearing member; a sealing member 520; a toner container 530, which serves as a developer container; a frame 540; a toner-supplying roller 550, which serves as a developer supplying member; a restriction blade 560, which serves as an electrical charging member; a blade-backing member (not shown) for urging the restriction blade 560; a flow-path restricting member 600; and an abutting section (or the so-called "nip") 700.

The developing roller 510 carries toner T and delivers it to a developing position opposing the photoconductor 20. The developing roller 510 is made from, for example, aluminum, stainless steel, or iron, and the roller 510 is plated with, for example, nickel plating, chromium plating and the like, as necessary. Further, the developing roller 510 is rotatable about a central axis. As shown in FIG. 3, in the present embodiment, the roller 510 rotates in the opposite direction (counterclockwise in FIG. 3) to the rotating direction of the photoconductor 20 (clockwise in FIG. 3). The central axis of the roller 510 is located below the central axis of the photoconductor 20.

As shown in FIG. 3, in the state where the yellow developing device 54 opposes the photoconductor 20, there exists a gap between the developing roller 510 and the photoconductor 20. That is, the yellow developing device 54 develops the latent image formed on the photoconductor 20 in a non-contacting state. Note that an alternating field is generated between the developing roller 510 and the photoconductor 20 upon developing the latent image formed on the photoconductor 20.

The sealing member 520 abuts against the upper section of the developing roller 510 and is provided to prevent the toner T in the yellow developing device 54 from escaping out from the device as well as collect the toner T, which is on the developing roller 510 that has passed the developing position, into the developing device without scraping. The sealing member 520 is a seal made from, for example, polyethylene film and the like. The sealing member 520 is supported by a seal-supporting metal plate 522, and is attached to the frame 540 through the seal-supporting metal plate 522. On the opposite side of the developing roller 510 side, the sealing member 520 is provided with a seal-urging member 524 made from, for example, Moltoprene and the like. The sealing member 520 is pressed against the developing roller 510 by the elastic force of the seal-urging member 524.

The toner container 530 is a section for receiving (containing) the toner T. A portion of the frame 540 structures the container 530. A stirring member for stirring the toner T contained in the toner container 530 may be provided. However, in the present embodiment, each of the developing devices (the black developing device 51, the magenta developing device 52, the cyan developing device 53, and the yellow developing device 54) rotate with the rotation of the YMCK developing device 50, and the toner T contained in each developing device is stirred according to this rotation; thus, the toner container 530 does not comprise a stirring member.

The toner-supplying roller 550 is capable of supplying the toner T contained in the toner container 530 to the developing roller 510 at the abutting section 700. The toner-supplying roller 550 is made from, for example, polyurethane foam and the like, and abuts against the developing roller 510 at the abutting section 700 in an elastically-deformed state. The toner-supplying roller 550 is arranged at a lower section of the toner container 530. The toner T contained in the toner container 530 is supplied to the developing roller 510 by the toner-supplying roller 550 at the lower section of the toner container 530. The toner-supplying roller 550 is rotatable about a central axis. The central axis is situated below the central axis of rotation of the developing roller 510. Further, in the present embodiment, the toner-supplying roller 550 rotates in the opposite direction (clockwise in FIG. 3) to the rotating direction of the developing roller 510 (counterclockwise in FIG. 3). Note that, other than the function of supplying the toner T contained in the toner container 530 to the developing roller 510, the toner supplying roller 550 also has the function of stripping the toner remaining on the developing roller 510 after development off from the developing roller 510.

The restriction blade 560, which serves as an electrical charging member, is made so that it abuts against the lower section of the developing roller 510. The restriction blade 560 restricts the thickness of the layer of the toner T bore by the developing roller 510 and also gives charge to the toner T bore by the developing roller 510. The restriction blade 560 comprises a rubber portion 560*a* and a rubber-supporting portion 560*b*. The rubber portion 560*a* is made from, for example, silicone rubber, urethane rubber, and the like. The rubber-supporting portion 560*b* is a thin plate made from, for example, phosphor bronze, stainless steel, and the like having a springy characteristic. The rubber portion 560*a* is supported by the rubber-supporting portion 560*b*. The rubber-supporting portion 560*b* is attached to the frame 540 through a pair of blade-supporting metal plates 562, in a way such that one end of the rubber-supporting portion 560*b* is pinched between the blade-supporting metal plates 562. On the opposite side of the side at which the developing roller 510 is located, the restriction blade 560 is provided with a blade-backing member (not shown) made from Moltoprene and the like.

The rubber portion 560*a* is pressed against the developing roller 510 by the elastic force caused by bending of the rubber-supporting portion 560*b*. Further, the blade-backing member prevents toner from entering between the rubber-supporting portion 560*b* and the frame 540, stabilizes the elastic force caused by bending of the rubber-supporting portion 560*b*, and also urges the rubber portion 560*a* from the back thereof towards the developing roller 510 to press the rubber portion 560*a* against the developing roller 510. Thus, the blade-backing member can make the rubber portion 560*a* abut against the developing roller 510 more evenly.

The other end of the restricting blade 560 that is not being supported by the blade-supporting metal plates 562 (i.e., the tip end of the restriction blade 560) does not contact the developing roller 510; rather, a section at a predetermined distance from the tip end contacts, with some breadth, the developing roller 510. In other words, the restriction blade 560 does not abut against the developing roller 510 with its end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510.

The frame 540 is manufactured by joining a plurality of integrally-molded frames (for example, an upper frame, a bottom frame, and the like). The frame 540 has an opening at its lower section. The developing roller 510 is arranged at the opening in a state in which a portion of the roller 510.is exposed towards the outside of the developing device. Further, in the present embodiment, a flow-path restricting member 600 is integrally joined to the frame 540 such that it structures a part of the frame. This is advantageous in terms of both strength of the flow-path restricting member 600 and manufacturability.

In the yellow developing device 54 thus structured, as the toner-supplying roller 550 rotates, it supplies the toner T contained in the toner container 530 to the developing roller 510 at the abutting section 700. Having been supplied to the developing roller 510, with the rotation of the developing roller 510, the toner T reaches the abutting position of the restriction blade 560; and, as the toner T passes the abutting position, the toner is charged and its thickness is restricted. Having its thickness being restricted, with further rotation of the developing roller 510, the toner T on the developing roller 510 reaches the developing position opposing the photoconductor 20; then, under the alternating field, the toner T is used for developing the latent image formed on the photoconductor 20 at the developing position. Having passed the developing position, with further rotation of the developing roller 510, the toner T on the developing roller 510 passes the sealing member 520 and is collected into the developing device by the sealing member 520 without being scraped off.

Next, explanation will be made of the flow-path restricting member 600. The flow-path restricting member 600 joined integrally to the frame 540 comprises a first wall 600*a* and a second wall 600*b*. In the horizontal direction, the first wall 600*a* extends in a slanting direction from the developing roller 510 towards the toner supplying roller 550. The second wall 600*b* extends from above and down towards the vicinity of an upper area of the abutting section 700. Further, a flange 600*c* protrudes from the backside of the flow-path restricting member 600, that is, from the opposite side of the container 530 of the developing device 54. The flange 600*c* serves to strengthen the structure of the flow-path restricting member 600.

The first wall 600*a* and the second wall 600*b* form a sharp, acute tip end. As shown in FIG. 3, the tip is located, in the horizontal direction, between the abutting section 700 and the center of rotation of the toner supplying roller 550. Further, in the present embodiment, the tip end of the flow-path restricting member 600 is located relatively close to the toner supplying roller 550. However, note that there is a gap with a predetermined size provided between the tip end and the toner supplying roller 550. The toner T reaches the abutting section 700 from the upper section of the container 530 by passing through this gap.

Next, explanation will be made of the effects obtained by providing such a flow-path restricting member 600. The YMCK developing device 50, which is a rotating member, rotates intermittently. Due to the centrifugal force caused during rotation of the YMCK developing device 50, the toner T is subjected to an outward force in the direction from the rotating shaft 50*a* towards the outside. Further, the toner T is always subjected to a vertically-downward force by gravitation, not only when the YMCK developing device 50 is rotating. As a result, during rotation of the YMCK developing device 50, the toner T tends to flow substantially in the direction shown by the black arrow in FIG. 3. Note that the size of the black arrow has no particular meaning. Further, when the YMCK developing device 50 is not rotating, the direction of the black arrow will be in a vertically downward direction (not shown).

In the present embodiment, the wedge-shaped flow-path restricting member 600 is provided so that it ranges, in the horizontal direction, from the developing roller 510, above and across the abutting section 700, and to a position above the toner supplying roller 550 and that slightly covers it. According to such a structure, the flow of the toner T (cf. the black arrow) flowing from the upper area of the abutting section 700 to the abutting section 700 is once suppressed because the flow collides against the flow-path restricting member 600. By arranging the flow-path restricting member 600 so that it covers at least the area right above the abutting section 700, it is possible to intercept the flow that would otherwise directly reach the abutting section 700 from right above the abutting section 700.

Note that, even if the structure of the flow-path restricting member 600 shown in FIG. 3 is changed in a manner that the second wall 600*b*, which is provided substantially in the vertical direction, is omitted and only the first wall 600*a*, which extends from the developing roller 510 side to the toner supplying roller 550 side (in the horizontal direction), is provided, it would be possible to restrict, with the first wall 600*a*, the flow of toner T that reaches the abutting section 700 from above. Explanation of such a modified example will be made later.

By providing a flow-path restricting member 600, since it is possible to intercept the flow that would otherwise directly reach the abutting section 700 from right above the abutting section 700, it becomes possible to prevent variation in the pressure of the toner T that is applied to the abutting section 700, and it becomes possible to stabilize supplying of the toner T to the developing roller 510 at the abutting section 700 with the toner supplying roller 550.

Further, in the present embodiment, the tip end of the flow-path restricting member 600 is located, in the horizontal direction, between the abutting section 700 and the center of rotation of the toner supplying roller 550. With such a structure, it is possible to restrict the flow of toner T that reaches the abutting section 700 throughout a range above the abutting section 700 and having a certain breadth in the horizontal direction, and not only restrict the flow in the area right above the abutting section 700.

Further, although the tip end of the flow-path restricting member 600 is located relatively close to the toner supplying roller 550, there still is a gap between the abutting section 700 and the roller 550. Therefore, it becomes possible to carry the toner T to the abutting section 700 at a stable amount, by intercepting the flow that reaches the abutting section 700 from above the abutting section 700 and making the toner T pass through this gap with the rotation of the toner supplying roller 550.

As explained, the toner T is carried to the abutting section 700 at a stable amount with the rotation of the toner supplying roller 550, by passing through the gap between tip end of the flow-path restricting member 600 and the toner supplying roller 550 while the flow path that leads from above directly to the abutting section 700 is being restricted by the flow-path restricting member 600. The toner T is then carried to a position opposing the photoconductor 20 by the developing roller 510 that rotates in the opposite direction to the toner supplying roller 550. While the toner is carried, the restriction blade 560 restricts the layer thickness of the toner and charges the toner. Since the toner T is stably delivered at the abutting section 700, it becomes possible to also stabilize the charging characteristics of the toner T, thereby keeping the quality of the finally-formed image stable and high.

Further, the sealing member 520 that abuts against the developing roller 510 and capable of preventing the toner T from escaping from the container 530 is provided above the tip end of the flow-path restricting member 600 and located closer to the developing roller 510 than the tip end of the member 600. Therefore, it becomes possible to reduce variations in pressure applied to the sealing member 520 which would occur due to the difference in the amount of toner T that exists above the abutting section 700, and thereby prevent the toner T from escaping.

Other Examples

Figure 4:
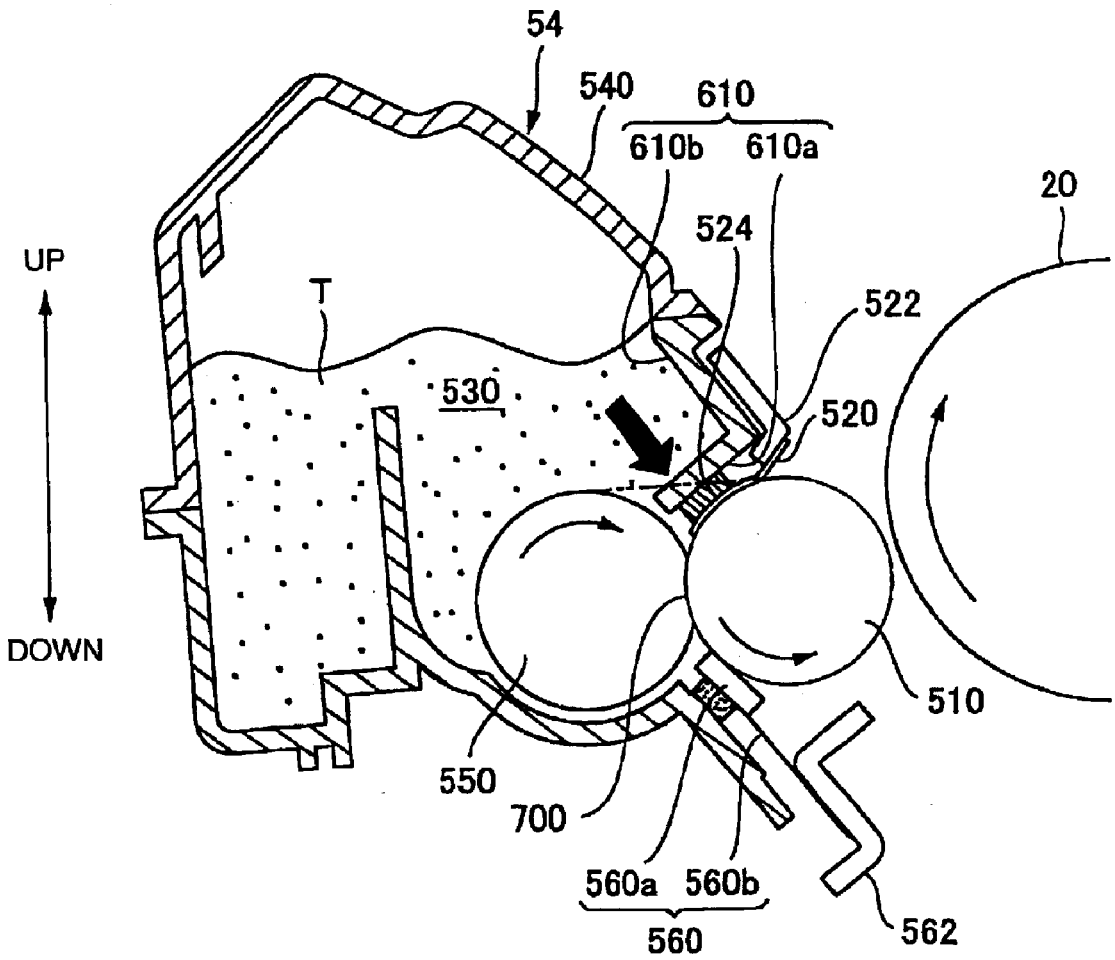
FIG. 4 is a section view showing some main structural components of a developing device according to a modified example of the first embodiment.

In the foregoing embodiment, the flow-path restricting member is structured to comprise a first wall 600*a*, a second wall 600*b*, and a flange 600*c*. However, the structure is not limited to the above. For example, a structure in which the flow-path restricting member 610 comprises a cover member 610*a* and a body 610*b* as shown in FIG. 4 can be adopted. Even with the flow-path restricting member 610 shown in FIG. 4, since the cover member 610*a* will intercept the flow path leading from right above the abutting section 700 to the abutting section, it is possible to prevent the toner T from colliding against the abutting section 700 at high pressure and realize stable supplying of the toner T to the abutting section 700. Further, the tip end of the cover member 610*a* of the flow-path restricting member 610 is located, in the horizontal direction, between the abutting section 700 and the center of rotation of the toner supplying roller 550, but there still is a gap between the abutting section 700 and the roller 550 though it may be narrow. Therefore, it becomes possible to prevent the toner T from colliding against the abutting section 700 at high pressure throughout a broad horizontal range, and not only at an area right above the abutting section 700, and, since the toner T reaches the abutting section 700 by passing through the gap, it also becomes possible to stably supply the toner T to the abutting section 700.

Figure 5:
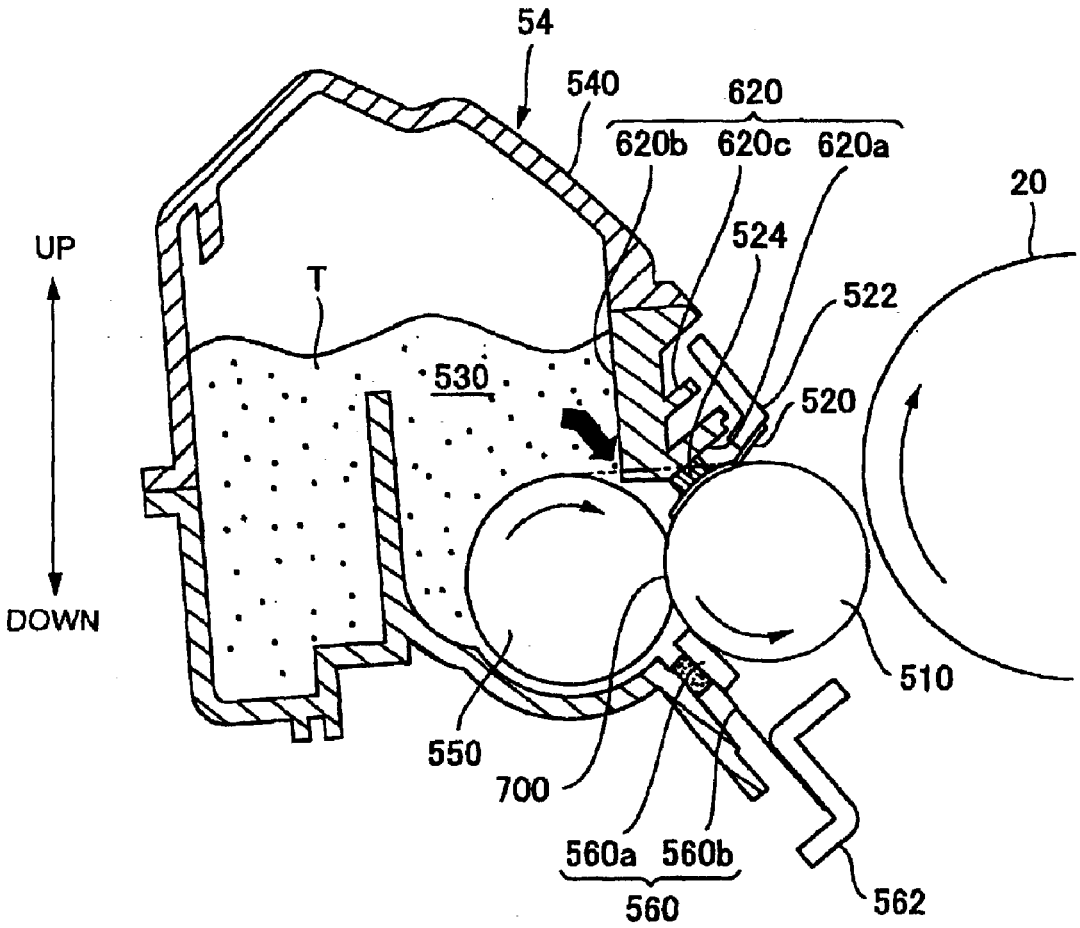
FIG. 5 is a section view showing some main structural components of a developing device according to another modified example of the first embodiment.

Further, in the foregoing embodiment, a wedge-shaped flow-path restricting member having a sharp tip end is adopted. However, the structure is not limited to the above. For example, the flow-path restricting member may comprise a flat end that has a notch at its tip as shown in FIG. 5. Further, the flow-path restricting member 620 shown in FIG. 5 is similar to the flow-path restricting member 600 described in the foregoing embodiment in terms that it comprises a first wall 620*a*, a second wall 620*b*, and a flange 620*c*; however, in the flow-path restricting member 620 of FIG. 5, the second wall 620*b* is thicker than that of the foregoing embodiment. Even with the flow-path restricting member 620 shown in FIG. 5, since the flow path of the toner T leading from right above the abutting section 700 to the abutting section is intercepted, it is possible to prevent the toner T from colliding against the abutting section 700 at high pressure and realize stable supplying of the toner T. Further, the tip end of the flow-path restricting member 620 is located, in the horizontal direction, between the abutting section 700 and the center of rotation of the toner supplying roller 550, and there still is a gap between the abutting section 700 and the roller 550 though it may be narrow. Therefore, it becomes possible to prevent the toner T from colliding against the abutting section 700 at high pressure throughout a broad horizontal range, and not only at an area right above the abutting section 700, and, since the toner T reaches the abutting section 700 by passing through the gap, it also becomes possible to stably supply the toner T to the abutting section 700.

Further, in the foregoing embodiment, the position of the tip end of the flow-path restricting member 600 is arranged, in the horizontal direction, between the abutting section 700 and the center of rotation of the toner supplying roller 550, which serves as a developer supplying member. However, the structure is not limited to the above. For example, the tip end may be located on the left-hand side of the center of rotation of the toner supplying roller 550; that is, the tip end may be located further away from the abutting section 700. Even with a flow-path restricting member having such a shape, the toner T is prevented from colliding against the abutting section 700 at high pressure throughout a broad horizontal range, and not only at an area right above the abutting section 700, and it becomes possible to stably supply the toner T to the abutting section 700.

In the foregoing embodiment, as shown in FIG. 3, the toner supplying roller 550 is to rotate clockwise. However, the configuration is not limited to the above. For example, the roller 550 may rotate counterclockwise in FIG. 3.

Further, in the foregoing embodiment, the toner supplying roller 550 is an elastic member. However, the structure is not limited to the above. For example, the toner supplying roller 550 does not have to be an elastic member.

Further, in the foregoing embodiment, the sealing member 520 is made from film. However, the structure is not limited to the above. For example, the sealing member 520 may be made from a stiff material other than film.

===Outline of the Second Embodiment of the Developing Device===

First Example

Figure 6:
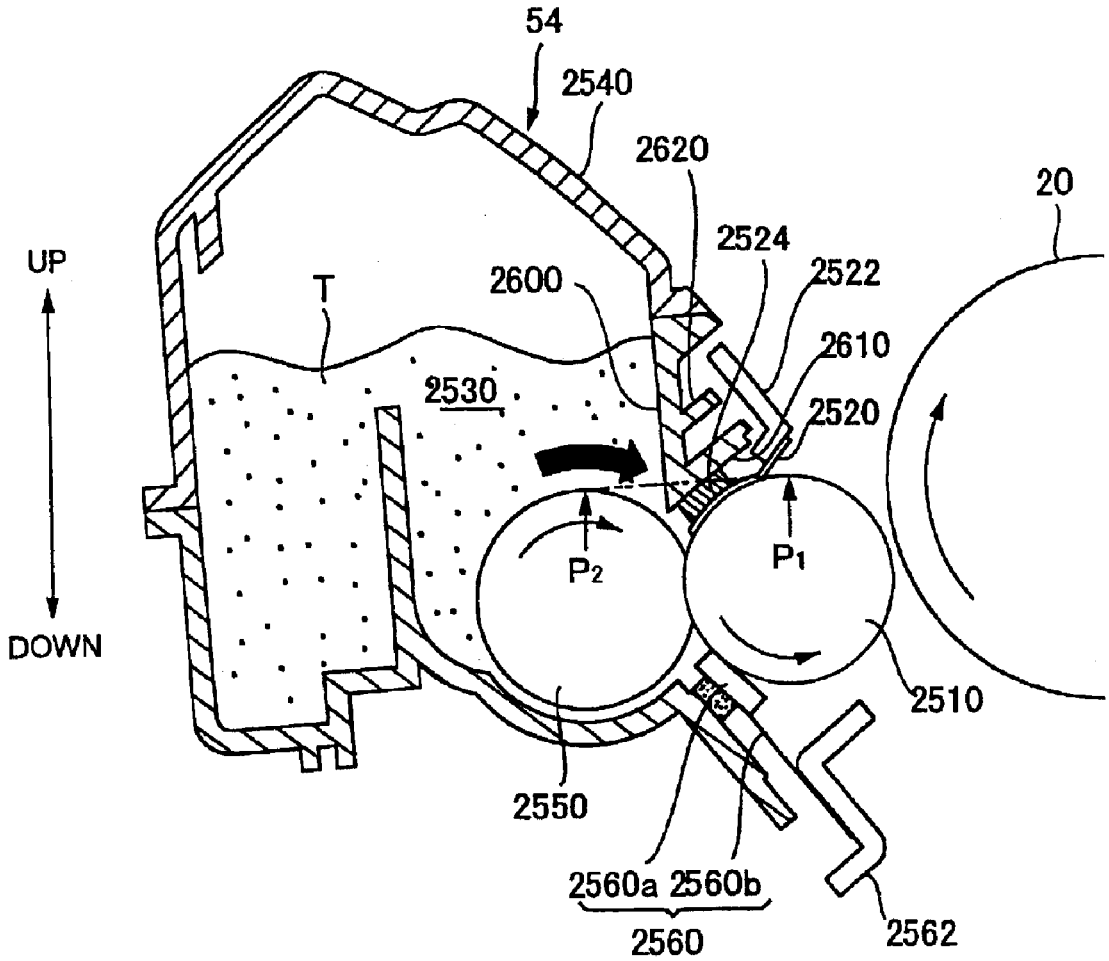
FIG. 6 is a section view showing some main structural components of a developing unit according to a second embodiment.

Next, with reference to FIG. 6, explanation will be made of an outline of a configuration of the developing unit according to a first example. FIG. 6 is a section view showing some main structural components of the developing unit. As in FIG. 1, in FIG. 6, the arrow indicates the vertical directions; for example, the central axis of the developing roller 2510 is located below the central axis of the photoconductor 20. Further, FIG. 6 shows a state in which the yellow developing unit 54 is located in the developing position opposing the photoconductor 20.

The YMCK developing device 50 comprises: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, explanation will be made of only the yellow developing unit 54.

The yellow developing unit 54 comprises, for example: the developing roller 2510, which serves as a developer bearing member; a sealing member 2520; a toner container 2530, which serves as a developer container; a frame 2540; a toner-supplying roller 2550, which serves as a developer supplying member; a restriction blade 2560, which serves as a thickness restricting member; a blade-backing member (not shown) for urging the restriction blade 2560; and a wall portion 2600. As shown in FIG. 6, in the present example, the sealing member 2520 abuts against the upper section of the developing roller 2510, and the restriction blade 2560 abuts against the lower section of the developing roller 2510.

The developing roller 2510 carries toner T and delivers it to a developing position opposing the photoconductor 20. The developing roller 2510 is made from, for example, aluminum, stainless steel, or iron, and the roller 2510 is plated with, for example, nickel plating, chromium plating and the like, as necessary. Further, the developing roller 2510 is rotatable about a central axis. As shown in FIG. 6, in the present embodiment, the roller 2510 rotates in the opposite direction (counterclockwise in FIG. 6) to the rotating direction of the photoconductor 20 (clockwise in FIG. 6). The central axis of the roller 2510 is located below the central axis of the photoconductor 20.

As shown in FIG. 6, in the state where the yellow developing unit 54 opposes the photoconductor 20, there exists a gap between the developing roller 2510 and the photoconductor 20. That is, the yellow developing unit 54 develops the latent image formed on the photoconductor 20 in a non-contacting state. Note that an alternating field is generated between the developing roller 2510 and the photoconductor 20 upon developing the latent image formed on the photoconductor 20.

The sealing member 2520 abuts against the upper section of the developing roller 2510 at an abutting section (not shown in the figure) and is provided to prevent the toner T in the yellow developing unit 54 from escaping out from the device as well as collect the toner T, which is on the developing roller 2510 that has passed the developing position, into the developing unit without scraping. The sealing member 2520 is a seal made from, for example, polyethylene film and the like. The sealing member 2520 is supported by a seal-supporting metal plate 2522, and is attached to the frame 2540 through the seal-supporting metal plate 2522. On the opposite side of the developing roller 2510 side, the sealing member 2520 is provided with a seal-urging member 2524 made from, for example, Moltoprene and the like. The sealing member 2520 is pressed against the developing roller 2510 by the elastic force of the seal-urging member 2524.

The toner container 2530 is a section for receiving (containing) the toner T. A portion of the frame 2540 structures the container 2530. A stirring member for stirring the toner T contained in the toner container 2530 may be provided. However, in the present embodiment, each of the developing units (the black developing unit 51, the magenta developing unit 52, the cyan developing unit 53, and the yellow developing unit 54) rotate with the rotation of the YMCK developing device 50, and the toner T contained in each developing unit is stirred according to this rotation; thus, the toner container 2530 does not comprise a stirring member.

The toner-supplying roller 2550 is capable of supplying the toner T contained in the toner container 2530 to the developing roller 2510. The toner-supplying roller 2550 is made from, for example, polyurethane foam and the like, and abuts against the developing roller 2510 in an elastically-deformed state. The toner-supplying roller 2550 is arranged at a lower section of the toner container 2530. The toner T contained in the toner container 2530 is supplied to the developing roller 2510 by the toner-supplying roller 2550 at the lower section of the toner container 2530. The toner-supplying roller 2550 is rotatable about a central axis. The central axis is situated below the central axis of rotation of the developing roller 2510. Further, the toner-supplying roller 2550 rotates in the opposite direction (clockwise in FIG. 6) to the rotating direction of the developing roller 2510 (counterclockwise in FIG. 6). Note that, other than the function of supplying the toner T contained in the toner container 2530 to the developing roller 2510, the toner supplying roller 2550 also has the function of stripping the toner remaining on the developing roller 2510 after development off from the developing roller 2510.

The restriction blade 2560, which serves as a thickness restricting member, is made so that it abuts against the lower section of the developing roller 2510. The restriction blade 2560 restricts the thickness of the layer of the toner T bore by the developing roller 2510 and also gives charge to the toner T bore by the developing roller 2510. The restriction blade 2560 comprises a rubber portion **2560*a* and a rubber-supporting portion 2560*b*. The rubber portion 2560*a* is made from, for example, silicone rubber, urethane rubber, and the like. The rubber-supporting portion 2560*b* is a thin plate made from, for example, phosphor bronze, stainless steel, and the like having a springy characteristic. The rubber portion 2560*a* is supported by the rubber-supporting portion 2560*b*. The rubber-supporting portion 2560*b* is attached to the frame 2540 through a pair of blade-supporting metal plates 2562, in a way such that one end of the rubber-supporting portion 2560*b* is pinched between the blade-supporting metal plates 2562. On the opposite side of the side at which the developing roller 2510 is located, the restriction blade 2560** is provided with a blade-backing member (not shown) made from Moltoprene and the like.

The rubber portion **2560*a* is pressed against the developing roller 2510 by the elastic force caused by bending of the rubber-supporting portion 2560*b*. Further, the blade-backing member prevents toner from entering between the rubber-supporting portion 2560*b* and the frame 2540, stabilizes the elastic force caused by bending of the rubber-supporting portion 2560*b*, and also urges the rubber portion 2560*a* from the back thereof towards the developing roller 2510 to press the rubber portion 2560*a* against the developing roller 2510. Thus, the blade-backing member can make the rubber portion 2560*a* abut against the developing roller 2510** more evenly.

The other end of the restricting blade 2560 that is not being supported by the blade-supporting metal plates 2562 (i.e., the tip end of the restriction blade 2560) does not contact the developing roller 2510; rather, a section at a predetermined distance from the tip end contacts, with some breadth, the developing roller 2510. In other words, the restriction blade 2560 does not abut against the developing roller 2510 with its end, but abuts against the roller 2510 near its central portion. Further, the restriction blade 2560 is arranged so that its tip end faces towards the upper stream of the rotating direction of the developing roller 2510, and thus, makes a so-called counter-contact with respect to the roller 2510.

The frame 2540 is manufactured by joining a plurality of integrally-molded frames (for example, an upper frame, a bottom frame, and the like). The frame 2540 has an opening at its lower section. The developing roller 2510 is arranged at the opening in a state in which a portion of the roller 2510 is exposed towards the outside of the developing unit. Further, in the present embodiment, the wall portion 2600 is integrally joined to the frame 2540 such that it structures a part of the frame. This is advantageous in terms of both strength of the wall portion 2600 and manufacturability.

In the yellow developing unit 54 thus structured, the toner-supplying roller 2550 supplies the toner T contained in the toner container 2530 to the developing roller 2510. Having been supplied to the developing roller 2510, with the rotation of the developing roller 2510, the toner T reaches the abutting position of the restriction blade 2560; and, as the toner T passes the abutting position, the toner is charged and its thickness is restricted. Having its thickness being restricted, with further rotation of the developing roller 2510, the toner T on the developing roller 2510 reaches the developing position opposing the photoconductor 20; then, under the alternating field, the toner T is used for developing the latent image formed on the photoconductor 20 at the developing position. Having passed the developing position, with further rotation of the developing roller 2510, the toner T on the developing roller 2510 passes the sealing member 2520 and is collected into the developing unit by the sealing member 2520 without being scraped off.

Next, explanation will be made of the wall portion 2600. The wall portion 2600 joined integrally to the frame 2540 extends in the vertical direction, and its sharp tip end (lower end) is arranged close to the lower end of a section (abutting section) at which the sealing member 2520 abuts against the developing roller 2510. Further, the wall portion 2600 is substantially vertical when the yellow developing unit 54 is located in the developing position as shown in FIG. 6. Therefore, the wall portion 2600 thus arranged extends in the direction such that it intersects the radial direction (not shown; refer to FIG. 1) of the YMCK developing device 50, which is a rotating member.

Further, the wall portion 2600 of the present embodiment comprises a second wall portion 2610 that is arranged obliquely upwards continuing from the lower end (tip end) of the wall portion 2600. The sealing member 2520 is located beneath the second wall portion 2610. The upper surface of the seal-urging member 2524, which is urged towards the second wall portion 2610 and the sealing member 2520, abuts against the lower surface of the second wall portion 2610. A flange 2620 protrudes from the back-side of the wall portion 2600, that is, from the opposite side of the container 2530 of the developing device 54. The flange 2620 serves to strengthen the structure of the wall portion 2600.

Further, the inner surface of the wall portion 2600, that is, the surface that is in contact with the container 2530, is located above the toner supplying roller 2550, rather than right above the developing roller 2510. The lower end of the wall portion 2600 comes beneath a line that passes through the uppermost point P1 of the developing roller 2510 and the uppermost point P2 of the toner supplying roller 2550.

Next, explanation will be made of the effects obtained by providing such a wall portion 2600. The YMCK developing device 50, which is a rotating member, rotates intermittently. Due to the centrifugal force caused during rotation of the YMCK developing device 50, the toner T is subjected to an outward force in the direction from the rotating shaft 50*a* towards the outside. Further, the toner T is always subjected to a vertically-downward force by gravitation. As a result, during rotation of the YMCK developing device 50, the toner T tends to flow substantially in the direction shown by the black arrow in FIG. 6. Note that the size of the black arrow has no particular meaning.

If the wall portion 2600 is not provided, the toner T that flows with great force in the direction of the black arrow will collide against the abutting section where the sealing member 2520 abuts against the developing roller 2510. The shock caused thereby will cause the toner T to escape out from the developing unit 54. On the other hand, when the wall portion 2600 intercepts the flow of toner, since it is possible to prevent the toner T from colliding directly against the abutting section, it becomes possible to prevent the toner T from escaping outside.

In the present embodiment, the lower end of the wall portion 2600 extends to the vicinity of the lower end of the sealing member 2520. However, if the lower end of the wall portion 2600 extends at least beyond the upper end of the abutting section, it is possible to intercept the collision of the toner T and prevent the toner from escaping outside.

As shown in FIG. 6, since the wall portion 2600 extends substantially in the vertical direction and extends in the direction such that it intersects the radial direction of the YMCK developing device 50, which is the rotating member, the wall portion 2600 effectively intercepts the toner T that flows in the direction of the black arrow and would otherwise collide against the abutting section of the sealing member 2520.

Next, explanation will be made of the effects obtained by the wall portion 2600 when the yellow developing unit 54 has been rotated 90° from the developing position (from the position shown in FIG. 6), that is, when the yellow developing unit 54 has moved substantially to the position of the black developing unit 51 in FIG. 1 and the developing roller 2510 and the sealing member 2520 are located almost at the lowermost position of the developing unit 54. The arrow in FIG. 7 also indicates the vertical direction.

Figure 7:
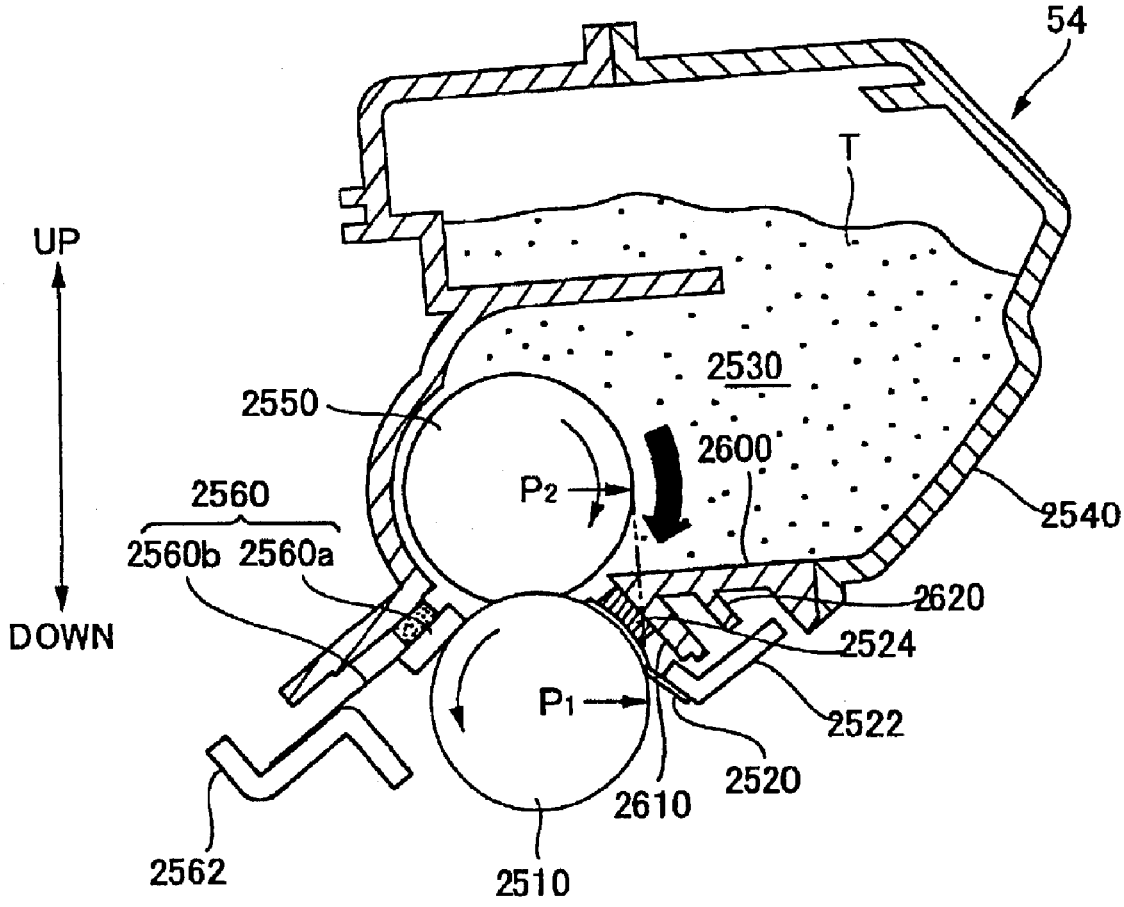
FIG. 7 is a section view showing of a developing unit in a position rotated 90° from a developing position.

When the developing unit 54 moves to such a position, the toner T is subjected to a force that is directed vertically downwards, in the direction of the black arrow schematically shown in FIG. 7, due to gravitation and the centrifugal force caused by rotation. However, the wall portion 2600 of the present embodiment is located closer to the toner supplying roller 2550 rather than to the developing roller 2510, and its tip end is located on the left of a line that passes through the uppermost section P1 of the developing roller 2510 (when it is located in the developing position) and the uppermost section P2 of the toner supplying roller 2550; that is, the tip end of the wall portion 2600 is located on the center-of-rotation side of both the rollers 2510, 2550. With such a structure, only a slight gap remains between the tip end of the wall portion 2600 and the toner supplying roller 2550. Therefore, most of the toner T that flows along in the direction of the black arrow will be intercepted by the wall portion 2600, and thus, the toner T is prevented from colliding directly against the abutting section of the sealing member 2520.

On the other hand, the toner T is restricted from colliding against the abutting section of the sealing member 2520 by the slight gap between the tip end of the wall portion 2600 and the toner supplying roller 2550, and the toner T can be supplied at a stable amount to the toner supplying roller 2550.

Second Example

Figure 8:
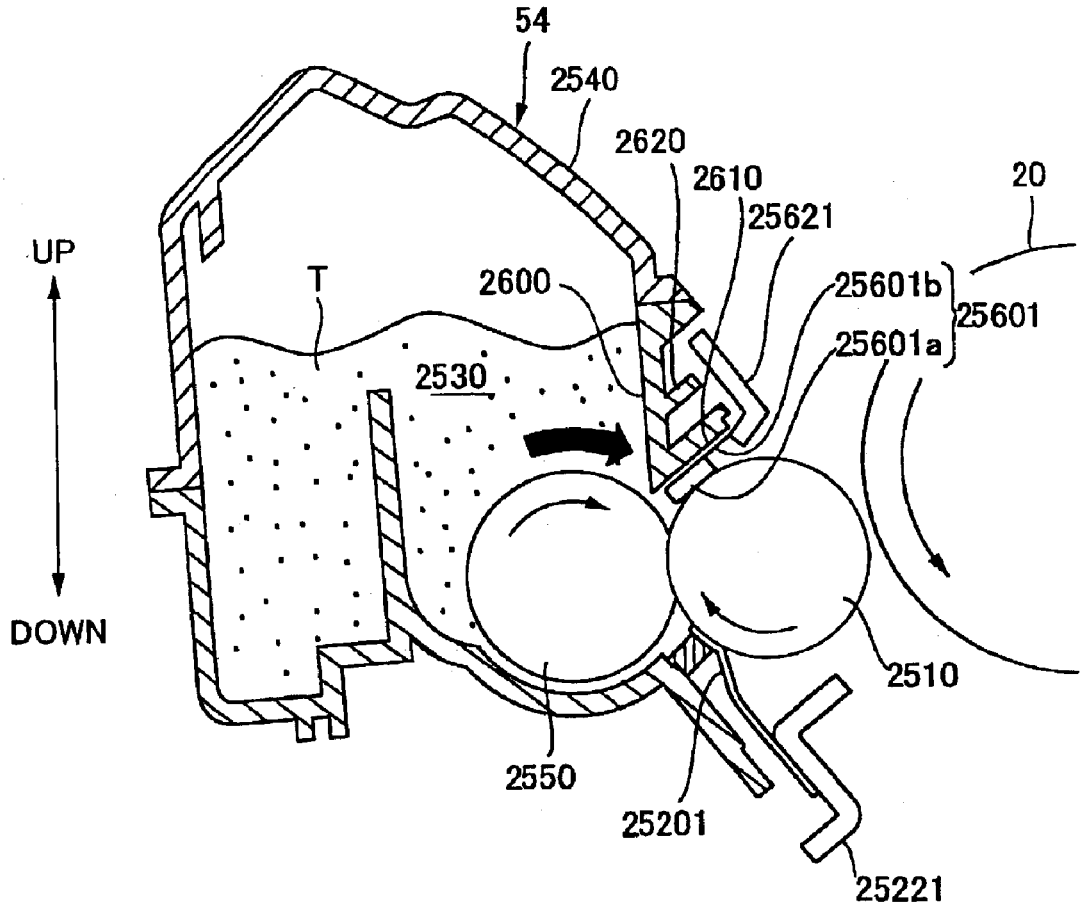
FIG. 8 is a section view showing some main structural components of a developing unit according to a second example of the second embodiment.

Next, with reference to FIG. 8, explanation will be made of a second example of the second embodiment of the present invention. FIG. 8 is a section view of the developing unit 54, similar to FIG. 6 for the first example. Among the structural components of the image-forming apparatus other than the developing unit 54, only the rotating direction of the photoconductor 20 is different from the first example; therefore, explanation of the overall configuration of the image-forming apparatus and of the control unit is omitted, since the configuration is the same as that in the first example.

As shown in FIG. 8, other than the rotating direction of the photoconductor 20, the rotating direction of the developing roller 2510 is different from that in the first example. Because the rotating direction of the developing roller 2510 has been reversed, in the present example, a restriction blade 2560, which serves as a thickness restricting member, is located at the upper section of the developing roller 2510, instead of the sealing member 2520 that was provided there in the first example. Further, in the present example, a sealing member 25201 is located at the lower section of the developing roller 2510, instead of the restriction blade 2560*a* that was provided there in the first example.

More specifically, as shown in FIG. 8, in the present example, a blade-supporting metal plate 25621 is provided instead of the seal-supporting metal plate 2522 that was provided in the first example, and a rubber portion 2560*b* makes a counter-contact with the developing roller 2510 at an abutting section through a rubber-supporting section 2560*a*. Further, a seal-supporting metal plate 25221 is provided instead of the blade-supporting metal plate 2562 that was provided in the first example, and the sealing member 25201 abuts against the developing roller 2510. A blade backing member (not shown) is provided on the back surface of the restriction blade 25601*a* and urges the restriction blade 25601*a*. A seal-urging member is provided on the back surface of the sealing member 25201 and urges the sealing member 25201.

The wall portion 2600 is substantially the same as that in the first example in terms of its shape, positioning, the shape and positioning of the tip end, and in terms that it comprises a second wall portion 2610 and a flange 2620. Therefore, similar to the first example, the wall portion 2600 is capable of effectively prevent the toner T, which is subjected to a force as shown with the black arrow in FIG. 8 due to gravitation and the centrifugal force caused by rotation, from directly colliding against the restriction blade 25601*a*, and also, it is possible to prevent the toner T from escaping out from the developing unit 54. Other effects, such as prevention of the toner T from escaping when the developing unit is rotated to a position 90° from the developing position, are the same as those in the first example; therefore, explanation of those effects is omitted.

Other Examples

Figure 9:
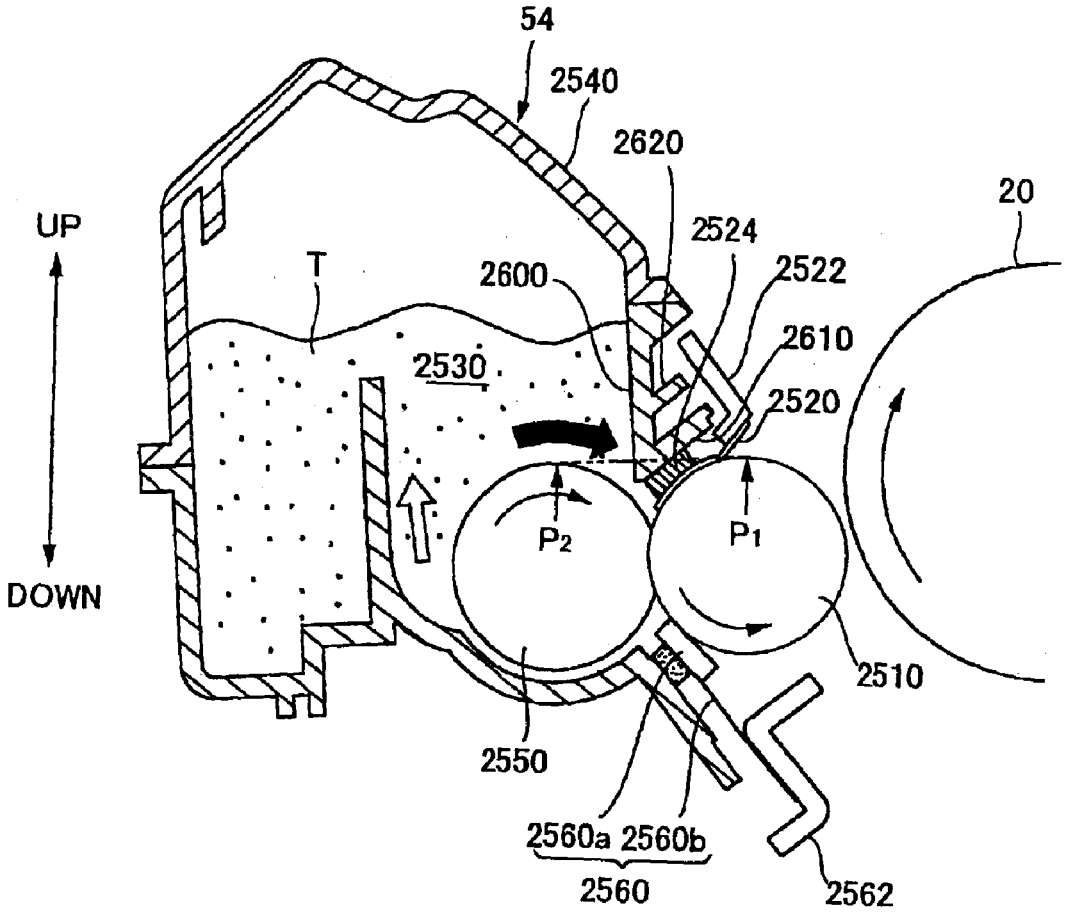
FIG. 9 is a section view showing some main structural components of a developing unit according to another modified example of the second embodiment.

In the foregoing embodiment, the tip end (the lower end when the developing unit is placed in the developing position) of the wall portion 2600 is made to be sharp. However, the structure is not limited to the above. Instead, the wall portion 2600 may be made so that it has a flat end comprising a notch as shown in FIG. 9. In the example shown in FIG. 9, the tip end of the wall portion 2600 extends to a position beyond the upper end of the abutting section. Even with such a structure, the effect of restricting the toner T from colliding against the abutting section of the sealing member 2520, which would otherwise be caused by rotation of the developing unit 54, and thereby preventing the toner T from escaping out from the developing unit 54 is the same as that obtained by the other examples.

===Outline of the Third Embodiment of the Developing Device===

Figure 10:
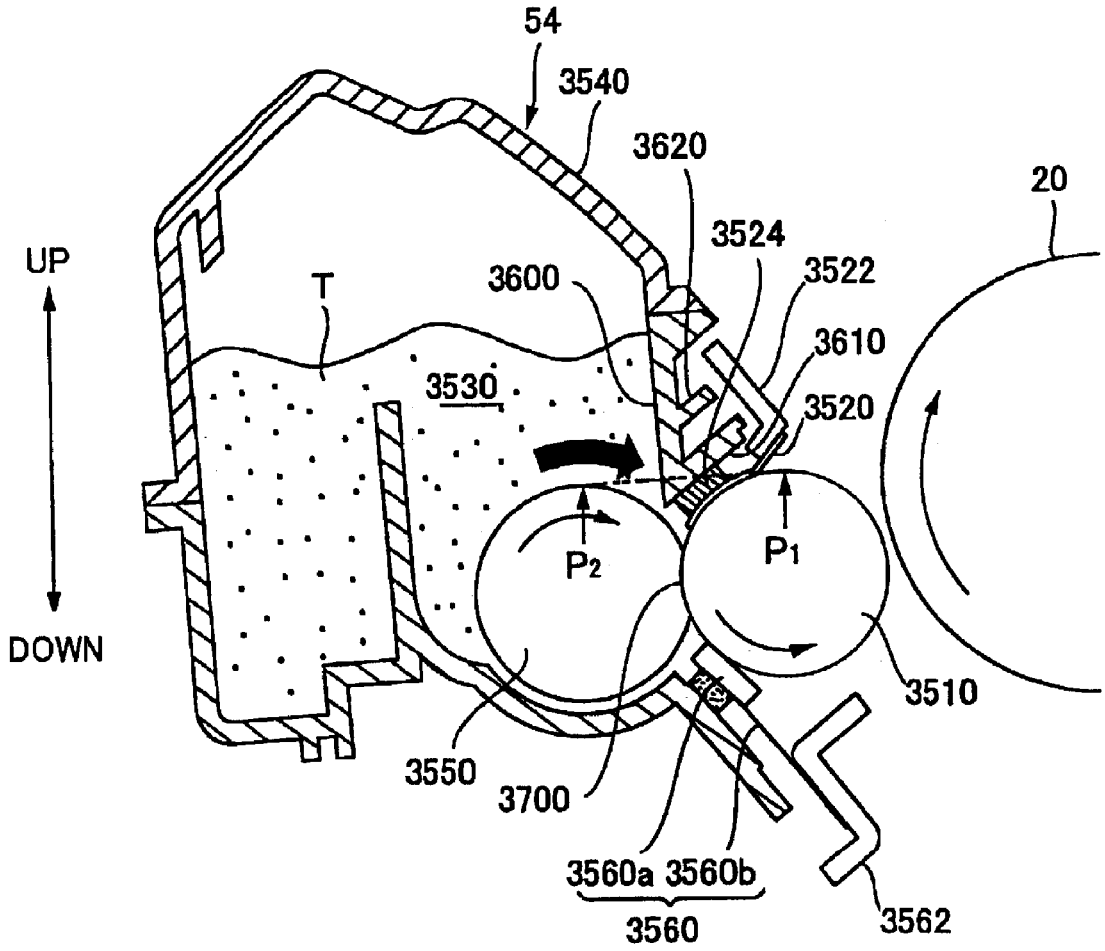
FIG. 10 is a section view showing some main structural components of a developing unit according to a third embodiment.

Next, with reference to FIG. 10, explanation will be made of an outline of a configuration of the developing unit according to a first example. FIG. 10 is a section view showing some main structural components of the developing unit. As in FIG. 1, in FIG. 10, the arrow indicates the vertical directions; for example, the central axis of the developing roller 3510 is located below the central axis of the photoconductor 20. Further, FIG. 10 shows a state in which the yellow developing unit 54 is located in the developing position opposing the photoconductor 20.

The YMCK developing device 50, which serves as a rotating member, comprises: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, explanation will be made of only the yellow developing unit 54.

The yellow developing unit 54 comprises, for example: the developing roller 3510, which serves as a developer bearing member; a sealing member 3520; a toner container 3530, which serves as a developer container; a frame 3540; a toner-supplying roller 3550, which serves as a developer supplying member; a restriction blade 3560 for restricting the thickness of a layer of the toner; a blade-backing member (not shown) for urging the restriction blade 3560; a wall portion 3600; and an abutting section (or a so-called nip) 700. As shown in FIG. 10, in the present example, the sealing member 3520 abuts against the upper section of the developing roller 3510, and the restriction blade 3560 abuts against the lower section of the developing roller 3510.

The developing roller 3510 carries toner T and delivers it to a developing position opposing the photoconductor 20. The developing roller 3510 is made from, for example, aluminum, stainless steel, or iron, and the roller 3510 is plated with, for example, nickel plating, chromium plating and the like, as necessary. Further, the developing roller 3510 is rotatable about a central axis. As shown in FIG. 10, in the present embodiment, the roller 3510 rotates in the opposite direction (counterclockwise in FIG. 10) to the rotating direction of the photoconductor 20 (clockwise in FIG. 10). The central axis of the roller 3510 is located below the central axis of the photoconductor 20.

As shown in FIG. 10, in the state where the yellow developing unit 54 opposes the photoconductor 20, there exists a gap between the developing roller 3510 and the photoconductor 20. That is, the yellow developing unit 54 develops the latent image formed on the photoconductor 20 in a non-contacting state. Note that an alternating field is generated between the developing roller 3510 and the photoconductor 20 upon developing the latent image formed on the photoconductor 20.

The sealing member 3520 abuts against the upper section of the developing roller 3510 and is provided to prevent the toner T in the yellow developing unit 54 from escaping out from the device as well as collect the toner T, which is on the developing roller 3510 that has passed the developing position, into the developing unit without scraping. The sealing member 3520 is a seal made from, for example, polyethylene film and the like. The sealing member 3520 is supported by a seal-supporting metal plate 3522, and is attached to the frame 3540 through the seal-supporting metal plate 3522. On the opposite side of the developing roller 3510 side, the sealing member 3520 is provided with a seal-urging member 3524 made from, for example, Moltoprene and the like. The sealing member 3520 is pressed against the developing roller 3510 by the elastic force of the seal-urging member 3524.

The toner container 3530 is a section for receiving (containing) the toner T. A portion of the frame 3540 structures the container 3530. A stirring member for stirring the toner T contained in the toner container 3530 may be provided. However, in the present embodiment, each of the developing units (the black developing unit 51, the magenta developing unit 52, the cyan developing unit 53, and the yellow developing unit 54) rotate with the rotation of the YMCK developing device 50, and the toner T contained in each developing unit is stirred according to this rotation; thus, the toner container 3530 does not comprise a stirring member.

The toner-supplying roller 3550 is capable of supplying the toner T contained in the toner container 3530 to the developing roller 3510 at the abutting section 700. The toner-supplying roller 3550 is made from, for example, polyurethane foam and the like, and abuts against the developing roller 3510 at the abutting section 700 in an elastically-deformed state. The toner-supplying roller 3550 is arranged at a lower section of the toner container 3530. The toner T contained in the toner container 3530 is supplied to the developing roller 3510 by the toner-supplying roller 3550 at the lower section of the toner container 3530. The toner-supplying roller 3550 is rotatable about a central axis. The central axis is situated below the central axis of rotation of the developing roller 3510. Further, the toner-supplying roller 3550 rotates in the opposite direction (clockwise in FIG. 10) to the rotating direction of the developing roller 3510 (counterclockwise in FIG. 10). Note that, other than the function of supplying the toner T contained in the toner container 3530 to the developing roller 3510, the toner supplying roller 3550 also has the function of stripping the toner remaining on the developing roller 3510 after development off from the developing roller 3510.

The restriction blade 3560 is made so that it abuts against the lower section of the developing roller 3510. The restriction blade 3560 restricts the thickness of the layer of the toner T bore by the developing roller 3510 and also gives charge to the toner T bore by the developing roller 3510. The restriction blade 3560 comprises a rubber portion 3560*a* and a rubber-supporting portion 3560*b*. The rubber portion 3560*a* is made from, for example, silicone rubber, urethane rubber, and the like. The rubber-supporting portion 3560*b* is a thin plate made from, for example, phosphor bronze, stainless steel, and the like having a springy characteristic. The rubber portion 3560*a* is supported by the rubber-supporting portion 3560*b*. The rubber-supporting portion 3560*b* is attached to the frame 3540 through a pair of blade-supporting metal plates 3562, in a way such that one end of the rubber-supporting portion 3560*b* is pinched between the blade-supporting metal plates 3562. On the opposite side of the side at which the developing roller 3510 is located, the restriction blade 3560 is provided with a blade-backing member (not shown) made from Moltoprene and the like.

The rubber portion 3560*a* is pressed against the developing roller 3510 by the elastic force caused by bending of the rubber-supporting portion 3560*b*. Further, the blade-backing member prevents toner from entering between the rubber-supporting portion 3560*b* and the frame 3540, stabilizes the elastic force caused by bending of the rubber-supporting portion 3560*b*, and also urges the rubber portion 3560*a* from the back thereof towards the developing roller 3510 to press the rubber portion 3560*a* against the developing roller 3510. Thus, the blade-backing member can make the rubber portion 3560*a* abut against the developing roller 3510 more evenly.

The other end of the restricting blade 3560 that is not being supported by the blade-supporting metal plates 3562 (i.e., the tip end of the restriction blade 3560) does not contact the developing roller 3510; rather, a section at a predetermined distance from the tip end contacts, with some breadth, the developing roller 3510. In other words, the restriction blade 3560 does not abut against the developing roller 3510 with its end, but abuts against the roller 3510 near its central portion. Further, the restriction blade 3560 is arranged so that its tip end faces towards the upper stream of the rotating direction of the developing roller 3510, and thus, makes a so-called counter-contact with respect to the roller 3510.

The frame 3540 is manufactured by joining a plurality of integrally-molded frames (for example, an upper frame, a bottom frame, and the like). The frame 3540 has an opening at its lower section. The developing roller 3510 is arranged at the opening in a state in which a portion of the roller 3510 is exposed towards the outside of the developing unit. Further, in the present embodiment, the wall portion 3600 is integrally joined to the frame 3540 such that it structures a part of the frame. This is advantageous in terms of both strength of the wall portion 3600 and manufacturability.

In the yellow developing unit 54 thus structured, the toner-supplying roller 3550 supplies the toner T contained in the toner container 3530 to the developing roller 3510 at the abutting section 700. Having been supplied to the developing roller 3510, with the rotation of the developing roller 3510, the toner T reaches the abutting position of the restriction blade 3560; and, as the toner T passes the abutting position, the toner is charged and its thickness is restricted. Having its thickness being restricted, with further rotation of the developing roller 3510, the toner T on the developing roller 3510 reaches the developing position opposing the photoconductor 20; then, under the alternating field, the toner T is used for developing the latent image formed on the photoconductor 20 at the developing position. Having passed the developing position, with further rotation of the developing roller 3510, the toner T on the developing roller 3510 passes the sealing member 3520 and is collected into the developing unit 54 by the sealing member 3520 without being scraped off.

Next, explanation will be made of the wall portion 3600. The wall portion 3600 joined integrally to the frame 3540 extends in the vertical direction. Further, the wall portion 3600 is substantially vertical when the yellow developing unit 54 is located in the developing position as shown in FIG. 10. In the horizontal direction, the wall portion 3600, which extends substantially in the vertical direction, is located closer to the toner supplying roller 3550 than the abutting section 700; in the vertical direction, it is located above the toner supplying roller 3550. The wall portion 3600 thus arranged extends in the direction such that it intersects the radial direction (not shown; refer to FIG. 1) of the YMCK developing device 50, which is a rotating member.

Further, the wall portion 3600 of the present embodiment comprises a second wall portion 3610 that is arranged obliquely upwards continuing from the lower end (tip end) of the wall portion 3600. The sealing member 3520 is located beneath the second wall portion 3610. The upper surface of the seal-urging member 3524, which urges the sealing member 3520 forward so that it abuts against the developing roller 3510, abuts against the lower surface of the second wall portion 3610. A flange 3620 protrudes from the backside of the wall portion 3600, that is, from the opposite side of the container 3530. The flange 3620 serves to strengthen the structure of the wall portion 3600.

By providing a second wall portion 3610 in this way, a space is formed between the second wall portion 3610, which is arranged obliquely upwards continuing from the lower end of the wall portion 3600 towards the developing roller 3510, and the developing roller 3510 (as well as the toner supplying roller 3550). Since it is possible to always keep some amount of toner T in this space, the amount of developer supplied to the abutting section 700 will further be stabilized.

Further, in the horizontal direction, the wall portion 3600 is located between the abutting section 700 and the center of rotation of the toner supplying roller 3550. The lower end of the wall portion 3600 comes beneath a line that passes through the uppermost point P1 of the developing roller 3510 and the uppermost point P2 of the toner supplying roller 3550. Since the lower end of the wall portion 3600 is located very close to the toner supplying roller 3550, the flow path of the toner T that leads to the abutting section 700 is narrowed here. Therefore, it becomes possible to prevent the toner T from colliding against the abutting section 700 with great force.

Next, explanation will be made of the effects obtained by providing such a wall portion 3600. The YMCK developing device 50, which is a rotating member, rotates intermittently. Due to the centrifugal force caused during rotation of the YMCK developing device 50, the toner T is subjected to an outward force in the direction from the rotating shaft 50*a* towards the outside. Further, the toner T is always subjected to a vertically-downward force by gravitation. As a result, during rotation of the YMCK developing device 50, the toner T tends to flow substantially in the direction shown by the black arrow in FIG. 10. Note that the size of the black arrow has no particular meaning.

If the wall portion 3600 is not provided, the toner T that has gained force by the rotation of the YMCK developing device 50 and flows with great force in the direction of the black arrow will directly surge upon the abutting section 700 at high pressure. The shock caused thereby may bring about changes in the charging characteristics of the toner T and give a bad influence on the quality of the formed image. On the other hand, by providing the wall portion 3600, the toner T, which would otherwise flow directly to the abutting section 700 as shown by the black arrow, will collide against the wall portion 3600 before flowing towards the abutting section 700, and is prevented from colliding directly against the abutting section 700. Therefore, it becomes possible to stably supply the toner T to the abutting section 700.

As shown in FIG. 10, since the wall portion 3600 extends substantially in the vertical direction and extends in the direction such that it intersects the radial direction of the YMCK developing device 50, which is the rotating member, the wall portion 3600 effectively blocks the toner T, which flows in the direction of the black arrow and would otherwise collide against the abutting section 700, substantially at right angles. Therefore, collision against the abutting section 700 at high pressure is effectively prevented.

Further, the tip end (lower end) of the wall portion 3600 is located beneath a line that passes through the uppermost point P1 of the developing roller 3510 and the uppermost point P2 of the toner supplying roller 3550. Therefore, since the lower end of the wall portion 3600 is located very close to the toner supplying roller 3550, the flow path of the toner T that leads to the abutting section 700 is narrowed here. Therefore, it becomes possible to prevent the toner T from colliding against the abutting section 700 with great force.

On the other hand, since there is a slight gap between the lower end of the wall portion 3600 and the toner supplying roller 3550, it becomes possible for the toner T to pass through this gap always at a stable amount and be supplied to the abutting section 700, while being prevented from colliding against the abutting section 700.

Other Examples

In the foregoing embodiment, the wall portion 3600 provided substantially in the vertical direction is arranged, in the horizontal direction, between the abutting section 700 and a center of rotation of the toner supplying member 3550, which serves as a developer supplying member. However, the structure is not limited to the above. That is, the wall portion 3600 may be located on the left of the center of rotation of the toner supplying member 3550, that is, it may be located away from the abutting section 700. Even with a wall portion with such an arrangement, it is possible to block the toner T, which is made to flow due to, for example, centrifugal force caused by the rotation of the YMCK developing device 50 (which is a rotating member), from colliding against the abutting section 700 before the toner T reaches the abutting section 700, and it is possible to supply the toner T to the abutting section 700 at a stable amount.

In the foregoing embodiment, as shown in FIG. 10, the toner supplying roller 3550 is to rotate clockwise. However, the configuration is not limited to the above. For example, the roller 3550 may rotate counterclockwise in FIG. 10.

Further, in the foregoing embodiment, the toner supplying roller 3550 is an elastic member. However, the structure is not limited to the above. For example, the toner supplying roller 3550 does not have to be an elastic member.

Further, in the foregoing embodiment, the sealing member 3520 is made from film. However, the structure is not limited to the above. For example, the sealing member 3520 may be made from a stiff material other than film.

===Outline of the Fourth Embodiment of the Developing Device===

Figure 11:
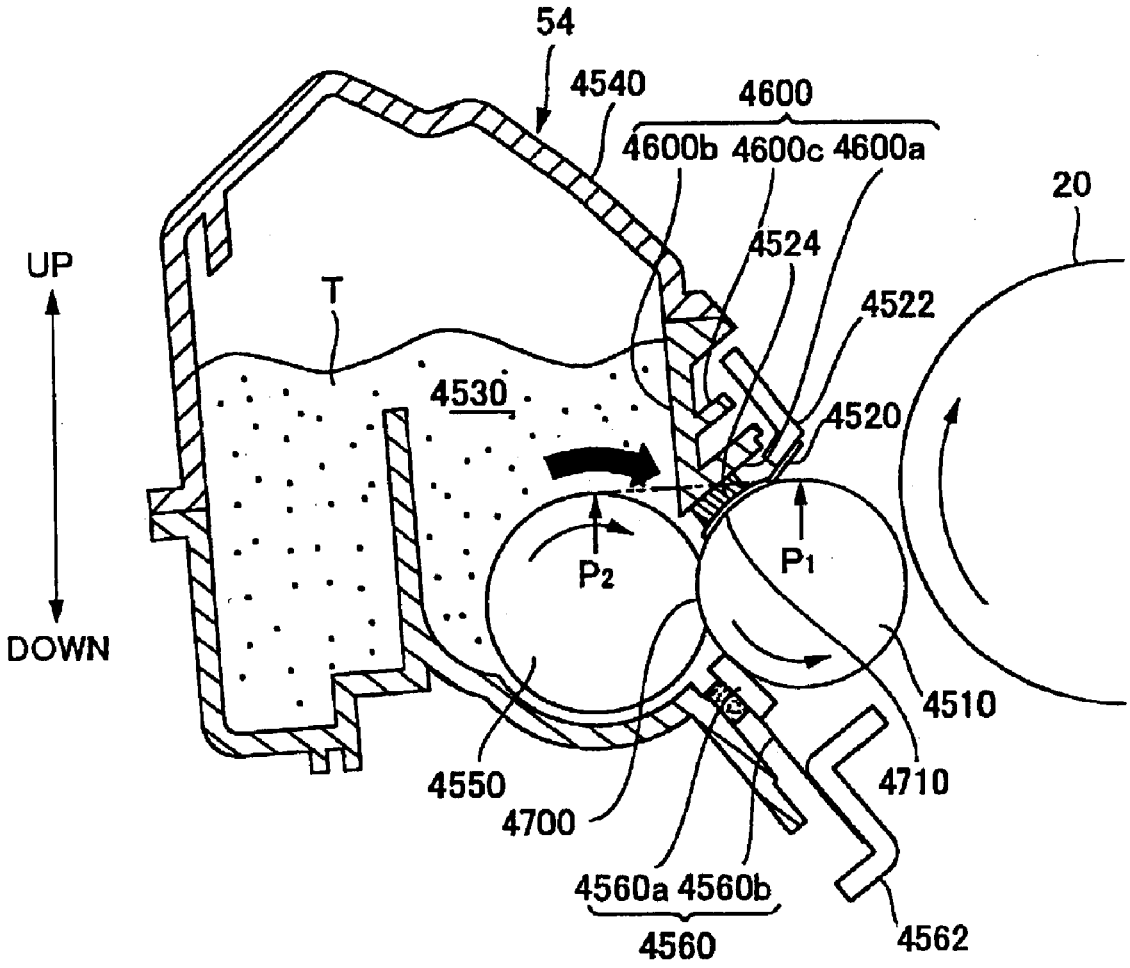
FIG. 11 is a section view showing some main structural components of a developing unit according to a fourth embodiment.

Next, with reference to FIG. 11, explanation will be made of an outline of a configuration of the developing device. FIG. 11 is a section view showing some main structural components of the developing device. As in FIG. 1, in FIG. 11, the arrow indicates the vertical directions; for example, the central axis of the developing roller 4510 is located below the central axis of the photoconductor 20. Further, FIG. 11 shows a state in which the yellow developing device 54 is located in the developing position opposing the photoconductor 20.

The YMCK developing device 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made of only the yellow developing device 54.

The yellow developing device 54 comprises, for example: the developing roller 4510, which serves as a developer bearing member; a sealing member 4520; a toner container 4530, which serves as a developer container; a frame 4540; a toner-supplying roller 4550, which serves as a developer supplying member; a restriction blade 4560 for restricting the thickness of a layer of the toner; a blade-backing member (not shown) for urging the restriction blade 4560; a flow-path restricting member 4600; a first abutting section (or the so-called "nip") 4700; and a second abutting section 4710 which is a section where the sealing member 4520 abuts against the developing roller 4510.

The developing roller 4510 carries toner T and delivers it to a developing position opposing the photoconductor 20. The developing roller 4510 is made from, for example, aluminum, stainless steel, or iron, and the roller 4510 is plated with, for example, nickel plating, chromium plating and the like, as necessary. Further, the developing roller 4510 is rotatable about a central axis. As shown in FIG. 11, in the present embodiment, the roller 4510 rotates in the opposite direction (counterclockwise in FIG. 11) to the rotating direction of the photoconductor 20 (clockwise in FIG. 11). The central axis of the roller 4510 is located below the central axis of the photoconductor 20.

As shown in FIG. 11, in the state where the yellow developing device 54 opposes the photoconductor 20, there exists a gap between the developing roller 4510 and the photoconductor 20. That is, the yellow developing device 54 develops the latent image formed on the photoconductor 20 in a non-contacting state. Note that an alternating field is generated between the developing roller 4510 and the photoconductor 20 upon developing the latent image formed on the photoconductor 20.

The sealing member 4520 abuts against the second abutting section 4710 at the upper section of the developing roller 4510 and is provided to prevent the toner T in the yellow developing device 54 from escaping out from the device as well as collect the toner T, which is on the developing roller 4510 that has passed the developing position, into the developing device without scraping. The sealing member 4520 is a seal made from, for example, polyethylene film and the like. The sealing member 4520 is supported by a seal-supporting metal plate 4522, and is attached to the frame 4540 through the seal-supporting metal plate 4522. On the opposite side of the developing roller 4510 side, the sealing member 4520 is provided with a seal-urging member 4524 made from, for example, Moltoprene and the like. The sealing member 4520 is pressed against the developing roller 4510 by the elastic force of the seal-urging member 4524.

The toner container 4530 is a section for receiving (containing) the toner T. A portion of the frame 4540 structures the container 4530. A stirring member for stirring the toner T contained in the toner container 4530 may be provided. However, in the present embodiment, each of the developing devices (the black developing device 51, the magenta developing device 52, the cyan developing device 53, and the yellow developing device 54) rotate with the rotation of the YMCK developing device 50, and the toner T contained in each developing device is stirred according to this rotation; thus, the toner container 4530 does not comprise a stirring member.

The toner-supplying roller 4550 is capable of supplying the toner T contained in the toner container 4530 to the developing roller 4510 at the first abutting section 4700. The toner-supplying roller 4550 is made from, for example, polyurethane foam and the like, and abuts against the developing roller 4510 at the first abutting section 4700 in an elastically-deformed state. The toner-supplying roller 4550 is arranged at a lower section of the toner container 4530. The toner T contained in the toner container 4530 is supplied to the developing roller 4510 by the toner-supplying roller 4550 at the lower section of the toner container 4530. The toner-supplying roller 4550 is rotatable about a central axis. The central axis is situated below the central axis of rotation of the developing roller 4510. Further, in the present embodiment, the toner-supplying roller 4550 rotates in the opposite direction (clockwise in FIG. 11) to the rotating direction of the developing roller 4510 (counterclockwise in FIG. 11). Note that, other than the function of supplying the toner T contained in the toner container 4530 to the developing roller 4510, the toner supplying roller 4550 also has the function of stripping the toner remaining on the developing roller 4510 after development off from the developing roller 4510.

The restriction blade 4560, which serves as a toner thickness restricting member, is made so that it abuts against the lower section of the developing roller 4510. The restriction blade 4560 restricts the thickness of the layer of the toner T bore by the developing roller 4510 and also gives charge to the toner T bore by the developing roller 4510. The restriction blade 4560 comprises a rubber portion **4560*a* and a rubber-supporting portion 4560*b*. The rubber portion 4560*a* is made from, for example, silicone rubber, urethane rubber, and the like. The rubber-supporting portion 4560*b* is a thin plate made from, for example, phosphor bronze, stainless steel, and the like having a springy characteristic. The rubber portion 4560*a* is supported by the rubber-supporting portion 4560*b*. The rubber-supporting portion 4560*b* is attached to the frame 4540 through a pair of blade-supporting metal plates 4562, in a way such that one end of the rubber-supporting portion 4560*b* is pinched between the blade-supporting metal plates 4562. On the opposite side of the side at which the developing roller 4510 is located, the restriction blade 4560** is provided with a blade-backing member (not shown) made from Moltoprene and the like.

The rubber portion **4560*a* is pressed against the developing roller 4510 by the elastic force caused by bending of the rubber-supporting portion 4560*b*. Further, the blade-backing member prevents toner from entering between the rubber-supporting portion 4560*b* and the frame 4540, stabilizes the elastic force caused by bending of the rubber-supporting portion 4560*b*, and also urges the rubber portion 4560*a* from the back thereof towards the developing roller 4510 to press the rubber portion 4560*a* against the developing roller 4510. Thus, the blade-backing member can make the rubber portion 4560*a* abut against the developing roller 4510** more evenly.

The other end of the restricting blade 4560 that is not being supported by the blade-supporting metal plates 4562 (i.e., the tip end of the restriction blade 4560) does not contact the developing roller 4510; rather, a section at a predetermined distance from the tip end contacts, with some breadth, the developing roller 4510. In other words, the restriction blade 4560 does not abut against the developing roller 4510 with its end, but abuts against the roller 4510 near its central portion. Further, the restriction blade 4560 is arranged so that its tip end faces towards the upper stream of the rotating direction of the developing roller 4510, and thus, makes a so-called counter-contact with respect to the roller 4510.

The frame 4540 is manufactured by joining a plurality of integrally-molded frames (for example, an upper frame, a bottom frame, and the like). The frame 4540 has an opening at its lower section. The developing roller 4510 is arranged at the opening in a state in which a portion of the roller 4510 is exposed towards the outside of the developing device. Further, in the present embodiment, a flow-path restricting member 4600 is integrally joined to the frame 4540 such that it structures a part of the frame. This is advantageous in terms of both strength of the flow-path restricting member 4600 and manufacturability.

In the yellow developing device 54 thus structured, as the toner-supplying roller 4550 rotates, it supplies the toner T contained in the toner container 4530 to the developing roller 4510 at the first abutting section 4700. Having been supplied to the developing roller 4510, with the rotation of the developing roller 4510, the toner T reaches the abutting position of the restriction blade 4560; and, as the toner T passes the abutting position, the toner is charged and its thickness is restricted. Having its thickness being restricted, with further rotation of the developing roller 4510, the toner T on the developing roller 4510 reaches the developing position opposing the photoconductor 20; then, under the alternating field, the toner T is used for developing the latent image formed on the photoconductor 20 at the developing position. Having passed the developing position, with further rotation of the developing roller 4510, the toner T on the developing roller 4510 passes the sealing member 4520 and is collected into the developing device by the sealing member 4520 without being scraped off.

Next, explanation will be made of the flow-path restricting member 4600. The flow-path restricting member 4600 joined integrally to the frame 4540 comprises a first wall 4600*a* and a second wall 4600*b*. The first wall 4600*a* extends, in the horizontal direction, in a slanting direction from the developing roller 4510 towards the toner supplying roller 4550. The second wall 4600*b* extends from above and down towards the vicinity of an upper area of the first abutting section 4700. The lower end of the second wall 4600*b* reaches a horizontal position beyond the upper end of the second abutting section 4710. Further, a flange 4600*c* protrudes from the backside of the flow-path restricting member 4600, that is, from the opposite side of the container 4530 of the developing device 54. The flange 4600*c* serves to strengthen the structure of the flow-path restricting member 4600.

The first wall 4600*a* and the second wall 4600*b* form a sharp, acute tip end. As shown in FIG. 11, in the horizontal direction, the tip is located between the abutting section 4700 and the center of rotation of the toner supplying roller 4550. Further, in the present embodiment, the tip end of the flow-path restricting member 4600 is located relatively close to the toner supplying roller 4550. However, note that there is a gap with a predetermined size provided between the tip end and the toner supplying roller 4550. The toner T passes through this gap from above the container 4530, is carried by the toner supplying roller 4550, and reaches the first abutting section 4700.

Next, explanation will be made of the effects obtained by providing such a flow-path restricting member 4600. The YMCK developing device 50, which is a rotating member, rotates intermittently. Due to the centrifugal force caused during rotation of the YMCK developing device 50, the toner T is subjected to an outward force in the direction from the rotating shaft 50*a* towards the outside. Further, the toner T is always subjected to a vertically-downward force by gravitation, not only when the YMCK developing device 50 is rotating. As a result, during rotation of the YMCK developing device 50, the toner T tends to flow substantially in the direction shown by the black arrow in FIG. 11. Note that the size of the black arrow has no particular meaning. Further, when the YMCK developing device 50 is not rotating, the direction of the black arrow will be in a vertically downward direction (not shown).

In the present embodiment, the wedge-shaped flow-path restricting member 4600 is provided so that it ranges, in the horizontal direction, from the developing roller 4510, above and across the first abutting section 4700, and to a position above the toner supplying roller 4550 and that slightly covers it. According to such a structure, the flow of the toner T (cf. the black arrow) flowing from the upper area of the first abutting section 4700 to the first abutting section 4700 is once suppressed because the flow collides against the flow-path restricting member 4600. By arranging the flow-path restricting member 4600 so that it covers at least only the area right above the first abutting section 4700, it is possible to intercept the flow that would otherwise directly reach the first abutting section 4700 from right above the first abutting section 4700.

By providing a flow-path restricting member 4600, since it is possible to intercept the flow that would otherwise directly reach the first abutting section 4700 from right above the first abutting section 4700, it becomes possible to prevent variation in the pressure of the toner T that is applied to the first abutting section 4700, and it becomes possible to stabilize supplying of the toner T to the developing roller 4510 at the first abutting section 4700 with the toner supplying roller 4550.

Further, in the present embodiment, the tip end of the flow-path restricting member 4600 is located, in the horizontal direction, between the first abutting section 4700 and the center of rotation of the toner supplying roller 4550. With such a structure, it is possible to restrict the flow of toner T that reaches the first abutting section 4700 throughout a range above the first abutting section 4700 and having a certain breadth in the horizontal direction (up to the tip end section of the flow-path restricting member 4600), and not only restrict the flow in the area right above the first abutting section 4700.

Further, although the tip end of the flow-path restricting member 4600 is located relatively close to the toner supplying roller 4550, there still is a gap between the first abutting section 4700 and the roller 4550. Therefore, it becomes possible to carry the toner T to the first abutting section 4700 at a stable amount, by intercepting the flow that surges upon the first abutting section 4700 from above the first abutting section 4700 and making the toner T pass through this gap with the rotation of the toner supplying roller 4550.

As explained, the toner T is carried to the first abutting section 4700 at a stable amount with the rotation of the toner supplying roller 4550, by passing through the gap between tip end of the flow-path restricting member 4600 and the toner supplying roller 4550 while the flow path that leads from above directly to the first abutting section 4700 is being restricted by the flow-path restricting member 4600. The toner T is then carried to a position opposing the photoconductor 20 by the developing roller 4510 that rotates in the opposite direction to the toner supplying roller 4550. While the toner is carried, the restriction blade 4560 restricts the layer thickness of the toner and charges the toner. Since the toner T is stably delivered at the first abutting section 4700, it becomes possible to also stabilize the charging characteristics of the toner T, thereby keeping the quality of the finally-formed image stable and high.

Further, the flow-path restricting member 4600 is provided closer to the toner supplying roller 4550 than the sealing member 4520 that abuts against the developing roller 4510 at the second abutting section 4710 and prevents the toner T from escaping from the container 4530. Therefore, the flow of the toner T, which would surge upon the sealing member 4520 at high pressure in the direction of the black arrow as shown in FIG. 11 due to centrifugal force caused by rotation, is restricted; also, changes in pressure applied on the sealing member 4520, which occur due to the difference in the amount of the toner T existing above the abutting section 4700, are prevented from occurring. As a result, it becomes possible to prevent the toner T from escaping from the sealing member 4520.

Next, with reference to FIG. 12, explanation will be made of explanation will be made of the effects obtained by the flow-path restricting member 4600 when the yellow developing unit 54 has been rotated 90° from the developing position (from the position shown in FIG. 11), that is, when the yellow developing unit 54 has moved substantially to the position of the black developing unit 51 in FIG. 1 and the developing roller 4510 and the sealing member 4520 are located almost at the lowermost position of the developing unit 54. The arrow in FIG. 12 also indicates the vertical direction.

Figure 12:
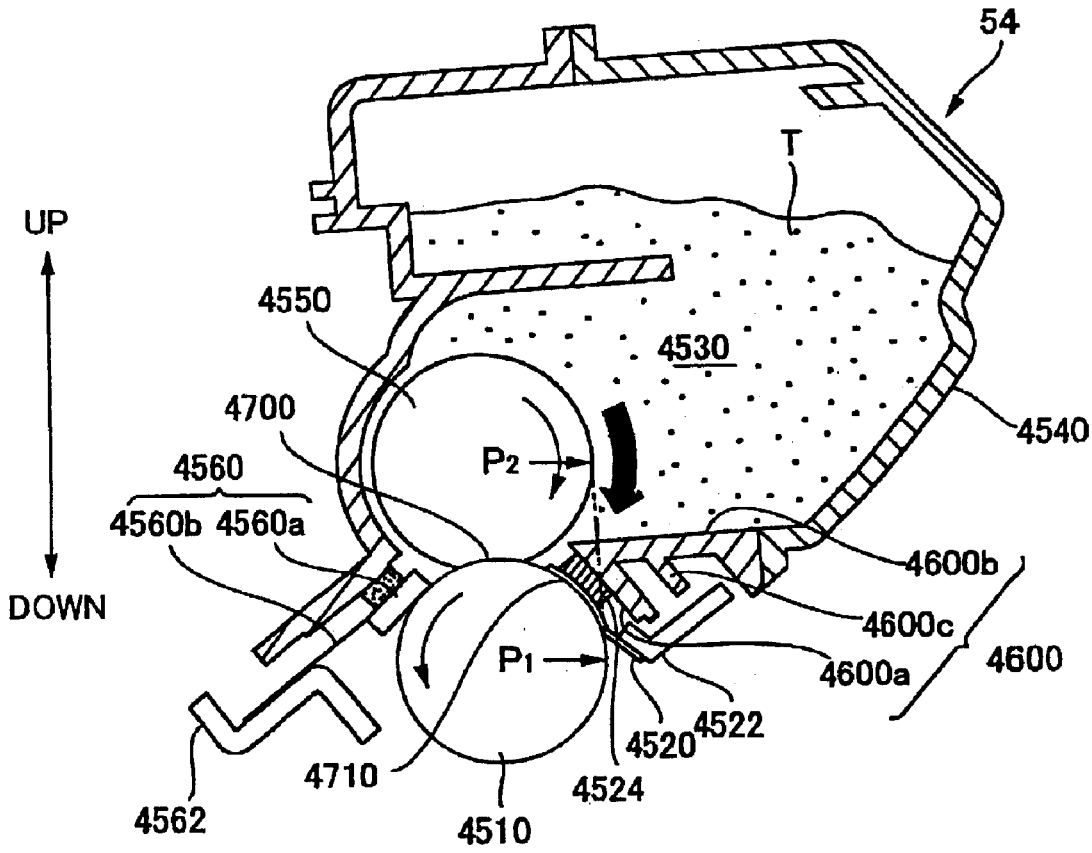
FIG. 12 is a section view showing of a developing unit in a position rotated 90° from a developing position.

When the developing unit 54 moves to such a position, the toner T is subjected to a force that is directed vertically downwards, in the direction of the black arrow schematically shown in FIG. 12, due to gravitation and the centrifugal force caused by rotation. However, the tip end formed by the first wall portion 4600*a* and the second wall portion 4600*b* of the flow-path restricting member 4600 of the present embodiment is located closer to the toner supplying roller 4550 rather than to the developing roller 4510, and the tip end is located on the left of a line that passes through the uppermost section P1 of the developing roller 4510 (when it is located in the developing position as in FIG. 11) and the uppermost section P2 of the toner supplying roller 4550; that is, the tip end of the flow-path restricting member 4600 is located on the center-of-rotation side of both the rollers 4510, 4550. With such a structure, only a slight gap remains between the tip end of the flow-path restricting member 4600 and the toner supplying roller 4550. Therefore, most of the toner T that flows along in the direction of the black arrow will be intercepted by the flow-path restricting member 4600, and thus, the flow of the toner T, which would directly collide against the second abutting section 4710 of the sealing member 4520 or the first abutting section 4700 at high pressure, is restricted.

On the other hand, the toner T is restricted from colliding against the second abutting section of the sealing member 4520 by the slight gap between the tip end of the flow-path restricting member 4600 and the toner supplying roller 4550, and the toner T can be supplied at a stable amount to the first abutting section 4700.

Again, reference is made to FIG. 11. The first wall portion 4600*a* of the flow-path restricting member 4600 according to the present embodiment extends obliquely upwards from the lower end, and the sealing member 4520 is arranged below this first wall portion 4600*a*. The upper surface of the seal-urging member 4524, which urges the sealing member 4520 so that it abuts against the developing roller 4510, abuts against the lower surface of the first wall portion 4600*a*.

The lower end of the first wall portion 4600*a* and the second wall portion 4600*b* form the sharp acute tip end of the flow-path restricting member 4600. Between the developing roller 4510 (as well as the toner supplying roller 4550) and the first wall portion 4600*a*, which extends obliquely upwards continuing from the lower end of the flow-path restricting member 4600 towards the developing roller 4510, is formed an appropriate space. Since it is possible to always keep some amount of toner T in this space, the amount of the toner T supplied to the first abutting section 4700 will further be stabilized.

Other Examples

Figure 13:
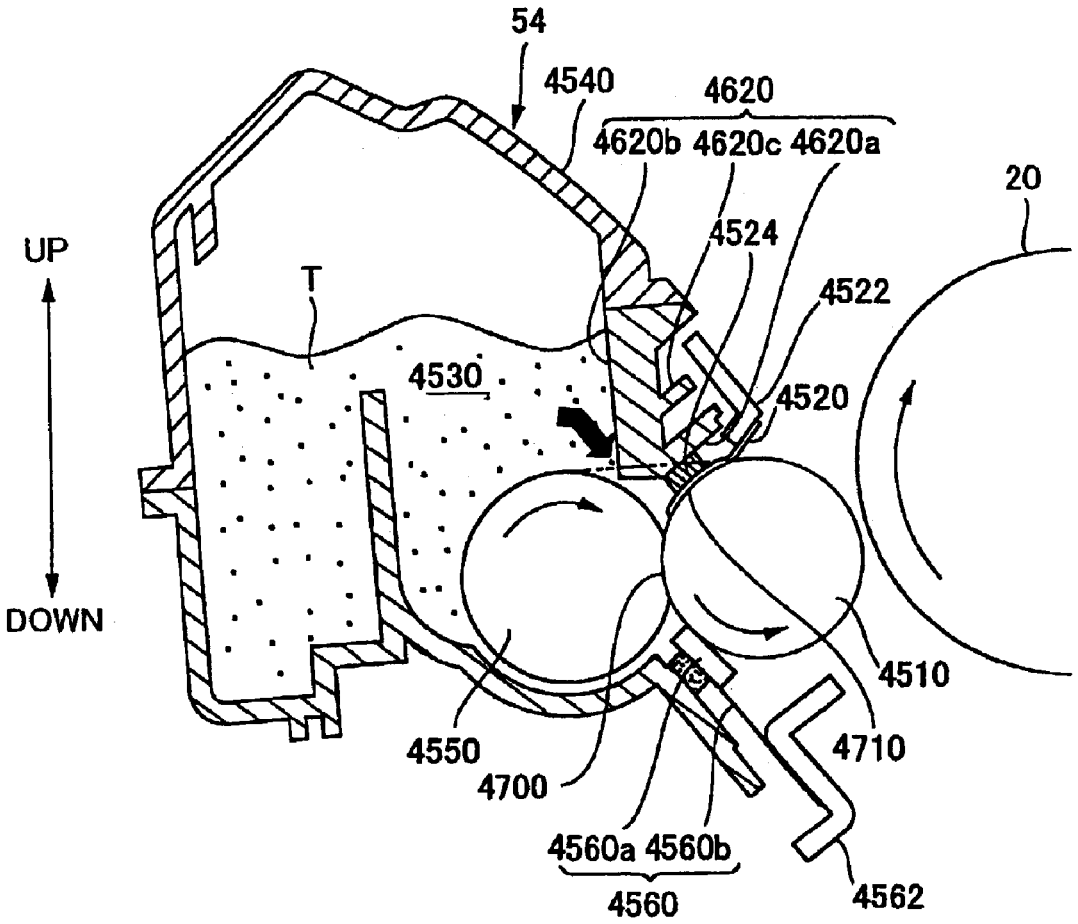
FIG. 13 is a section view showing some main structural components of a developing unit according to a modified example of the fourth embodiment.

In the foregoing embodiment, a wedge-shaped flow-path restricting member having a sharp tip end is adopted. However, the structure is not limited to the above. For example, the flow-path restricting member may comprise a flat end that has a notch at its tip as shown in FIG. 13. Further, the flow-path restricting member 4620 shown in FIG. 13 is similar to the flow-path restricting member 4600 described in the foregoing embodiment in terms that it comprises a first wall 4620*a*, a second wall 4620*b*, and a flange 4620*c*; however, in the flow-path restricting member 4620 of FIG. 13, the second wall 4620*b* is thicker than that of the foregoing embodiment. Even with the flow-path restricting member 4620 shown in FIG. 13, since the flow path of the toner T leading from right above the first abutting section 4700 to the abutting section is intercepted, it is possible to prevent the toner T from colliding against the first abutting section 4700 at high pressure and realize stable supplying of the toner T. Further, the tip end of the flow-path restricting member 4620 is located, in the horizontal direction, between the first abutting section 4700 and the center of rotation of the toner supplying roller 4550, and there still is a gap between the first abutting section 4700 and the roller 4550 though it may be narrow. Therefore, it becomes possible to prevent the toner T from colliding against the first abutting section 4700 at high pressure throughout a broad horizontal range, and not only at an area right above the first abutting section 4700, and, since the toner T reaches the first abutting section 4700 by passing through the gap, it also becomes possible to stably supply the toner T to the first abutting section 4700. Further, it is possible to restrict the flow of the toner T that would surge upon the sealing member 4520 (or the upper end of the second abutting section 4710), and also prevent the toner T from escaping (falling out).

Further, in the foregoing embodiment, the position of the tip end of the flow-path restricting member 4600 is arranged, in the horizontal direction, between the first abutting section 4700 and the center of rotation of the toner supplying roller 4550, which serves as a developer supplying member. However, the structure is not limited to the above. For example, the tip end may be located on the left-hand side of the center of rotation of the toner supplying roller 4550; that is, the tip end may be located further away from the first abutting section 4700. Even with a flow-path restricting member having such a shape, the toner T is prevented from colliding against the first abutting section 4700 at high pressure throughout a broad horizontal range, and not only at an area right above the first abutting section 4700, and it becomes possible to stably supply the toner T to the first abutting section 4700. Further, it is possible to restrict the flow of the toner T that would surge upon the sealing member 4520 (or the upper end of the second abutting section 4710), and also prevent the toner T from escaping out from the developing device 54.

In the foregoing embodiment, as shown in FIG. 11, the toner supplying roller 4550 is to rotate clockwise. However, the configuration is not limited to the above. For example, the roller 4550 may rotate counterclockwise in FIG. 11.

Further, in the foregoing embodiment, the toner supplying roller 4550 is an elastic member. However, the structure is not limited to the above. For example, the toner supplying roller 4550 does not have to be an elastic member.

Further, in the foregoing embodiment, the sealing member 4520 is made from film. However, the structure is not limited to the above. For example, the sealing member 4520 may be made from a stiff material other than film.

===Outline of the Fifth Embodiment of the Developing Device===

First Example

Figure 14:
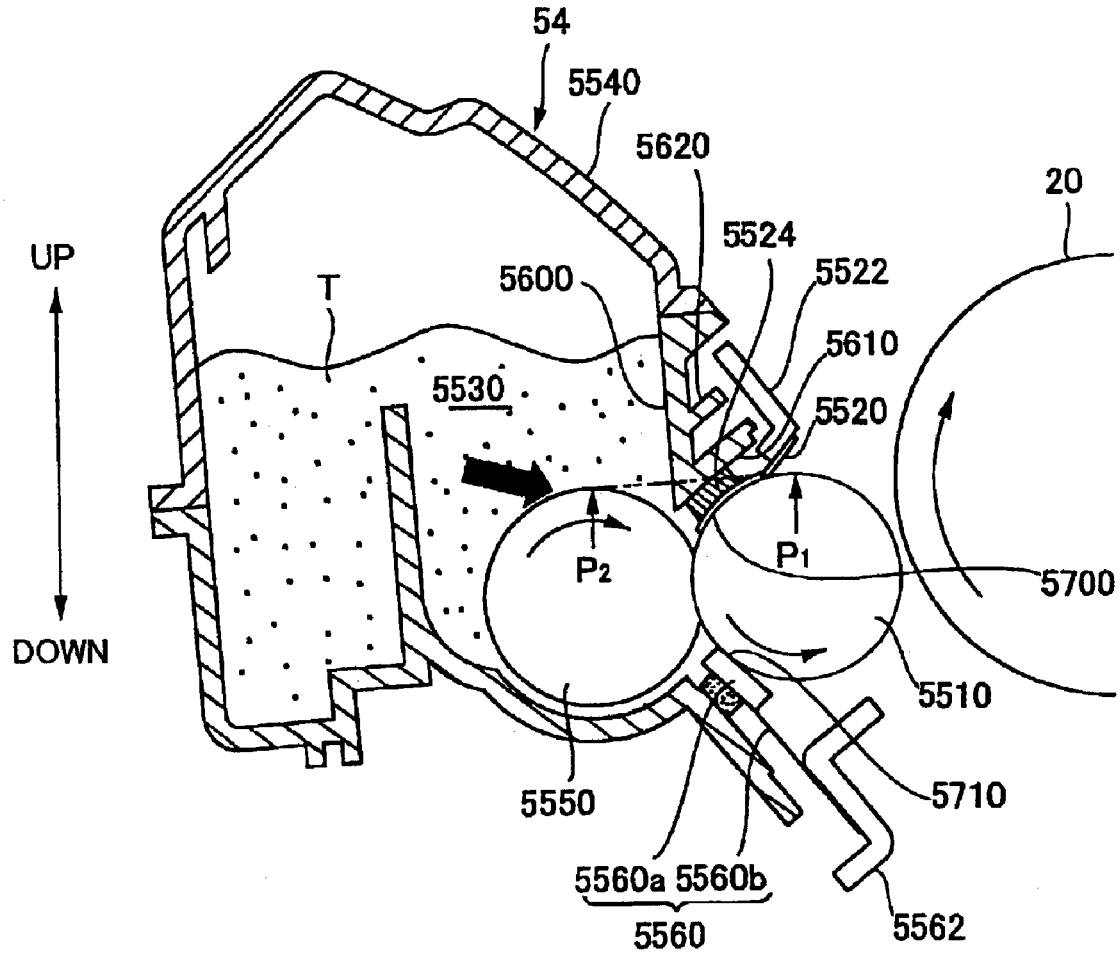
FIG. 14 is a section view showing some main structural components of a developing unit according to a fifth embodiment.

Next, with reference to FIG. 14, explanation will be made of an outline of a configuration of the developing unit according to a first example. FIG. 14 is a section view showing some main structural components of the developing unit. As in FIG. 1, in FIG. 14, the arrow indicates the vertical directions; for example, the central axis of the developing roller 5510 is located below the central axis of the photoconductor 20. Further, FIG. 14 shows a state in which the yellow developing unit 54 is located in the developing position opposing the photoconductor 20.

The YMCK developing device 50 comprises: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, explanation will be made of only the yellow developing unit 54.

The yellow developing unit 54 comprises, for example: the developing roller 5510, which serves as a developer bearing member; a sealing member 5520; a toner container 5530, which serves as a developer container; a frame 5540; a toner-supplying roller 5550, which serves as a developer supplying member; a restriction blade 5560, which serves as a thickness restricting member; a blade-backing member (not shown) for urging the restriction blade 5560; and a wall portion 5600. As shown in FIG. 14, in the present example, the sealing member 5520 abuts against the upper section of the developing roller 5510, and the restriction blade 5560 abuts against the lower section of the developing roller 5510.

The developing roller 5510 carries toner T and delivers it to a developing position opposing the photoconductor 20. The developing roller 5510 is made from, for example, aluminum, stainless steel, or iron, and the roller 5510 is plated with, for example, nickel plating, chromium plating and the like, as necessary. Further, the developing roller 5510 is rotatable about a central axis. As shown in FIG. 14, in the present embodiment, the roller 5510 rotates in the opposite direction (counterclockwise in FIG. 14) to the rotating direction of the photoconductor 20 (clockwise in FIG. 14). The central axis of the roller 5510 is located below the central axis of the photoconductor 20.

As shown in FIG. 14, in the state where the yellow developing unit 54 opposes the photoconductor 20, there exists a gap between the developing roller 5510 and the photoconductor 20. That is, the yellow developing unit 54 develops the latent image formed on the photoconductor 20 in a non-contacting state. Note that an alternating field is generated between the developing roller 5510 and the photoconductor 20 upon developing the latent image formed on the photoconductor 20.

The sealing member 5520 abuts against the upper section of the developing roller 5510 at an abutting section 5700 and is provided to prevent the toner T in the yellow developing unit 54 from escaping out from the device as well as collect the toner T, which is on the developing roller 5510 that has passed the developing position, into the developing unit without scraping. The sealing member 5520 is a seal made from, for example, polyethylene film and the like. The sealing member 5520 is supported by a seal-supporting metal plate 5522, and is attached to the frame 5540 through the seal-supporting metal plate 5522. On the opposite side of the developing roller 5510 side, the sealing member 5520 is provided with a seal-urging member 5524 made from, for example, Moltoprene and the like. The sealing member 5520 is pressed against the developing roller 5510 by the elastic force of the seal-urging member 5524.

Although it is not shown in the FIG. 14, the tip end of the sealing member 5520 does not contact the developing roller 5510; rather, a section at a predetermined distance from the tip end contacts, with some breadth, the developing roller 5510. In other words, the sealing member 5520 does not abut against the developing roller 5510 with its end, but abuts against the roller 5510 near its central portion. Therefore, the lower end of the contacting section (abutting section 5700) where the sealing member 5520 and the developing roller 5510 contact each other is located above the lower end of the sealing member 5520 (when the developing unit 54 is located in the developing position as shown in FIG. 14).

The toner container 5530 is a section for receiving (containing) the toner T. A portion of the frame 5540 structures the container 5530. A stirring member for stirring the toner T contained in the toner container 5530 may be provided. However, in the present embodiment, each of the developing units (the black developing unit 51, the magenta developing unit 52, the cyan developing unit 53, and the yellow developing unit 54) rotate with the rotation of the YMCK developing device 50, and the toner T contained in each developing unit is stirred according to this rotation; thus, the toner container 5530 does not comprise a stirring member.

The toner-supplying roller 5550 is capable of supplying the toner T contained in the toner container 5530 to the developing roller 5510. The toner-supplying roller 5550 is made from, for example, polyurethane foam and the like, and abuts against the developing roller 5510 in an elastically-deformed state. The toner-supplying roller 5550 is arranged at a lower section of the toner container 5530 and is located closer to the center of rotation 50*a* of the YMCK developing device 50, which is a rotating member, than the developing roller 5510 (cf. FIG. 1). The toner T contained in the toner container 5530 is supplied to the developing roller 5510 by the toner-supplying roller 5550 at the lower section of the toner container 5530. The toner-supplying roller 5550 is rotatable about a central axis. The central axis is situated below the central axis of rotation of the developing roller 5510. Further, in the present embodiment, the toner-supplying roller 5550 rotates in the opposite direction (clockwise in FIG. 14) to the rotating direction of the developing roller 5510 (counterclockwise in FIG. 14). Note that, other than the function of supplying the toner T contained in the toner container 5530 to the developing roller 5510, the toner supplying roller 5550 also has the function of stripping the toner remaining on the developing roller 5510 after development off from the developing roller 5510.

Note that in the present embodiment, the diameter of the toner supplying roller 5550 is larger than the diameter of the developing roller 5510. Therefore, the uppermost section P2 of the toner supplying roller 5550 and the uppermost section P1 of the developing roller 5510 are located approximately at the same height (horizontal level), even though the center of rotation of the toner supplying roller 5550 is located below the center of rotation of the developing roller 5510. Further, in the present embodiment, since the sealing member 5520 abuts against the developing roller 5510 at an abutting section 5700 that is located at a predetermined distance from the uppermost section P1 of the developing roller 5510, the uppermost section P2 of the toner supplying roller 5550 is located above the lower end of the sealing member 5520 and also above the lower end of the abutting section 5700.

The restriction blade 5560, which serves as a thickness restricting member, is made so that it abuts against the lower section of the developing roller 5510. The restriction blade 5560 restricts the thickness of the layer of the toner T bore by the developing roller 5510 and also gives charge to the toner T bore by the developing roller 5510. The restriction blade 5560 comprises a rubber portion 5560*a* and a rubber-supporting portion 5560*b*. The rubber portion 5560*a* is made from, for example, silicone rubber, urethane rubber, and the like. The rubber-supporting portion 5560*b* is a thin plate made from, for example, phosphor bronze, stainless steel, and the like having a springy characteristic. The rubber portion 5560*a* is supported by the rubber-supporting portion 5560*b*. The rubber-supporting portion 5560*b* is attached to the frame 5540 through a pair of blade-supporting metal plates 5562, in a way such that one end of the rubber-supporting portion 5560*b* is pinched between the blade-supporting metal plates 5562. On the opposite side of the side at which the developing roller 5510 is located, the restriction blade 5560 is provided with a blade-backing member (not shown) made from Moltoprene and the like.

The rubber portion 5560*a* is pressed against the developing roller 5510 by the elastic force caused by bending of the rubber-supporting portion 5560*b*. Further, the blade-backing member prevents toner from entering between the rubber-supporting portion 5560*b* and the frame 5540, stabilizes the elastic force caused by bending of the rubber-supporting portion 5560*b*, and also urges the rubber portion 5560*a* from the back thereof towards the developing roller 5510 to press the rubber portion 5560*a* against the developing roller 5510. Thus, the blade-backing member can make the rubber portion 5560*a* abut against the developing roller 5510 more evenly.

The other end of the restricting blade 5560 that is not being supported by the blade-supporting metal plates 5562 (i.e., the tip end of the restriction blade 5560) does not contact the developing roller 5510; rather, a section at a predetermined distance from the tip end contacts, with some breadth, the developing roller 5510. In other words, the restriction blade 5560 does not abut against the developing roller 5510 with its end, but abuts against the roller 5510 near its central portion at a second abutting section 5710. Further, the restriction blade 5560 is arranged so that its tip end faces towards the upper stream of the rotating direction of the developing roller 5510, and thus, makes a so-called counter-contact with respect to the roller 5510.

The frame 5540 is manufactured by joining a plurality of integrally-molded frames (for example, an upper frame, a bottom frame, and the like). The frame 5540 has an opening at its lower section. The developing roller 5510 is arranged at the opening in a state in which a portion of the roller 5510 is exposed towards the outside of the developing unit. Further, in the present embodiment, the wall portion 5600 is integrally joined to the frame 5540 such that it structures a part of the frame. This is advantageous in terms of both strength of the wall portion 5600 and manufacturability.

In the yellow developing unit 54 thus structured, the toner-supplying roller 5550 supplies the toner T contained in the toner container 5530 to the developing roller 5510. Having been supplied to the developing roller 5510, with the rotation of the developing roller 5510, the toner T reaches the abutting position of the restriction blade 5560; and, as the toner T passes the abutting position, the toner is charged and its thickness is restricted. Having its thickness being restricted, with further rotation of the developing roller 5510, the toner T on the developing roller 5510 reaches the developing position opposing the photoconductor 20; then, under the alternating field, the toner T is used for developing the latent image formed on the photoconductor 20 at the developing position. Having passed the developing position, with further rotation of the developing roller 5510, the toner T on the developing roller 5510 passes the sealing member 5520 and is collected into the developing unit 54 by the sealing member 5520 without being scraped off.

Next, explanation will be made of the wall portion 5600. The wall portion 5600 joined integrally to the frame 5540 extends in the vertical direction, and its sharp tip end (lower end) is arranged close to the lower end of a section (abutting section 5700) at which the sealing member 5520 abuts against the developing roller 5510. Further, the wall portion 5600 is substantially vertical when the yellow developing unit 54 is located in the developing position as shown in FIG. 14. Therefore, the wall portion 5600 thus arranged extends in the direction such that it intersects the radial direction (not shown; refer to FIG. 1) of the YMCK developing device 50, which is a rotating member.

Further, the wall portion 5600 of the present embodiment comprises a second wall portion 5610 that is arranged obliquely upwards continuing from the lower end (tip end) of the wall portion 5600. The sealing member 5520 is located beneath the second wall portion 5610. The upper surface of the seal-urging member 5524, which is urged towards the second wall portion 5610 and the sealing member 5520, abuts against the lower surface of the second wall portion 5610. A flange 5620 protrudes from the back-side of the wall portion 5600, that is, from the opposite side of the container 5530 of the developing device 54. The flange 5620 serves to strengthen the structure of the wall portion 5600.

Further, the inner surface of the wall portion 5600, that is, the surface that is in contact with the container 5530, is located above the toner supplying roller 5550 in the horizontal direction, and not above the developing roller 5510. The lower end of the wall portion 5600 comes beneath a line that passes through the uppermost point P1 of the developing roller 5510 and the uppermost point P2 of the toner supplying roller 5550.

Next, explanation will be made of the effects obtained by the developing unit 54 according to the present embodiment, and especially the effects obtained by providing a wall portion 5600 and by the particular sizing and the positioning of the toner supplying roller 5550. The YMCK developing device 50, which is a rotating member, rotates intermittently. Due to the centrifugal force caused during rotation of the YMCK developing device 50, the toner T is subjected to an outward force in the direction from the rotating shaft 50*a* towards the outside. Further, the toner T is always subjected to a vertically-downward force by gravitation. As a result, during rotation of the YMCK developing device 50, the toner T tends to flow substantially in the direction shown by the black arrow in FIG. 14. Note that the size of the black arrow has no particular meaning.

In the present embodiment, the diameter of the toner supplying roller 5550 is larger than the diameter of the developing roller 5510. Further, in the present embodiment, since the sealing member 5520 abuts against the developing roller 5510 at an abutting section 5700 that is located at a predetermined distance from the uppermost section P1 of the developing roller 5510, the uppermost section P2 of the toner supplying roller 5550 is located above the lower end of the sealing member 5520 and also above the lower end of the abutting section 5700.

Therefore, the toner T that tends to flow with great force in the direction of the black arrow due mainly to centrifugal force will not directly collide against the sealing member 5520 (and the abutting section 5700), but collide against a section in the vicinity of the upper section of the toner supplying roller before collision against the abutting section 5700. Therefore, since it is possible to prevent the toner T from colliding against the abutting section 5700 at high pressure, is becomes possible to prevent the toner T from escaping out from the developing unit 54.

Further, as shown in FIG. 14, the lower end of the wall portion 5600 of the present embodiment extends to a position beyond a line that passes through the uppermost section P2 of the toner supplying roller 5550 and the uppermost section P1 of the developing roller 5510, and actually extends up to the vicinity of the lower end of the sealing member 5520. As a result, the wall portion 5600 intercepts (blocks) the flow path of the toner T that leads to the abutting section 5700, the toner T flowing in parallel to and above the black arrow shown in FIG. 14. That is, an area in the vicinity of the upper section of the toner supplying roller 5550 and the wall portion 5600 cooperate with each other to substantially intercept (block) the flow path of the toner T that would directly surge upon the abutting section 5700, and they prevent the high-pressure collision against the abutting section 5700. Note that, if the lower end of the wall portion 5600 extends at least to the position beyond the upper end of the abutting section 5700, it is possible to restrict the toner T from colliding at high pressure and prevent the toner T from escaping outside.

As mentioned above, the area in the vicinity of the upper section of the toner supplying roller 5550 and the wall portion 5600 cooperate with each other to prevent the toner T, which is moved by the centrifugal force caused by rotation, from escaping outside. Meanwhile, between the lower end of the wall portion 5600 and the toner supplying roller 5550 is provided a gap, though it might be relatively narrow. The toner T can be supplied to the toner supplying roller 5550 always at a stable amount through this gap, while being restricted from colliding against the abutting section 5700 of the sealing member 5520.

Next, explanation will be made of the effects obtained in a state where the yellow developing unit 54 has been rotated 90° from the developing position (from the position shown in FIG. 14), that is, when the yellow developing unit 54 has moved substantially to the position of the black developing unit 51 in FIG. 1 and the developing roller 5510 and the sealing member 5520 are located almost at the lowermost position of the developing unit 54. The arrow in FIG. 15 also indicates the vertical direction.

Figure 15:
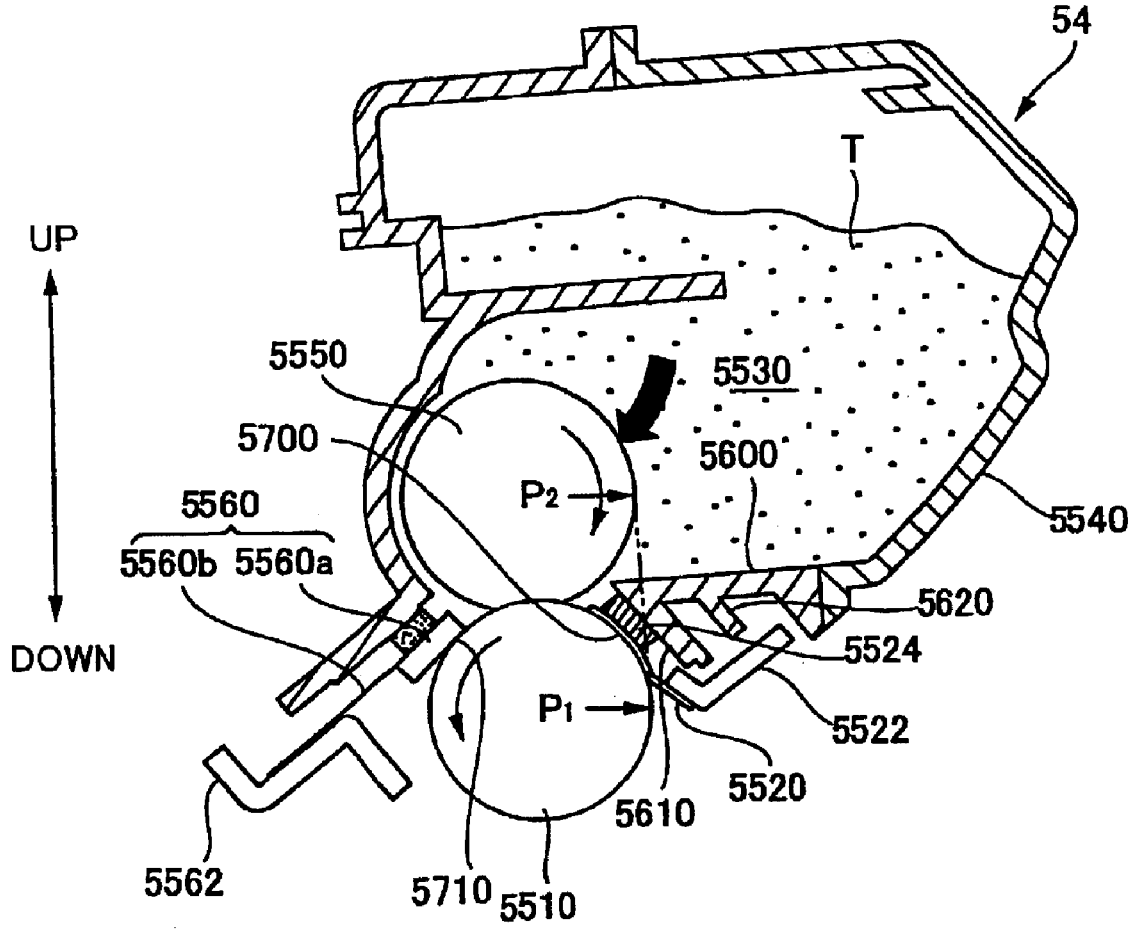
FIG. 15 is a section view showing of a developing unit in a position rotated 90° from a developing position.

When the developing unit 54 moves to such a position, the toner T is subjected to a force that is directed vertically downwards, in the direction of the black arrow schematically shown in FIG. 15, due to gravitation and the centrifugal force caused by rotation. However, since the diameter of the toner supplying roller 5550 is larger than that of the developing roller 5510 and the sealing member 5520 of the present embodiment abuts against the developing roller 5510 at an abutting section 5700 located at a predetermined distance from the uppermost section P1 of the developing roller 5510, the uppermost section P2 of the toner supplying roller 5550 is located to the right, rather than the left, of the sealing member 5520, and also, located to the right, rather than the left, of the abutting section 5700, as shown in FIG. 15.

Therefore, the toner T that tends to flow with great force in the direction of the black arrow will not directly collide against the sealing member 5520 (and the abutting section 5700), but collide against a section in the vicinity of the upper section of the toner supplying roller before collision against the abutting section 5700. Therefore, since it is possible to prevent the toner T from colliding against the abutting section 5700 at high pressure, is becomes possible to prevent the toner T from escaping out from the developing unit 54.

Further, on the side opposite to the abutting section 5700 for the sealing member 5520, a restriction blade 5560 abuts against the developing roller 5510 at a second abutting section 5710. On the opposite side of the uppermost section P2 of the toner supplying roller 5520, that is, on the side close to the frame 54, there is a gap having a predetermined width in which the toner T can flow. Particularly, in the state where the developing device is rotated 90° from the developing position as shown in FIG. 15, the toner T will pass through this gap and surge to the vicinity of the restriction blade 5560 at high pressure.

However, in the present embodiment, the lowermost section P3 of the toner supplying roller (in the developing position) is located below the upper end of the second abutting section 5710 of the restriction blade 5560 in the developing position as shown in FIG. 14. That is, in FIG. 15 which has a positional relationship of substantially 90° in view of FIG. 14, the lowermost section P3 is located on the left, rather than to the right side, of the second abutting section. For this reason, the flow path of the toner T, which surges from right above the second abutting section 5710 towards the second abutting section 5710 due mainly to gravitation, is intercepted by a section in the vicinity of the lowermost section of the toner supplying roller 5550. Therefore, it is possible to effectively prevent the toner T from escaping outside from the vicinity of the restriction blade 5560.

Second Example

Figure 16:
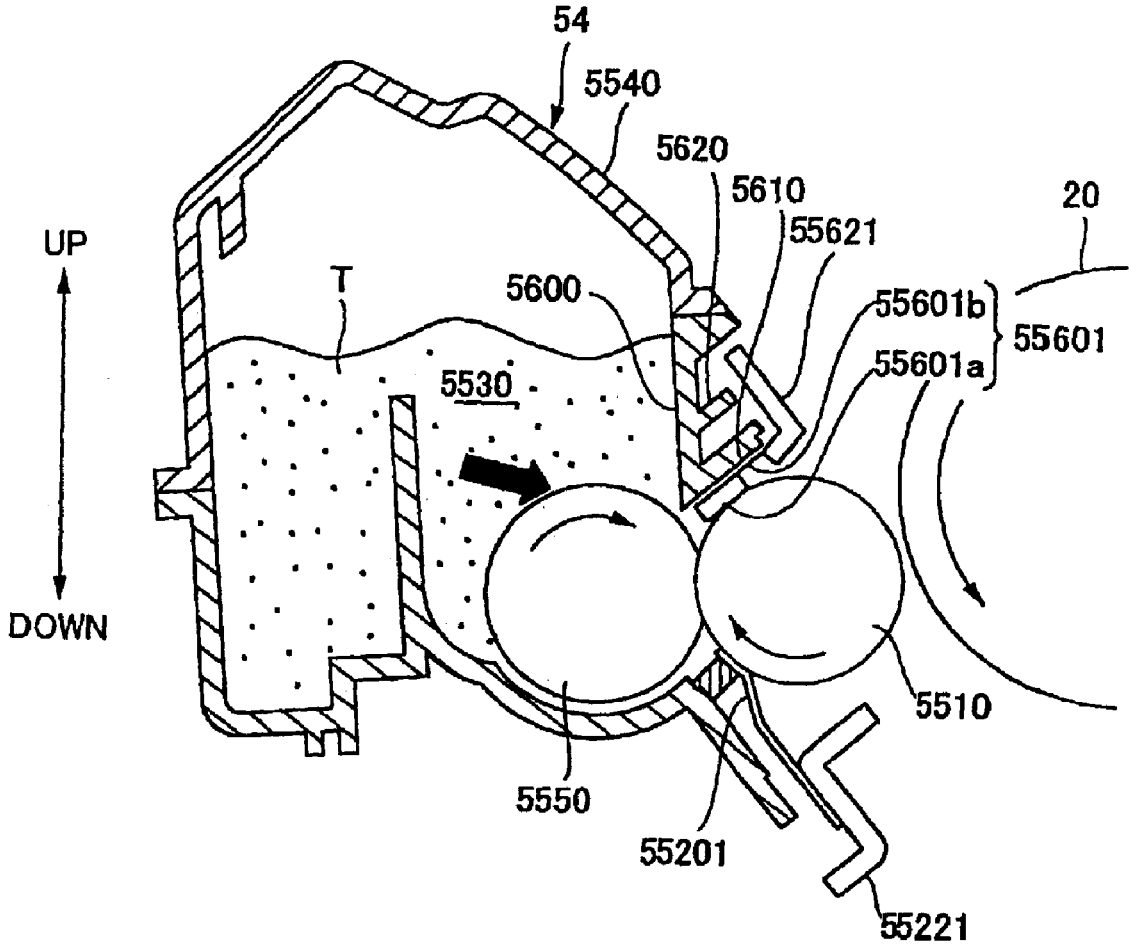
FIG. 16 is a section view showing some main structural components of a developing unit according to a second example of the fifth embodiment.

Next, with reference to FIG. 16, explanation will be made of a second example of the second embodiment of the present invention. FIG. 16 is a section view of the developing unit 54, similar to FIG. 14 for the first example. Among the structural components of the image-forming apparatus other than the developing unit 54, only the rotating direction of the photoconductor 20 is different from the first example; therefore, explanation of the overall configuration of the image-forming apparatus and of the control unit is omitted, since the configuration is the same as that in the first example.

As shown in FIG. 16, other than the rotating direction of the photoconductor 20, the rotating direction of the developing roller 5510 is different from that in the first example.

Because the rotating direction of the developing roller 5510 has been reversed, in the present example, a restriction blade 55601, which serves as a thickness restricting member, is located at the upper section of the developing roller 5510, instead of the sealing member 5520 that was provided there in the first example. Further, in the present example, a sealing member 55201 is located at the lower section of the developing roller 5510, instead of the restriction blade 5560*a* that was provided there in the first example.

More specifically, as shown in FIG. 16, in the present example, a blade-supporting metal plate 55621 is provided instead of the seal-supporting metal plate 5522 that was provided in the first example, and a rubber portion 55601*b* makes a counter-contact with the developing roller 5510 at an abutting section through a rubber-supporting section 55601*a*. Further, a seal-supporting metal plate 55221 is provided instead of the blade-supporting metal plate 5562 that was provided in the first example, and the sealing member 55201 contacts the developing roller 5510. A blade backing member (not shown) is provided on the back surface of the restriction blade 55601*a* and urges the restriction blade 55601*a*. A seal-urging member is provided on the back surface of the sealing member 55201 and urges the sealing member 55201.

The wall portion 5600 is substantially the same as that in the first example in terms of its shape, positioning, the shape and positioning of the tip end, and in terms that it comprises a second wall portion 5610 and a flange 5620. Therefore, similar to the first example, in cooperation with the wall portion 5600, the upper section of the toner supplying roller 5550 effectively prevents the toner T, which is subjected to a force as shown with the black arrow in FIG. 16 due to gravitation and the centrifugal force caused by rotation, from directly colliding against the restriction blade 55601*a*, and also, it is possible to prevent the toner T from escaping out from the developing unit 54. Other effects, such as prevention of the toner T from escaping when the developing unit is rotated to a position 90° from the developing position, are the same as those in the first example; therefore, explanation of those effects is omitted.

Other Examples

In the foregoing examples, the tip end (the lower end when the developing unit is placed in the developing position) of the wall portion 5600 is made to be sharp. However, the structure is not limited to the above. Instead, the wall portion 5600 may be made so that it has a flat end comprising a notch. By making the tip end of the wall portion 5600 extend to a position beyond the upper end of the abutting section, the effects of restricting the toner T from colliding against the sealing member 5520 and the abutting section 5700 and thereby preventing the toner T from escaping out from the developing unit can similarly be obtained.

Figure 17:
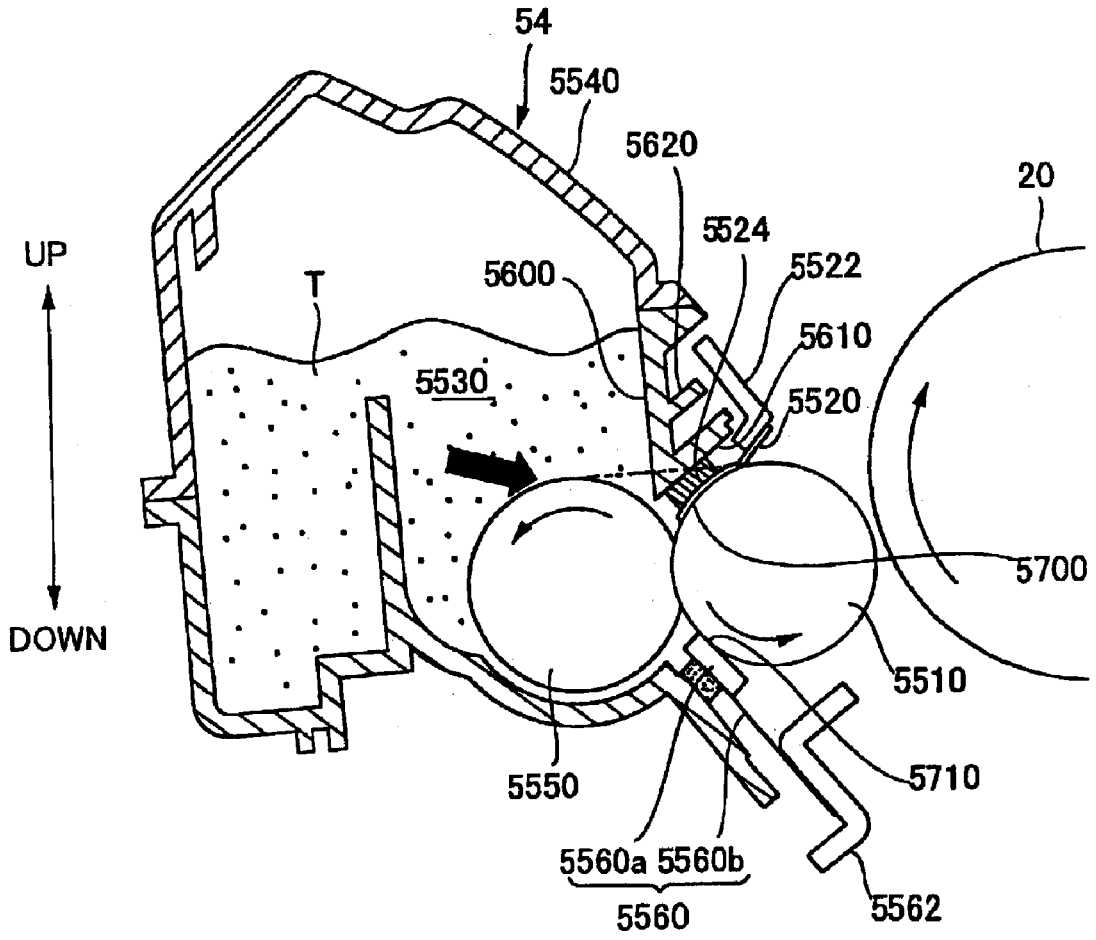
FIG. 17 is a section view of a modified example of the fifth embodiment.

In the foregoing examples, as shown in FIG. 14, the toner supplying roller 5550 is to rotate clockwise. However, the configuration is not limited to the above. For example, the roller 5550 may rotate counterclockwise in FIG. 14. FIG. 17 is a section view of a developing unit 54 according to such a modified example. The modified example shown in FIG. 17 has substantially the same structure as that of the first embodiment except that the rotating direction of the toner supplying roller 5550 is in the opposite direction. Therefore, the effects obtained by the developing unit, the image-forming apparatus etc. are the same as those of the first embodiment; for this reason, detailed explanation thereof is omitted.

Further, in the foregoing examples, the toner supplying roller 5550, which serves as a developer supplying member, is located below the developing roller 5510, which serves as a developer bearing member (in terms of positional relationship of the center of rotation), and the diameter of the toner supplying roller 5550 is larger than that of the developing roller 5510. However, the structure is not limited to the above. For example, the uppermost section of the toner supplying roller may be located above the lower end of the sealing member 5520 by making the diameter of the toner supplying roller smaller than that of the developing roller but arranging the toner supplying roller above the developing roller (in terms of positional relationship of the center of rotation). In this way, similar to the other embodiments mentioned above, the toner T that is subjected mainly to centrifugal force and tends to flow with great force in the direction of the black arrow (cf. FIG. 14) will not collide directly against the sealing member 5520 (and the abutting section 5700), but rather, it will collide against a section in the vicinity of the upper section of the toner supplying roller before collision against the abutting section. Therefore, since it is possible to prevent high-pressure collision of the toner T against the abutting section 5700, it becomes possible to prevent the toner T from escaping outside the developing unit 54.

===Outline of the Sixth Embodiment of the Developing Device===

Next, with reference to FIG. 18, explanation will be made of an outline of a configuration of the developing device.

The YMCK developing device 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made of only the yellow developing device 54.

Figure 18:
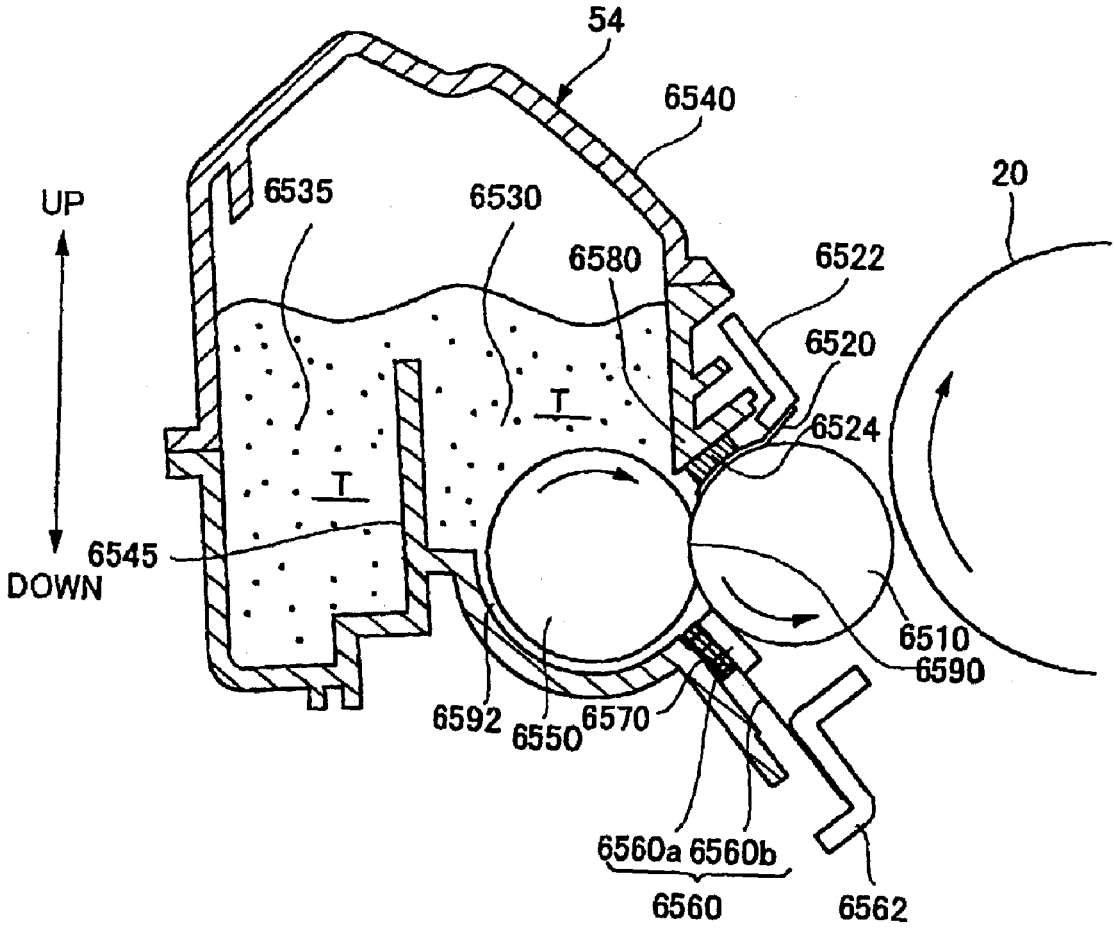
FIG. 18 is a section view showing some main structural components of a developing unit according to a sixth embodiment.
Figures 19A, 19B, 19C:
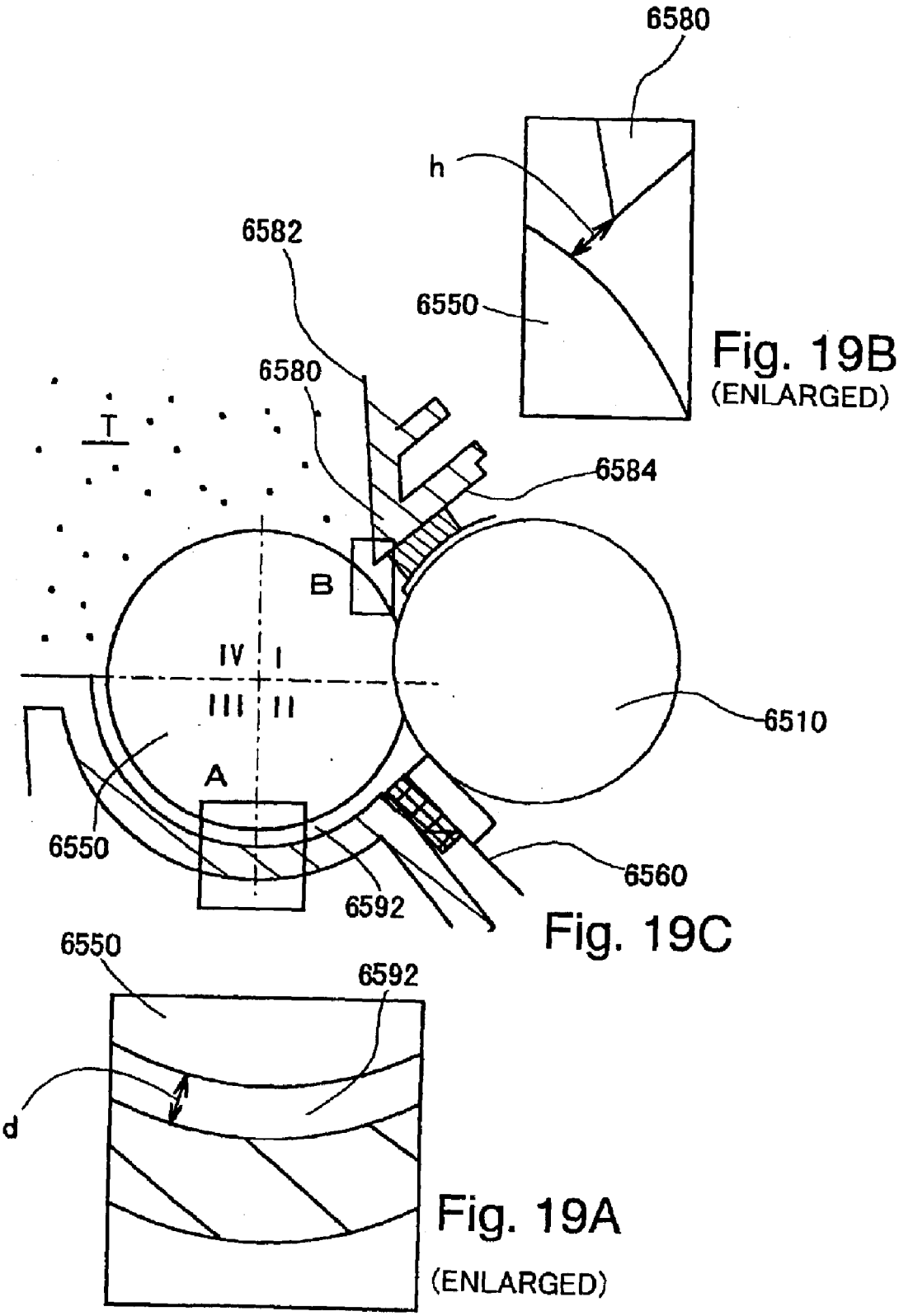
FIG. 19A is a view of the periphery of the toner supplying roller of the developing device shown in FIG. 18, and FIG. 19B and FIG. 19C show enlarged portions of FIG. 19A.

FIG. 18 is a section view showing some main structural components of the developing device in a state where the yellow developing device 54 is located at a developing position opposing the photoconductor 20. FIGS. 19A through 19C are diagrams enlarging the periphery of the toner supplying roller 6550. As in FIG. 1, in FIG. 18 and FIGS. 19A through 19C, the arrow indicates the vertical directions; for example, the central axis of the developing roller 6510 is located below the central axis of the photoconductor 20.

The yellow developing device 54 comprises, for example, the following as main structural components: the developing roller 6510, which serves as a developer bearing member; a sealing member 6520 and an elastic member 6524, which serve as a blocking member; a first container 6530; a second container 536; a frame 6540; a restriction wall 6545; a toner-supplying roller 6550, which serves as a developer supplying member; and a restriction blade 6560.

The frame 6540 is manufactured by joining a plurality of integrally-molded frames (for example, an upper frame, a bottom frame, and the like). The frame 6540 has an opening at its lower section. The toner supplying roller 6550 is arranged at the opening in a state in which a portion of the roller 6550 is exposed towards the outside of the developing device.

The first and second containers 6530, 6535 are sections for containing the toner T, and are formed by a part of the frame 6540. The frame comprises, as a part of the frame, a restriction wall 6545 for restricting the movement of the toner T between the first container 6530 and the second container 6535. The restriction wall 6545 extends upwards from below (in the vertical direction in FIGS. 19A through 19C). The upper end of the restriction wall 6545 is located above the uppermost section of the toner supplying roller 6550. A stirring member for stirring the toner T contained in the first and second containers 6530, 6535 may be provided. However, in the present embodiment, each of the developing devices (the black developing device 51, the magenta developing device 52, the cyan developing device 53, and the yellow developing device 54) rotate with the rotation of the YMCK developing device 50, and the toner T contained in each developing device is stirred according to this rotation; thus, the first and second containers 6530, 6535 do not comprise a stirring member.

The toner-supplying roller 6550, which is provided at the opening of the frame, is capable of supplying the toner T contained in the first and second containers 6530, 6535 to the developing roller 6510 located just outside the opening. The toner-supplying roller 6550 is made from, for example, polyurethane foam and the like, and fits tightly against the developing roller 6510 in an elastically-deformed state. The toner-supplying roller 6550 is arranged at a lower section of the first container 6530. The toner T contained in the first and second containers 6530, 6535 is supplied to the developing roller 6510 by the toner-supplying roller 6550 at the lower section of the first container 6530. The toner-supplying roller 6550 is rotatable about a central axis. The central axis is situated below the central axis of rotation of the developing roller 6510. Further, in the present embodiment, the toner-supplying roller 6550 rotates in the opposite direction (clockwise in FIG. 18) to the rotating direction of the developing roller 6510 (counterclockwise in FIG. 18). Note that, other than the function of supplying the toner T contained in the first and second containers 6530, 6535 to the developing roller 6510, the toner supplying roller 6550 also has the function of stripping the toner T remaining on the developing roller 6510 after development off from the developing roller 6510.

The developing roller 6510 carries toner T and delivers it to a developing position opposing the photoconductor 20. The developing roller 6510 is made from, for example, aluminum, stainless steel, or iron, and the roller 6510 is plated with, for example, nickel plating, chromium plating and the like, as necessary. Further, the developing roller 6510 is rotatable about a central axis located below the central axis of the photoconductor 20, and the roller 6510 rotates in the opposite direction (counterclockwise in FIG. 18) to the rotating direction of the photoconductor 20 (clockwise in FIG. 18). In the state where the yellow developing device 54 opposes the photoconductor 20, there exists a gap between the developing roller 6510 and the photoconductor 20. That is, the yellow developing device 54 develops the latent image formed on the photoconductor 20 in a non-contacting state. Note that an alternating field is generated between the developing roller 6510 and the photoconductor 20 upon developing the latent image formed on the photoconductor 20.

The sealing member 6520 is provided to prevent the toner T in the yellow developing device 54 from escaping out from the device as well as to collect the toner T, which is on the developing roller 6510 that has passed the developing position, into the developing device without scraping. The sealing member 6520 is a seal made from, for example, polyethylene film and the like. The sealing member 6520 is supported by a seal-supporting metal plate 6522, and is attached to the frame 6540 through the seal-supporting metal plate 6522. On the opposite side of the developing roller 6510 side, the sealing member 6520 is provided with an elastic member 6524 made from, for example, Moltoprene and the like. The sealing member 6520 is pressed against the developing roller 6510 by the elastic force of the elastic member 6524. Note that the position at which the sealing member 6520 contacts the developing roller 6510 is above the central axis of the developing roller 6510.

Above the toner supplying roller 6550 is provided a supply-amount restricting member 6580 so that an excessive amount of the toner T will not be supplied to the contacting surface between the toner supplying roller 6550 and the developing roller 6510. A part of the frame 6540 protrudes to form the supply-amount restricting member 6580. The supply-amount restricting member 6580 is in line with the inner wall and comprises a first wall surface 6582 that faces the toner supplying roller 6550 side and a second wall surface 6584 that faces the developing roller 6510 side. The first and second wall surfaces 6582, 6584 form an acute angle. The supply-amount restricting member 6580 serves to prevent the flow of the toner T in the first container 6530 from directly flowing into the contacting surface. Therefore, it is preferable that, among the four spaces that are formed by a horizontal plane and a vertical plane that pass through a center of rotation of the toner supplying roller 6550, the end of the supply-amount restricting member 6580 exists in the space above the developing roller 6510 and on the developing roller 6510 side (in the first quadrant in FIG. 19C). Further, a spacing h between the surface of the toner supplying roller 6550 and the end of the supply-amount restricting member is set to be substantially constant so that the developer can pass the spacing evenly. According to the same reasons as those for the spacing d (explained later), the spacing h should be somewhat small, preferably equal to or below 3 mm, and more preferably, equal to or below 2 mm.

The restriction blade 6560 is provided below the developing roller 6510. The restriction blade 6560 restricts the thickness of the layer of the toner T bore by the developing roller 6510 and also gives charge to the toner T bore by the developing roller 6510. The restriction blade 6560 comprises a rubber portion 6560*a* and a rubber-supporting portion 6560*b*. The rubber portion 6560*a* is made from, for example, silicone rubber, urethane rubber, and the like. The rubber-supporting portion 6560*b* is a thin plate made from, for example, phosphor bronze, stainless steel, and the like having a springy characteristic. The rubber portion 6560*a* is supported by the rubber-supporting portion 6560*b*. The rubber-supporting portion 6560*b* is attached to the frame 6540 through a pair of blade-supporting metal plates 6562, in a way such that one end of the rubber-supporting portion 6560*b* is pinched between the blade-supporting metal plates 6562. On the opposite side of the side at which the developing roller 6510 is located, the restriction blade 6560 is provided with a blade-backing member 6570 made from Moltoprene and the like.

The rubber portion 6560*a* is pressed against the developing roller 6510 by the elastic force caused by bending of the rubber-supporting portion 6560*b*. Further, the blade-backing member 6570 prevents the toner T from entering between the rubber-supporting portion 6560*b* and the frame 6540, stabilizes the elastic force caused by bending of the rubber-supporting portion 6560*b*, and also presses the rubber portion 6560*a* from the back thereof towards the developing roller 6510. Thus, the blade-backing member 6570 can make the pressure exerted by the rubber portion 6560*a* towards the developing roller 6510 more even.

The other end of the restricting blade 6560 that is not being supported by the blade-supporting metal plates 6562 (i.e., the tip end of the restriction blade 6560) does not contact the developing roller 6510; rather, a section at a predetermined distance from the tip end contacts, with some breadth, the developing roller 6510. In other words, the restriction blade 6560 does not abut against the developing roller 6510 with its end, but tightly contacts with the roller 6510 near its central portion. Further, the restriction blade 6560 is arranged so that its tip end faces towards the upper stream of the rotating direction of the developing roller 6510, and thus, makes a so-called counter-contact with respect to the roller 6510. Note that the abutting position where the restriction blade 6560 abuts against the developing roller 6510 is below the central axis of the developing roller 6510 and also below the central axis of the toner supplying roller 6550.

A developer passage 6592 is provided by forming the inner wall surface of the frame 6540 from below the toner supplying roller 6550, along the surface of the toner supplying roller 6550, and towards a direction on the opposite side of the photoconductor 20 in relation to a center of rotation of the toner supplying roller 6550. The developer, which has passed between the contacting surface 6590 where the toner supplying roller 6550 and the developing roller 6510 contact each other, will pass the developer passage 6592 and be collected into the toner container. In order for the developer to smoothly pass through the developer passage 6592, the spacing d between the surface of the toner supplying roller 6550 and the inner wall surface of the frame 6540 is set to be substantially constant. In the developer passage 6592, the toner T is carried by a force generated by the rotation of the toner supplying roller 6550; if the spacing d is large, this force will not reach the inner wall surface of the frame 6540, and the toner T might precipitate or accumulate on the surface of the inner wall surface. The so-formed precipitation and/or deposits may inhibit the toner T from flowing through the developer passage; in other cases, the precipitation and/or deposits may fall off and form clusters, and these clusters may inhibit normal flow of the toner T. Therefore, the spacing d should be somewhat small, preferably 0.5 mm through 3 mm, and more preferably, 1 mm through 2 mm. In the present embodiment, the spacing d is 1.25 mm.

<Relation between the Functions of the Control Unit and the Structure of the Present Invention>

In the yellow developing device 54 thus structured, the toner-supplying roller 6550 supplies the toner T contained in the first and second containers 6530, 6535 to the developing roller 6510 at the abutting section 700. Here, the toner T supplied to the contacting surface 6590 between the toner supplying roller 6550 and the developing roller 6510 is restricted in its amount by the supply-amount restricting member 6580, and therefore, will not be supplied in excess. Having been supplied to the developing roller 6510, with the rotation of the developing roller 6510, the toner T reaches the abutting position of the restriction blade 6560; and, as the toner T passes the abutting position, the toner is charged and its thickness is restricted. Having its thickness being restricted, with further rotation of the developing roller 6510, the toner T on the developing roller 6510 reaches the developing position opposing the photoconductor 20; then, under the alternating field, the toner T is used for developing the latent image formed on the photoconductor 20 at the developing position. Having passed the developing position, with further rotation of the developing roller 6510, the toner T on the developing roller 6510 passes the sealing member 6520 and is collected into the developing device by the sealing member 6520 without being scraped off.

On the other hand, among the toner T bore by the toner supplying roller 6550, the toner T that was not supplied to the developing roller and/or the toner T that has been scraped off by the restriction blade 6560 after being supplied will pass the developer passage 6592 and be collected into the toner container 6530. During this process, by setting the spacing h (the spacing between the surface of the toner supplying roller 6550 and the end of the supply-amount restricting member) smaller than the spacing d (the spacing between the surface of the toner supplying roller 6550 and the inner wall surface of the frame 6540), it is possible to provide enough room to allow all of the developer that has passed by the supply-amount restricting member 6580 to pass through the developer passage 6592. In this way, it is possible to smoothly collect the toner T, which is to be collected after passing the contacting surface between the toner supplying roller 6550 and the developing roller 6510, into the container. Therefore, the toner T will be supplied steadily to the contacting surface.

Other Examples

In the foregoing embodiment, the supply-amount restricting member 6580 for the toner T protrudes towards the toner supplying roller 6550. However, the structure is not limited to the above. For example, the supply-amount restricting member 6580 may be structured from a member having an inner wall surface that is in line with the toner supplying roller 6550.

Further, the supply-amount restricting member 6580 for the toner T is formed as a part of the wall. However, the supply-amount restricting member 6580 can be structured as an independent component made from a material different from the wall.

Further, the supply-amount restricting member 6580 for the toner T comprises a first wall surface 6582 that faces the toner supplying roller 6550 side and a second wall surface 6584 that faces the developing roller 6510 side, and the first and second wall surfaces 6582, 6584 form a linear end forming an acute angle. However, the structure is not limited to the above. For example, the supply-amount restricting member 6580 does not have to comprise a sharp end, the supply-amount restricting member 6580 may be formed by three or more wall surfaces, and the two wall surfaces do not have to form an acute angle.

Further, in the foregoing embodiment, the sealing member 6520 that contacts the developing roller 6510 and the elastic member 6524 that occupies a gap between the second wall surface 6584 and the sealing member 6520 and presses the sealing member 6520 towards the developing roller 6510 are provided between the second wall surface 6584 and the developing roller 6510. However, the structure is not limited to the above. For example, the blocking member does not have to be structured from two members; it may be formed by a single member or by three or more members.

Further, in the foregoing embodiment, the end of the supply-amount restricting member 6580 exists in the space above the developing roller 6510 and on the developing roller 6510 side among the four spaces that are formed by a horizontal plane and a vertical plane that pass through a center of rotation of the toner supplying roller 6550, that is, the end of the member 6580 exists in the first quadrant in FIG. 19C. However, the end of the member 6580 may be in the second quadrant or in the fourth quadrant.

Further, the foregoing embodiment adopts a form in which the spacing between the end of the supply-amount restricting member 6580 and the outer surface of the toner supplying roller 6550 is constant. However, the size of the spacing in some sections may be different from other sections.

Further, the developer passage 6592 is provided by forming the inner wall surface of the frame 6540 from below the toner supplying roller 6550, along the surface of the toner supplying roller 6550, and towards a direction on the opposite side of the photoconductor 20 in relation to a center of rotation of the toner supplying roller 6550. However, the length of the developer passage 6592 does not have to be cover one fourth of the periphery of the toner supplying roller 6550, but may be of any length as long as the toner can pass through the passage. For example, the passage may be a gap formed between a sharp end and the toner supplying roller 6550.

Further, the foregoing embodiment adopts a form in which the spacing for the developer passage 6592 between the surface of the toner supplying roller 6550 and the inner wall surface of the frame is substantially constant. However, the size of the spacing in some sections along the toner supplying roller 6550 may be different from other sections.

===Outline of the Seventh Embodiment of the Developing Device===

Figure 20:
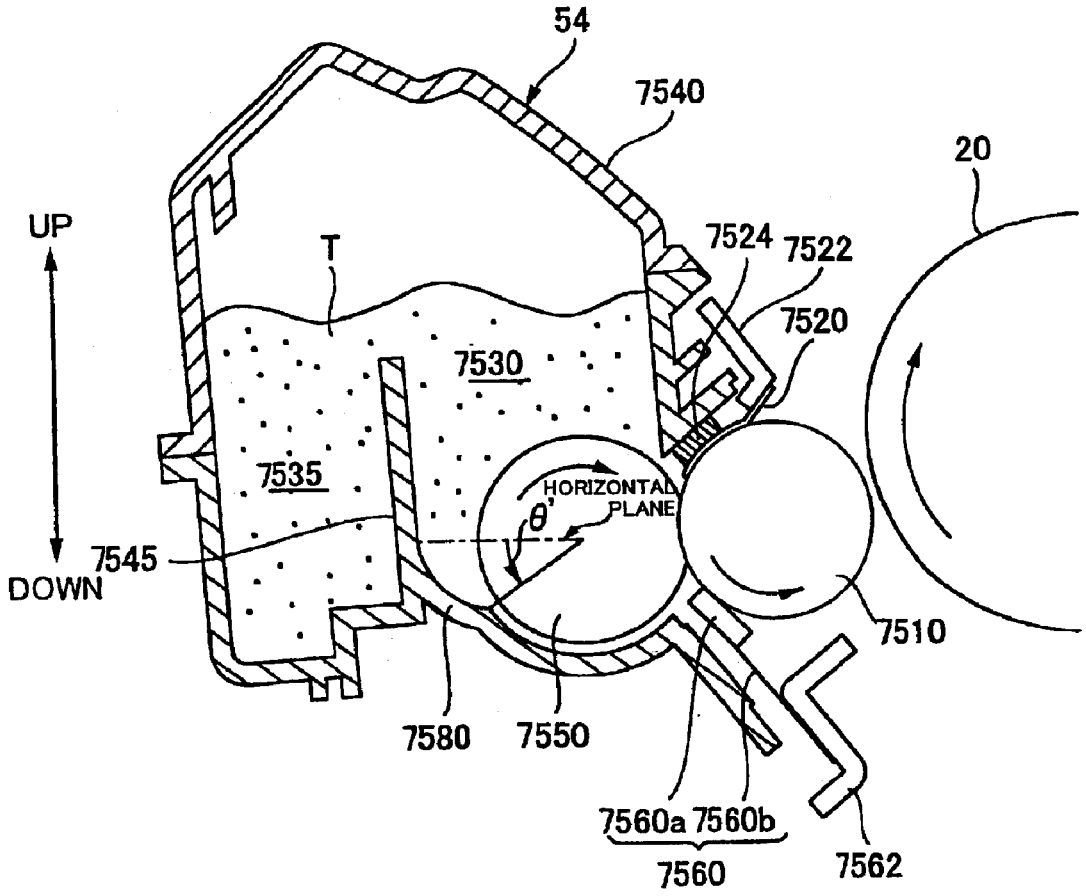
FIG. 20 is a section view showing some main structural components of a developing unit according to a seventh embodiment.

Next, with reference to FIG. 20, explanation will be made of an outline of a configuration of the developing device. FIG. 20 is a section view showing some main structural components of the developing device. As in FIG. 1, in. FIG. 20, the arrow indicates the vertical directions; for example, the central axis of the developing roller 7510 is located below the central axis of the photoconductor 20. Further, FIG. 20 shows a state in which the yellow developing device 54 is located in the developing position opposing the photoconductor 20.

The YMCK developing device 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made of only the yellow developing device 54.

The yellow developing device 54 comprises, for example: the developing roller 7510, which serves as a developer bearing member; a sealing member 7520; a first container 7530; a second container 7535; a frame 7540; a restriction wall 7545; a toner-supplying roller 7550, which serves as a developer supplying member; a restriction blade 7560, which serves as a thickness restricting member; and a not-shown blade-backing member 570 for urging the restriction blade 7560.

The developing roller 7510 carries toner T and delivers it to a developing position opposing the photoconductor 20. The developing roller 7510 is made from, for example, aluminum, stainless steel, or iron, and the roller 7510 is plated with, for example, nickel plating, chromium plating and the like, as necessary. Further, the developing roller 7510 is rotatable about a central axis. As shown in FIG. 20, in the present embodiment, the roller 7510 rotates in the opposite direction (counterclockwise in FIG. 20) to the rotating direction of the photoconductor 20 (clockwise in FIG. 20). The central axis of the roller 7510 is located below the central axis of the photoconductor 20.

As shown in FIG. 20, in the state where the yellow developing device 54 opposes the photoconductor 20, there exists a gap between the developing roller 7510 and the photoconductor 20. That is, the yellow developing device 54 develops the latent image formed on the photoconductor 20 in a non-contacting state. Note that an alternating field is generated between the developing roller 7510 and the photoconductor 20 upon developing the latent image formed on the photoconductor 20.

The sealing member 7520 is provided to prevent the toner T in the yellow developing device 54 from escaping out from the device as well as collect the toner T, which is on the developing roller 7510 that has passed the developing position, into the developing device without scraping. The sealing member 7520 is a seal made from, for example, polyethylene film and the like. The sealing member 7520 is supported by a seal-supporting metal plate 7522, and is attached to the frame 7540 through the seal-supporting metal plate 7522. On the opposite side of the developing roller 7510 side, the sealing member 7520 is provided with a seal-urging member 7524 made from, for example, Moltoprene and the like. The sealing member 7520 is pressed against the developing roller 7510 by the elastic force of the seal-urging member 7524. Note that the abutting section where the sealing member 7520 abuts against the developing roller 7510 is above a central axis of the developing roller 7510.

The first and second containers 7530, 7535 are sections for receiving (containing) the toner T. A portion of the frame 7540 structures the first and second containers 7530, 7535. The frame 7540 comprises a restriction wall 7545 for restricting the movement of the toner T between the first container 7530 and the second container 7535. The restriction wall 7545 extends upwards from below (in the vertical direction in FIG. 20). The upper end of the restriction wall 7545 is located above the uppermost section of the toner supplying roller 7550. A stirring member for stirring the toner T contained in the first and second containers 7530, 7535 may be provided. However, in the present embodiment, each of the developing devices (the black developing device 51, the magenta developing device 52, the cyan developing device 53, and the yellow developing device 54) rotate with the rotation of the YMCK developing device 50, and the toner T contained in each developing device is stirred according to this rotation; thus, the first and second containers 7530, 7535 do not comprise a stirring member.

The toner-supplying roller 7550 is capable of supplying the toner T contained in the first and second containers 7530, 7535 to the developing roller 7510. The toner-supplying roller 7550 is made from, for example, polyurethane foam and the like, and abuts against the developing roller 7510 in an elastically-deformed state. The toner-supplying roller 7550 is arranged at a lower section of the first container 7530. The toner T contained in the first and second containers 7530, 7535 is supplied to the developing roller 7510 by the toner-supplying roller 7550 at the lower section of the first container 7530. The toner-supplying roller 7550 is rotatable about a central axis. The central axis is situated below the central axis of rotation of the developing roller 7510. Further, in the present embodiment, the toner-supplying roller 7550 rotates in the opposite direction (clockwise in FIG. 20) to the rotating direction of the developing roller 7510 (counterclockwise in FIG. 20). Note that, other than the function of supplying the toner T contained in the first and second containers 7530, 7535 to the developing roller 7510, the toner supplying roller 7550 also has the function of stripping the toner remaining on the developing roller 7510 after development off from the developing roller 7510.

As shown in FIG. 20, a gap that (i) exists on a plane that passes through the center of rotation of the toner supplying roller 7550 and forms an angle θ with a horizontal plane (see figure), which is taken as a reference and extends from the center of rotation of the toner supplying roller 7550 towards the opposite side of the photoconductor 20, in a direction opposite to the rotating direction of the toner supplying roller 7550 and (ii) exists between the toner supplying roller 7550 and the inner wall of the first container 7530 is taken as Δd. Within a range of $0° \leqq \theta \leqq 90°$, while θ increases from 0° up to a predetermined angle θ', Δd becomes gradually smaller. Further, the inner wall of the first container 7530 has a curved section 7580, and while θ increases from θ' to 90°, Δd has a constant value. This constant value is 0.5 mm through 3 mm, and preferably 1 mm through 2 mm. In the present embodiment, Δd is 1.25 mm.

The restriction blade 7560, which serves as a thickness restricting member, restricts the thickness of the layer of the toner T bore by the developing roller 7510 and also gives charge to the toner T bore by the developing roller 7510. The restriction blade 7560 comprises a rubber portion 7560*a* and a rubber-supporting portion 7560*b*. The rubber portion 7560*a* is made from, for example, silicone rubber, urethane rubber, and the like. The rubber-supporting portion 7560*b* is a thin plate made from, for example, phosphor bronze, stainless steel, and the like having a springy characteristic. The rubber portion 7560*a* is supported by the rubber-supporting portion 7560*b*. The rubber-supporting portion 7560*b* is attached to the frame 7540 through a pair of blade-supporting metal plates 7562, in a way such that one end of the rubber-supporting portion 7560*b* is pinched between the blade-supporting metal plates 7562. On the opposite side of the side at which the developing roller 7510 is located, the restriction blade 7560 is provided with a not-shown blade-backing member 570 made from Moltoprene and the like.

The rubber portion 7560*a* is pressed against the developing roller 7510 by the elastic force caused by bending of the rubber-supporting portion 7560*b*. Further, the not-shown blade-backing member 570 prevents toner from entering between the rubber-supporting portion 7560*b* and the frame 7540, stabilizes the elastic force caused by bending of the rubber-supporting portion 7560*b*, and also urges the rubber portion 7560*a* from the back thereof towards the developing roller 7510 to press the rubber portion 7560*a* against the developing roller 7510. Thus, the not-shown blade-backing member 570 can make the rubber portion 7560*a* abut against the developing roller 7510 more evenly.

The other end of the restricting blade 7560 that is not being supported by the blade-supporting metal plates 7562 (i.e., the tip end of the restriction blade 7560) does not contact the developing roller 7510; rather, a section at a predetermined distance from the tip end contacts, with some breadth, the developing roller 7510. In other words, the restriction blade 7560 does not abut against the developing roller 7510 with its end, but abuts against the roller 7510 near its central portion. Further, the restriction blade 7560 is arranged so that its tip end faces towards the upper stream of the rotating direction of the developing roller 7510, and thus, makes a so-called counter-contact with respect to the roller 7510. Note that the abutting position where the restriction blade 7560 abuts against the developing roller 7510 is below the central axis of the developing roller 7510 and also below the central axis of the toner supplying roller 7550.

The frame 7540 is manufactured by joining a plurality of integrally-molded frames (for example, an upper frame, a bottom frame, and the like). The frame 7540 has an opening at its lower section. The developing roller 7510 is arranged at the opening in a state in which a portion of the roller 7510 is exposed outside.

In the yellow developing device 54 thus structured, as the toner-supplying roller 7550 rotates, it supplies the toner T contained in the first and second containers 7530, 7535 to the developing roller 7510. Having been supplied to the developing roller 7510, with the rotation of the developing roller 7510, the toner T reaches the abutting position of the restriction blade 7560; and, as the toner T passes the abutting position, the toner is charged and its thickness is restricted. Having its thickness being restricted, with further rotation of the developing roller 7510, the toner T on the developing roller 7510 reaches the developing position opposing the photoconductor 20; then, under the alternating field, the toner T is used for developing the latent image formed on the photoconductor 20 at the developing position. Having passed the developing position, with further rotation of the developing roller 7510, the toner T on the developing roller 7510 passes the sealing member 7520 and is collected into the developing device by the sealing member 7520 without being scraped off.

<Sealing Characteristic of the Toner>

Figure 21A:
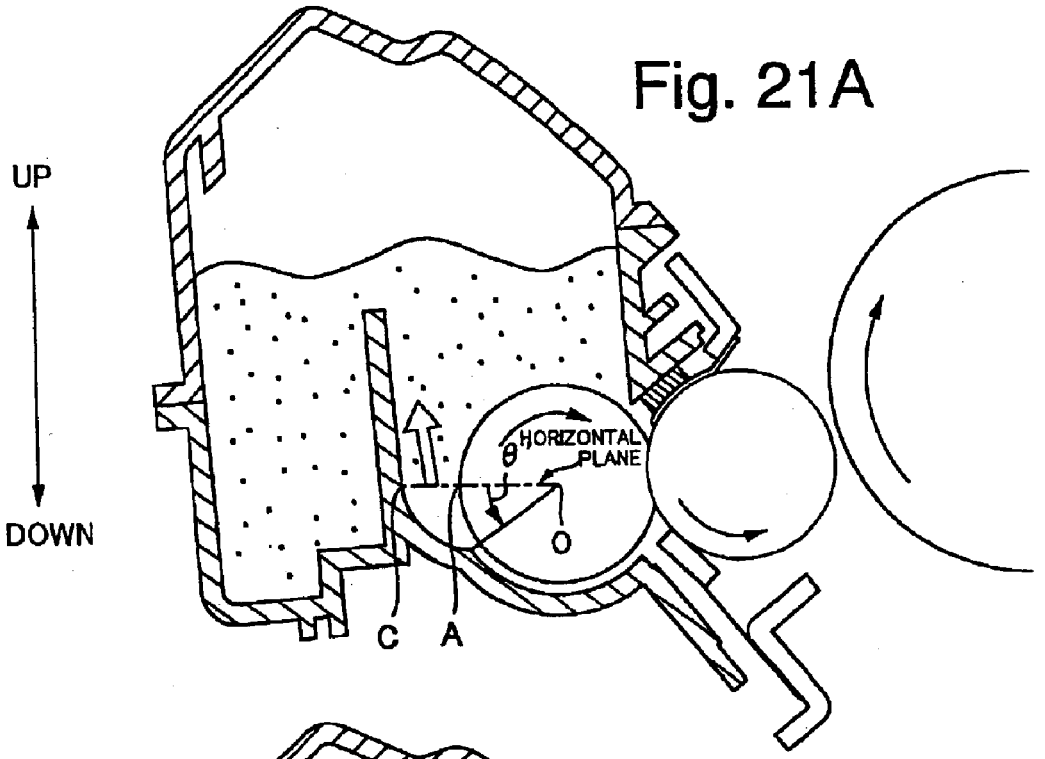
FIGS. 21A and 21B are diagrams showing the average velocity, at a horizontal plane ($\theta=0°$), at which the toner bursts out.
Figure 21B:
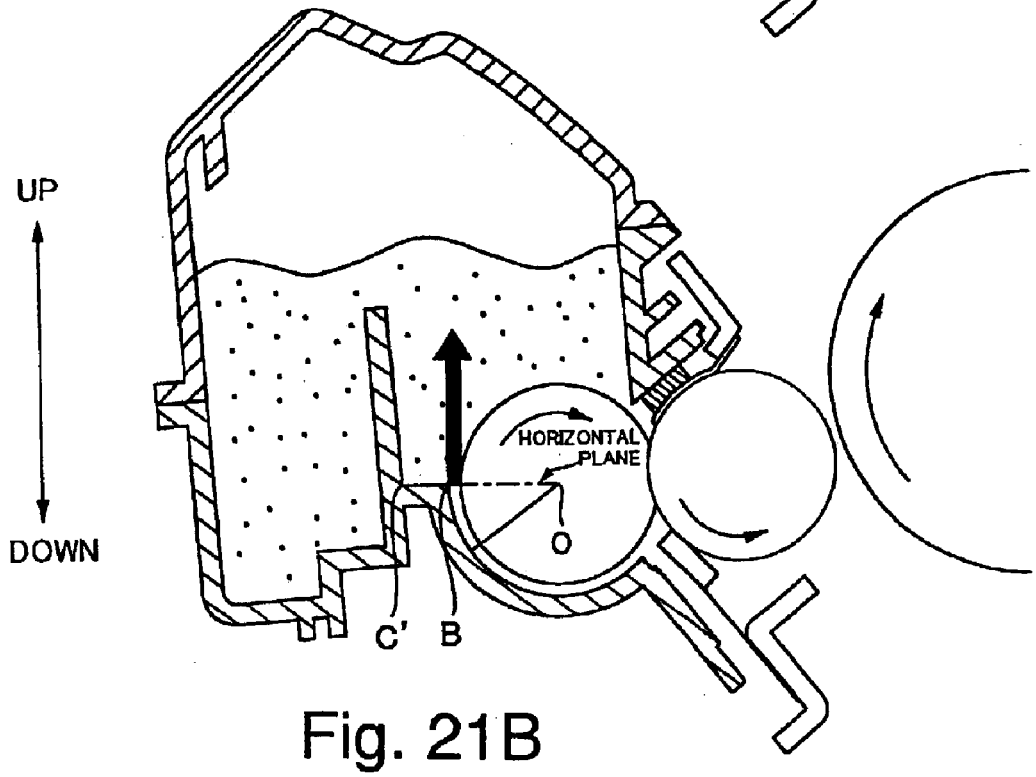
Figure 22A:
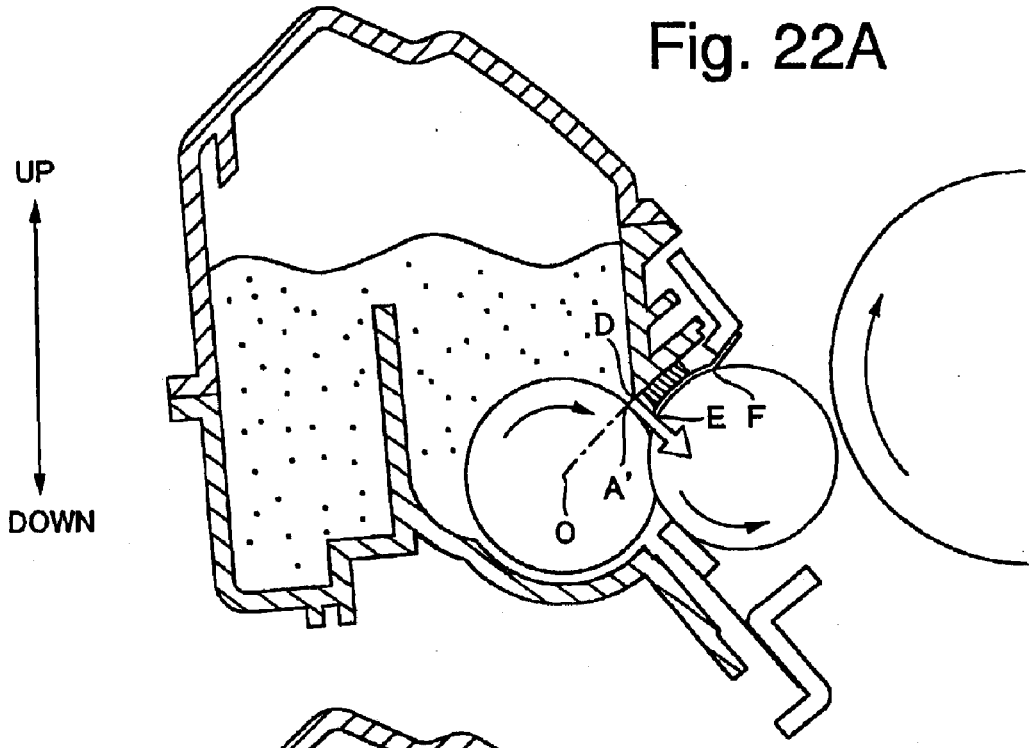
FIG. 22A and FIG. 22B are diagrams showing the component of the velocity of the toner taken along the circumference of the toner supplying roller and right before the sealing member.
Figure 22B:
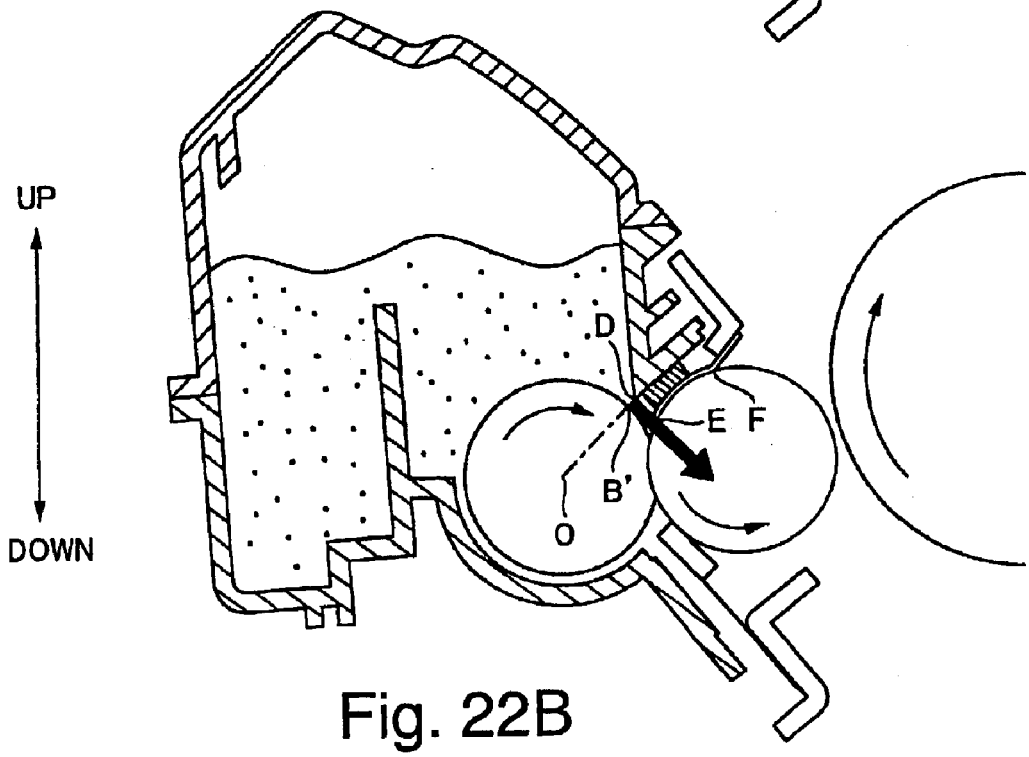

With reference to FIG. 21A, FIG. 21B, FIG. 22A, and FIG. 22B, explanation will be made of an influence that the structure of the gap (Δd) between the toner supplying roller 7550 and the inner wall of the first container 7530 has upon the sealing characteristic of the toner T. FIG. 21A and FIG. 21B are diagrams showing the average velocity, at the above-mentioned horizontal plane (θ=0°), at which the toner T bursts out. FIG. 22A and FIG. 22B are diagrams showing the component of the velocity of the toner T taken along the circumference of the toner supplying roller 7550 and right before the sealing member.

Figure 31:
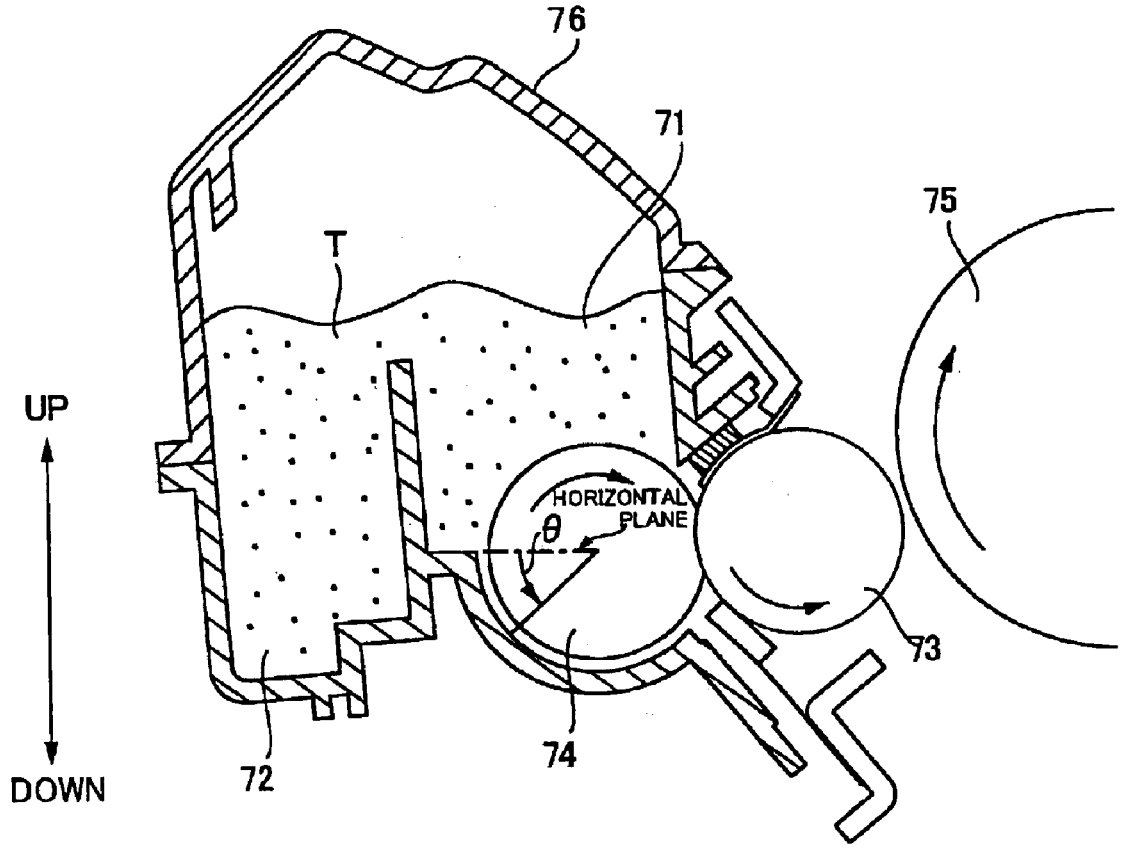
FIG. 31 is a diagram showing another example of a developing device.

FIG. 21A shows the average velocity, at the horizontal plane AC, at which the toner T bursts out when the yellow developing device of the present embodiment is used. The average velocity is indicated in terms of magnitude (speed) and direction (see the white arrow). For comparison with the developing device of FIG. 21A, FIG. 21B shows a developing device as shown in FIG. 31, in which Δd has a constant value throughout the range of $0° \leqq \theta \leqq 90°$, and its average velocity, at the horizontal plane BC', at which the toner T bursts out. The average velocity is indicated in terms of magnitude (speed) and direction (see the black arrow). Note that the absolute size of the arrow has no particular meaning, and it only signifies a relative difference in magnitude.

In FIG. 21A, which indicates the present embodiment, the toner T will be shoved into a narrow space within the range of $\theta' \leqq \theta \leqq 90°$ and pressurized through rotation of the toner supplying roller 7550, and the inner pressure of the toner T increases. However, since the inner pressure will be relieved by virtue of the Δd that gets gradually larger as the value of θ decreases within the range of $0° \leqq \theta \leqq \theta'$. Therefore, the toner T is prevented from bursting out in the perpendicular direction to the above-mentioned horizontal plane at the horizontal plane AC. Further, when observing from a direction perpendicular to the above-mentioned horizontal plane, Δd is wide in the direction of the restriction wall 7545 and becomes large in a asymmetric manner, it is thought that the average velocity of the toner T at the horizontal plane AC has a velocity component in the direction towards the restriction wall 7545.

On the other hand, according to the developing device shown in FIG. 21B, the toner T is shoved into a narrow space throughout the range of $0° \leqq \theta \leqq 90°$ and pressurized through rotation of the toner supplying roller 7550, and the inner pressure of the toner T increases. However, since the inner pressure is suddenly relieved at the horizontal plane BC', the toner T will burst out in the direction perpendicular to the horizontal plane.

According to the above, it can be appreciated that, in FIG. 21A, the direction of the average velocity of the toner T in the developing device according to the present embodiment is slightly towards the restriction wall 7545, whereas the direction of the average velocity of the developing device in FIG. 21B is almost perpendicular to the horizontal plane. Further, the magnitude (speed) of the developing device of FIG. 21B is larger than that of the developing device of the present embodiment.

The more the component of the direction of the velocity at the horizontal plane AC or BC' there is in the direction of the sealing member 7520, the more the velocity of the toner T that flows towards the sealing member 7520 will increase. In FIG. 21A, the velocity of the toner T in the developing device of the present embodiment is tilted towards the restriction wall 7545 and has a component towards the opposite of the sealing member 7520. On the other hand, in the developing device of FIG. 21B, the velocity of the toner T is in the direction perpendicular to the horizontal plane. Therefore, in the developing device of the present embodiment shown in FIG. 21A, the toner T is restricted from flowing towards the sealing member 7520, compared to the developing device shown in FIG. 21B.

FIG. 22A shows the magnitude of the component of the velocity of the toner T taken at the gap DA' (the gap between the frame 7540 and the toner supplying roller 7550) in the direction along the circumference of the toner supplying roller 7550 when the yellow developing device of the present embodiment is used (see the white arrow). For comparison with the developing device of FIG. 22A, FIG. 22B shows a developing device as shown in FIG. 31, in which $\Delta d$ has a constant value throughout the range of $0° \leqq \theta \leqq 90°$, and the magnitude of the component of the velocity of the toner T taken at the gap DB' (the gap between the frame 7540 and the toner supplying roller 7550) in the direction along the circumference of the toner supplying roller 7550 (see the black arrow). Note that the absolute size of the arrow has no particular meaning, and it only signifies a relative difference in magnitude.

The larger the bursting velocity of toner T along the circumference of the toner supplying roller 7550 is at the above-mentioned horizontal plane (shown in FIG. 21A and FIG. 21B), the larger the velocity of the toner T along the circumference at point A' and point B' becomes, in association with the bursting velocity, when the toner supplying roller 7550 shown in the figures rotates from points A and B towards points A' and B', respectively. Therefore, since the bursting velocity of the toner T in the developing device shown in FIG. 21B is larger than that of the developing device of the present embodiment, in the developing device of FIG. 21B, the velocity of the toner T right before the sealing member 7520 as shown in FIG. 22B will be larger than that of the developing device according to the present embodiment shown in FIG. 21A and FIG. 22A.

If the toner T, which has a velocity in the direction along the circumference of the toner supplying roller 7550 at the gap DA' or DB', passes by an abutting position EF where the sealing member 7520 made from soft film and the developing roller 7510 abut against each other, there is a possibility that the toner T will escape from the developing device. Therefore, as the velocity of the toner T at the gap DA' or DB' gets smaller, escaping of the toner T will further be restricted. For this reason, the toner T is suitably restricted from escaping according to the developing device of the present embodiment shown in FIG. 21A, compared to the developing device shown in FIG. 21B.

Other Examples

In the foregoing embodiment, the upper end of the restriction wall 7545 is located above the uppermost section of the toner supplying roller 7550. However, the structure is not limited to the above. For example, the upper end of the restriction wall 7545 may be located below the uppermost section of the toner supplying roller 7550. However, even when the upper end of the restriction wall 7545 is located above the uppermost section of the toner supplying roller 7550 and the toner T is reflected towards the sealing member 7520 by one side of the wall of the restriction wall 7545, the movement of the toner T flowing towards the sealing member 7520 is effectively restricted. More specifically, for example, in FIG. 20, there is a possibility that the toner T, which moves upwards at the above-mentioned horizontal plane (i.e., $\theta=0°$), is reflected by the restriction wall 7545 and will move towards the sealing member 7520. However, this movement will be restricted because the velocity of the toner T before being reflected is decreased due to relief of inner pressure caused by the $\Delta d$ made to have a larger dimension.

Further, in the foregoing embodiment, the restriction wall 7545 is made to extend upwards from below. However, the structure is not limited to the above. For example, the restriction wall 7545 may be tilted. However, even when the restriction wall 7545 is made to extend upwards from below and the toner T is reflected towards the sealing member 7520 by one side of the wall of the restriction wall 7545, the movement of the toner T flowing towards the sealing member 7520 is effectively restricted. More specifically, for example, in FIG. 20, there is a possibility that the toner T, which moves upwards at the above-mentioned horizontal plane (i.e., $\theta=0°$), is reflected by the restriction wall 7545 and will move towards the sealing member 7520. However, this movement will be restricted because the velocity of the toner T before being reflected is decreased due to relief of inner pressure caused by the $\Delta d$ made to have a larger dimension.

In the foregoing embodiment, as shown in FIG. 20, the toner supplying roller 7550 is to rotate clockwise. However, the configuration is not limited to the above. For example, the roller 7550 may rotate counterclockwise in FIG. 20. However, even when the toner supplying roller 7550 is to rotate clockwise in FIG. 20 and the toner T may have a velocity directed upwards from the above-mentioned horizontal plane along the circumference of the toner supplying roller 7550, the movement of the toner T flowing towards the sealing member 7520 will be effectively restricted.

Further, in the foregoing embodiment, the toner supplying roller 7550 is an elastic member. However, the structure is not limited to the above. For example, the toner supplying roller 7550 does not have to be an elastic member. However, even when the toner supplying roller 7550 is made from, for example, polyurethane foam and the velocity of the toner T flowing along the circumference of the toner supplying roller 7550 becomes larger than when the roller 7550 is made from a stiff material because of the high pressure caused by making the roller 7550 out of an elastic member, the movement of the toner T towards the sealing member 7520 will still be effectively restricted due to relief of inner pressure caused by the $\Delta d$ made to have a larger dimension.

Further, in the foregoing embodiment, for example, in FIG. 20, as θ increases within the range of 0°≦θ≦90°, Δd does not become larger in association with the increase of θ. However, the structure is not limited to the above. For example, Δd may become larger as θ becomes larger within the range of 0°≦θ≦90°. However, if Δd does not become larger in association with the increase of θ within the range of 0°≦θ≦90°, the pressure of the toner T applied on the gap between the toner supplying roller 7550 and the inner wall of the first container 7530 will not increase as θ becomes smaller. Therefore, the above-mentioned structure is preferable in terms that the movement of the toner T colliding against the sealing member 7520 located above the horizontal plane is effectively restricted, because the pressure of the toner will be relieved and the velocity of the toner T at the horizontal plane (θ=0°) in the upward direction from below along the circumference of the toner supplying roller will decrease.

Further, in the foregoing embodiment, for example, in FIG. 20, within the range of 0°≦θ≦90°, while θ increases from 0° up to a predetermined angle θ', Δd becomes gradually smaller, and while θ increases from the predetermined angle θ' up to 90°, Δd has a constant value. However, the structure is not limited to the above. For example, it is not necessary to set the above-mentioned predetermined angle θ'. However, if the above-mentioned predetermined angle θ' exists, the pressure of the toner T applied on the gap between the toner supplying roller 7550 and the inner wall of the first container 7530 will decrease as θ becomes smaller than θ'. Therefore, the above-mentioned structure is preferable in terms that the movement of the toner T colliding against the sealing member 7520 located above the horizontal plane is effectively restricted, because the pressure of the toner will be relieved and the velocity of the toner T at the horizontal plane in the upward direction from below along the circumference of the toner supplying roller 7550 will decrease.

Figure 23:
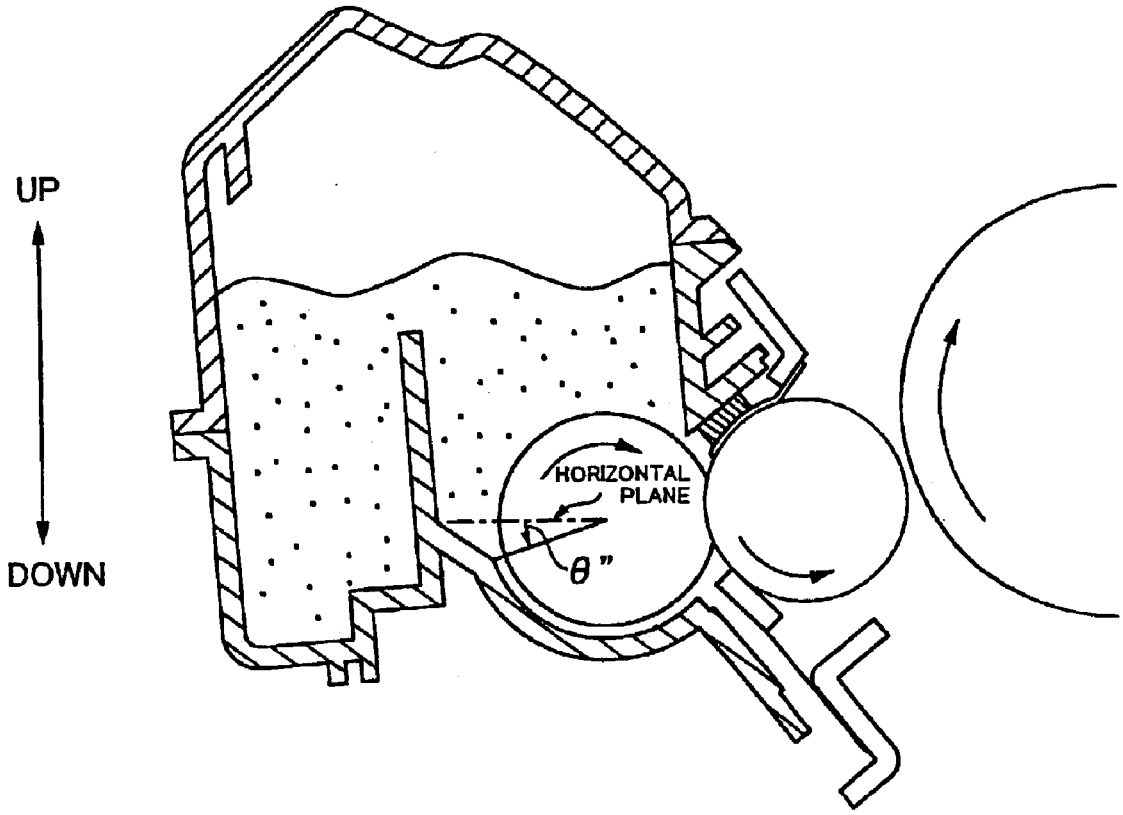
FIG. 23 shows a developing device according to another example of the seventh embodiment.

Further, in the foregoing embodiment, Δd is defined by a curved section 7580. However, the structure is not limited to the above. FIG. 23 shows a developing device according to another example of the present embodiment. In FIG. 23, the curved section 7580 is not provided; within the range of θ"≦θ≦90°, Δd takes a small constant value, and within the range of 0°≦θ≦θ", Δd becomes larger in association with the decrease of θ. However, the structure in which Δd is defined by the curved section 7580 is preferable according to the following reasons. For example, in FIG. 20, in a space where the angle θ, taking the horizontal plane passing through the toner supplying roller 7550 as a reference, is within a range of θ'≦θ≦90° and Δd takes a small constant value, the toner T is shoved into a narrow space due to the rotation of the toner supplying roller 7550, and the inner pressure of the toner T within the space is high. On the other hand, in a curve-shaped space within 0°≦θ≦θ' and in which Δd gradually becomes larger with the decrease of θ, the toner T is gradually relieved from the inner pressure in the wider space, and the toner T becomes free to move. However, if Δd becomes gradually larger, the inner pressure is gradually decreased. Therefore, the toner T is restricted from bursting out at the horizontal plane (θ=0°) with great force in the direction perpendicular to the horizontal plane. Consequently, the movement of the toner T carried by the toner supplying roller 7550 and moving towards the sealing member 7520 is restricted.

Further, in the foregoing embodiment, the tip end of the sealing member 7520 is located above the center of rotation of the toner supplying roller 7550. However, the structure is not limited to the above. For example, the tip end of the sealing member 7520 can be located below the center of rotation of the toner supplying roller 7550. However, the structure in which the tip end of the sealing member 7520 is located above the center of rotation of the toner supplying roller 7550 is preferable in terms that the velocity of the toner T at the horizontal plane in the upward direction from below along the circumference of the toner supplying roller 7550 decreases and the movement of the toner T colliding against the tip end of the sealing member 7520 located above the horizontal plane is effectively restricted.

Further, in the foregoing embodiment, the lowermost point of the abutting position between the sealing member 7520 and the developing roller 7510 is located above the center of rotation of the toner supplying roller 7550. However, the structure is not limited to the above. For example, the lowermost point of the abutting position can be located below the center of rotation of the toner supplying roller 7550. However, when the lowermost point of the abutting position is located above the center of rotation of the toner supplying roller 7550, the velocity of the toner T at the horizontal plane in the upward direction from below along the circumference of the toner supplying roller 7550 decreases. Therefore, the above-mentioned structure is preferable in terms that the movement of the toner T, which collides against the lowermost abutting point having a predetermined width and being located above the horizontal plane and between the sealing member 7520 and the developing roller 7510, is restricted.

Further, in the foregoing embodiment, the sealing member 7520 is made from film. However, the structure is not limited to the above. For example, the sealing member 7520 may be made from a stiff material other than film. However, even if the sealing member 7520 is made from film and the toner T may easily escape outside because the sealing member 7520 is soft, it is possible to effectively prevent the toner T from escaping from the developing device according to the present embodiment because the movement of the toner T towards the sealing member is restricted.

===Outline of the Eighth Embodiment of the Developing Device===

Figure 25:
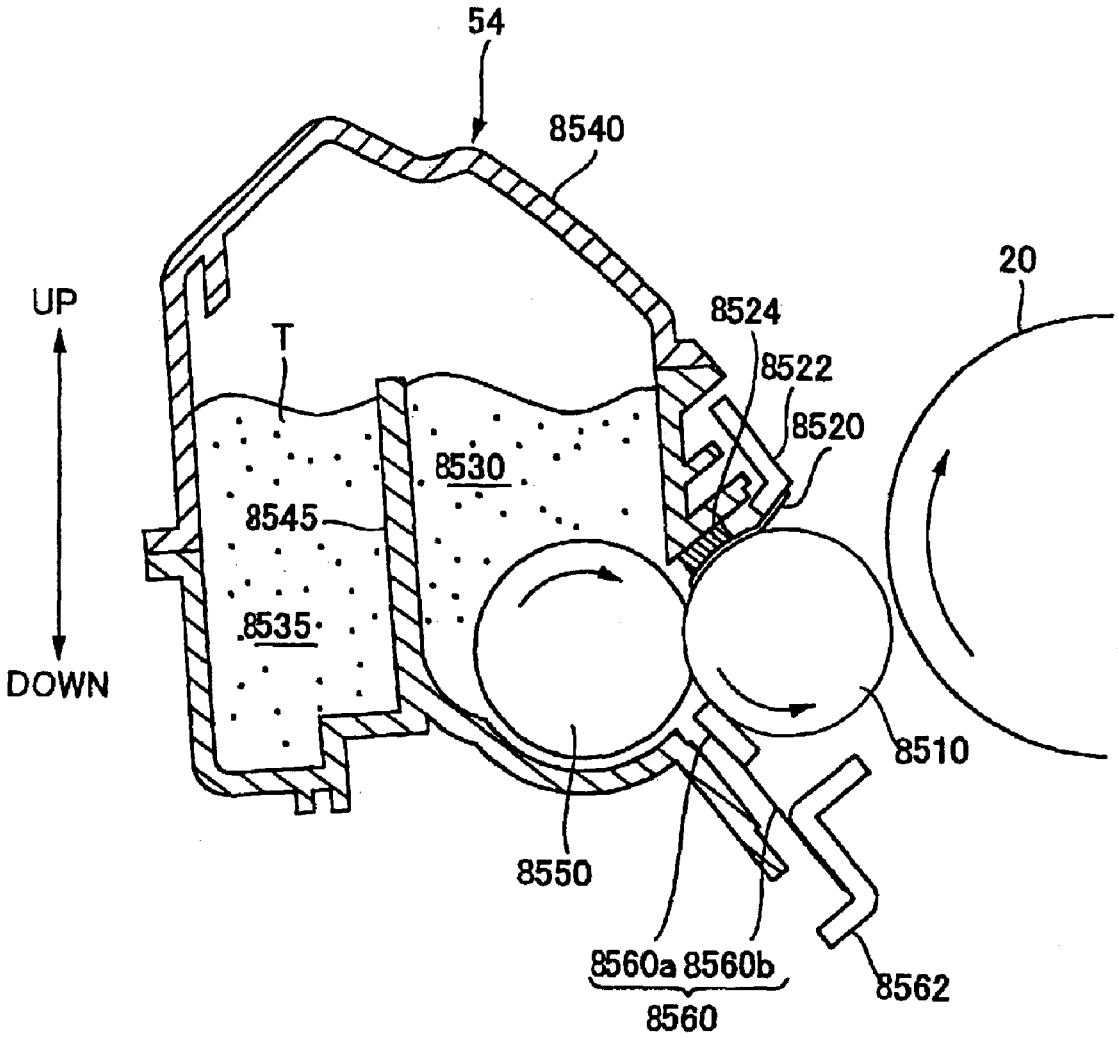
FIG. 25 is a section view showing some main structural components of a developing device according to an eighth embodiment.

Next, with reference to FIG. 25, explanation will be made of an outline of a configuration of the developing device. FIG. 25 is a section view showing some main structural components of the developing device. As in FIG. 1, in FIG. 25, the arrow indicates the vertical directions; for example, the central axis of the developing roller 8510 is located below the central axis of the photoconductor 20. Further, FIG. 25 shows a state in which the yellow developing device 54 is located in the developing position opposing the photoconductor 20.

The YMCK developing device 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made of only the yellow developing device 54.

The yellow developing device 54 comprises, for example: the developing roller 8510, which serves as a developer bearing member; a sealing member 8520; a first container 8530; a second container 8535; a frame 8540; a restriction wall 8545; a toner-supplying roller 8550, which serves as a toner supplying member; a restriction blade 8560, which serves as a thickness restricting member; and a not-shown blade-backing member for urging the restriction blade 8560.

The developing roller 8510 carries toner T and delivers it to a developing position opposing the photoconductor 20. The developing roller 8510 is made from, for example, aluminum, stainless steel, or iron, and the roller 8510 is plated with, for example, nickel plating, chromium plating and the like, as necessary. Further, the developing roller 8510 is rotatable about a central axis. As shown in FIG. 25, in the present embodiment, the roller 8510 rotates in the opposite direction (counterclockwise in FIG. 25) to the rotating direction of the photoconductor 20 (clockwise in FIG. 25). The central axis of the roller 8510 is located below the central axis of the photoconductor 20.

As shown in FIG. 25, in the state where the yellow developing device 54 opposes the photoconductor 20, there exists a gap between the developing roller 8510 and the photoconductor 20. That is, the yellow developing device 54 develops the latent image formed on the photoconductor 20 in a non-contacting state. Note that an alternating field is generated between the developing roller 8510 and the photoconductor 20 upon developing the latent image formed on the photoconductor 20.

The sealing member 8520 is provided to prevent the toner T in the yellow developing device 54 from escaping out from the device as well as collect the toner T, which is on the developing roller 8510 that has passed the developing position, into the developing device without scraping. The sealing member 8520 is a seal made from, for example, polyethylene film and the like. The sealing member 8520 is supported by a seal-supporting metal plate 8522, and is attached to the frame 8540 through the seal-supporting metal plate 8522. On the opposite side of the developing roller 8510 side, the sealing member 8520 is provided with a seal-urging member 8524 made from, for example, Moltoprene and the like. The sealing member 8520 is pressed against the developing roller 8510 by the elastic force of the seal-urging member 8524. Note that the abutting section where the sealing member 8520 abuts against the developing roller 8510 is above a central axis of the developing roller 8510.

The first and second containers 8530, 8535 are sections for receiving (containing) the toner T. A portion of the frame 8540 structures the first and second containers 8530, 8535. The frame 8540 comprises a restriction wall 8545 for restricting the movement of the toner T between the first container 8530 and the second container 8535. The restriction wall 8545 extends upwards from below (in the vertical direction in FIG. 25). The uppermost end of the restriction wall 8545 is located above the uppermost end of the sealing member 8520. A stirring member for stirring the toner T contained in the first and second containers 8530, 8535 may be provided. However, in the present embodiment, each of the developing devices (the black developing device 51, the magenta developing device 52, the cyan developing device 53, and the yellow developing device 54) rotate with the rotation of the YMCK developing device 50, and the toner T contained in each developing device is stirred according to this rotation; thus, the first and second containers 8530, 8535 do not comprise a stirring member.

The toner-supplying roller 8550 is capable of supplying the toner T contained in the first and second containers 8530, 8535 to the developing roller 8510. The toner-supplying roller 8550 is made from, for example, polyurethane foam and the like, and abuts against the developing roller 8510 in an elastically-deformed state. The toner-supplying roller 8550 is arranged at a lower section of the first container 8530. The toner T contained in the first and second containers 8530, 8535 is supplied to the developing roller 8510 by the toner-supplying roller 8550 at the lower section of the first container 8530. The toner-supplying roller 8550 is rotatable about a central axis. The central axis is situated below the central axis of rotation of the developing roller 8510. Further, in the present embodiment, the toner-supplying roller 8550 rotates in the opposite direction (clockwise in FIG. 25) to the rotating direction of the developing roller 8510 (counterclockwise in FIG. 25). Note that, other than the function of supplying the toner T contained in the first and second containers 8530, 8535 to the developing roller 8510, the toner supplying roller 8550 also has the function of stripping the toner remaining on the developing roller 8510 after development off from the developing roller 8510.

The restriction blade 8560, which serves as a thickness restricting member, restricts the thickness of the layer of the toner T bore by the developing roller 8510 and also gives charge to the toner T bore by the developing roller 8510. The restriction blade 8560 comprises a rubber portion 8560*a* and a rubber-supporting portion 8560*b*. The rubber portion 8560*a* is made from, for example, silicone rubber, urethane rubber, and the like. The rubber-supporting portion 8560*b* is a thin plate made from, for example, phosphor bronze, stainless steel, and the like having a springy characteristic. The rubber portion 8560*a* is supported by the rubber-supporting portion 8560*b*. The rubber-supporting portion 8560*b* is attached to the frame 8540 through a pair of blade-supporting metal plates 8562, in a way such that one end of the rubber-supporting portion 8560*b* is pinched between the blade-supporting metal plates 8562. On the opposite side of the side at which the developing roller 8510 is located, the restriction blade 8560 is provided with a not-shown blade-backing member made from Moltoprene and the like.

The rubber portion 8560*a* is pressed against the developing roller 8510 by the elastic force caused by bending of the rubber-supporting portion 8560*b*. Further, the not-shown blade-backing member prevents toner from entering between the rubber-supporting portion 8560*b* and the frame 8540, stabilizes the elastic force caused by bending of the rubber-supporting portion 8560*b*, and also urges the rubber portion 8560*a* from the back thereof towards the developing roller 8510 to press the rubber portion 8560*a* against the developing roller 8510. Thus, the not-shown blade-backing member can make the rubber portion 8560*a* abut against the developing roller 8510 more evenly.

The other end of the restricting blade 8560 that is not being supported by the blade-supporting metal plates 8562 (i.e., the tip end of the restriction blade 8560) does not contact the developing roller 8510; rather, a section at a predetermined distance from the tip end contacts, with some breadth, the developing roller 8510. In other words, the restriction blade 8560 does not abut against the developing roller 8510 with its end, but abuts against the roller 8510 near its central portion. Further, the restriction blade 8560 is arranged so that its tip end faces towards the upper stream of the rotating direction of the developing roller 8510, and thus, makes a so-called counter-contact with respect to the roller 8510. Note that the abutting position where the restriction blade 8560 abuts against the developing roller 8510 is below the central axis of the developing roller 8510 and also below the central axis of the toner supplying roller 8550.

The frame 8540 is manufactured by joining a plurality of integrally-molded frames (for example, an upper frame, a bottom frame, and the like). The frame 8540 has an opening at its lower section. The developing roller 8510 is arranged at the opening in a state in which a portion of the roller 8510 is exposed outside.

In the yellow developing device 54 thus structured, as the toner-supplying roller 8550 rotates, it supplies the toner T contained in the first and second containers 8530, 8535 to the developing roller 8510. Having been supplied to the developing roller 8510, with the rotation of the developing roller 8510, the toner T reaches the abutting position of the restriction blade 8560; and, as the toner T passes the abutting position, the toner is charged and its thickness is restricted. Having its thickness being restricted, with further rotation of the developing roller 8510, the toner T on the developing roller 8510 reaches the developing position opposing the photoconductor 20; then, under the alternating field, the toner T is used for developing the latent image formed on the photoconductor 20 at the developing position. Having passed the developing position, with further rotation of the developing roller 8510, the toner T on the developing roller 8510 passes the sealing member 8520 and is collected into the developing device by the sealing member 8520 without being scraped off.

<Sealing Characteristic of the Toner>

Figure 26A:
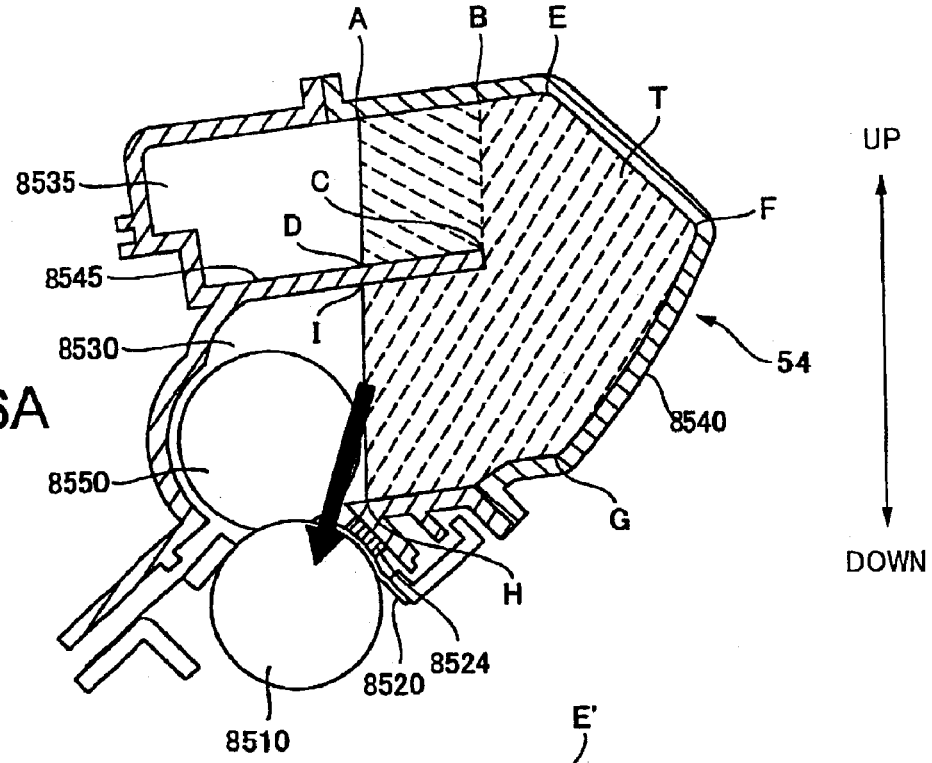
FIG. 26A is a diagram showing how toner flows in a developing device in an image-forming apparatus of the present embodiment.
Figure 26B:
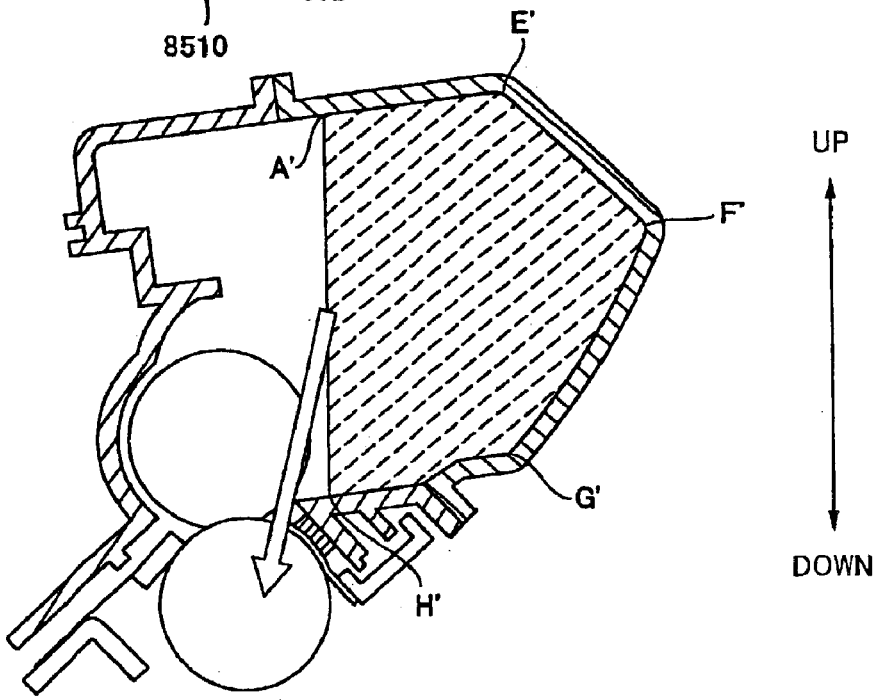
FIG. 26B is a diagram showing how toner T flows in a developing device in which the uppermost end of a restriction wall is located below the center of rotation of a developing roller when in the developing position.

With reference to FIG. 26A and FIG. 26B, explanation will be made of an influence that the structure of the restriction wall 8545 has upon the sealing characteristic of the toner T. FIG. 26A is a diagram showing how toner T flows towards the sealing member 8520 in a developing device in an image-forming apparatus of the present embodiment. FIG. 26B is a diagram showing how toner T flows towards the sealing member 8520 in a developing device in which the uppermost end of the restriction wall 8545 is located below the center of rotation of the developing roller 8510 when in the developing position.

FIG. 26A shows the yellow developing device 54 in the image-forming apparatus of the present embodiment in a state where it has been rotated 270° from the developing position in the counterclockwise direction. Further, in the figure, it is assumed that the toner T has not moved since the state where the yellow developing device 54 was rotated 180° from the developing position. Among the toner T indicated within a section AEFGH in FIG. 26A, the toner T indicated within a section ABCD in the second container 8535 is retained by the restriction wall 8545; therefore, the toner indicated within the section ABCD does not flow over to the first container 8530. The toner T indicated within a section BEFGHIC flows into the first container 8530 passing across a gap HI in the first container 8530.

FIG. 26B shows a developing device, in which the uppermost end of the restriction wall 8545 is located below the center of rotation of the developing roller 8510 when in the developing position, in a state where it has been rotated 270° from the developing position in the counterclockwise direction. Further, in the figure, it is assumed that the toner T has not moved since the state where the developing device was rotated 180° from the developing position. In FIG. 26B, there is a possibility that all of the toner T within the section A'E'F'G'H' will flow into the first container 8530, and the toner will not pass across the narrow gap HI as in FIG. 26A.

The arrows shown in FIG. 26A and FIG. 26B schematically show the speed at which the toner T flows towards the sealing member 8520. In FIG. 26A, the toner T, which is smaller in amount than the toner of FIG. 26B by the amount indicated by the section ABCD, will flow through the gap HI which is narrower than the gap H'A'; therefore, the speed at which the toner T flows towards the sealing member 8520 in the device of FIG. 26A is slower than that of FIG. 26B.

From the above, it can be stated that the sealing member 8520 and the elastic member 8524 in FIG. 26A is subjected to a smaller pressure by the toner T, compared to the members 8520, 8524 in FIG. 26B. Therefore, the escaping of toner T from the sealing member 8520 and the elastic member 8524 is further restricted in the developing device in the image-forming apparatus of the present embodiment, compared to the developing device in which the uppermost end of the restriction wall 8545 is located below the center of rotation of the developing roller 8510 when in the developing position.

FIG. 26B shows a developing device in which the uppermost end of the restriction wall 8545 is located below the center of rotation of the developing roller 8510 when in the developing position. However, the escaping of toner T from the sealing member 8520 and the elastic member 8524 is further restricted in the developing device in the image-forming apparatus of the present embodiment, even when compared with a developing device in which the uppermost end of the restriction wall 8545 is located, for example, below the tip end of the sealing member 8520.

Second Example

Figure 27:
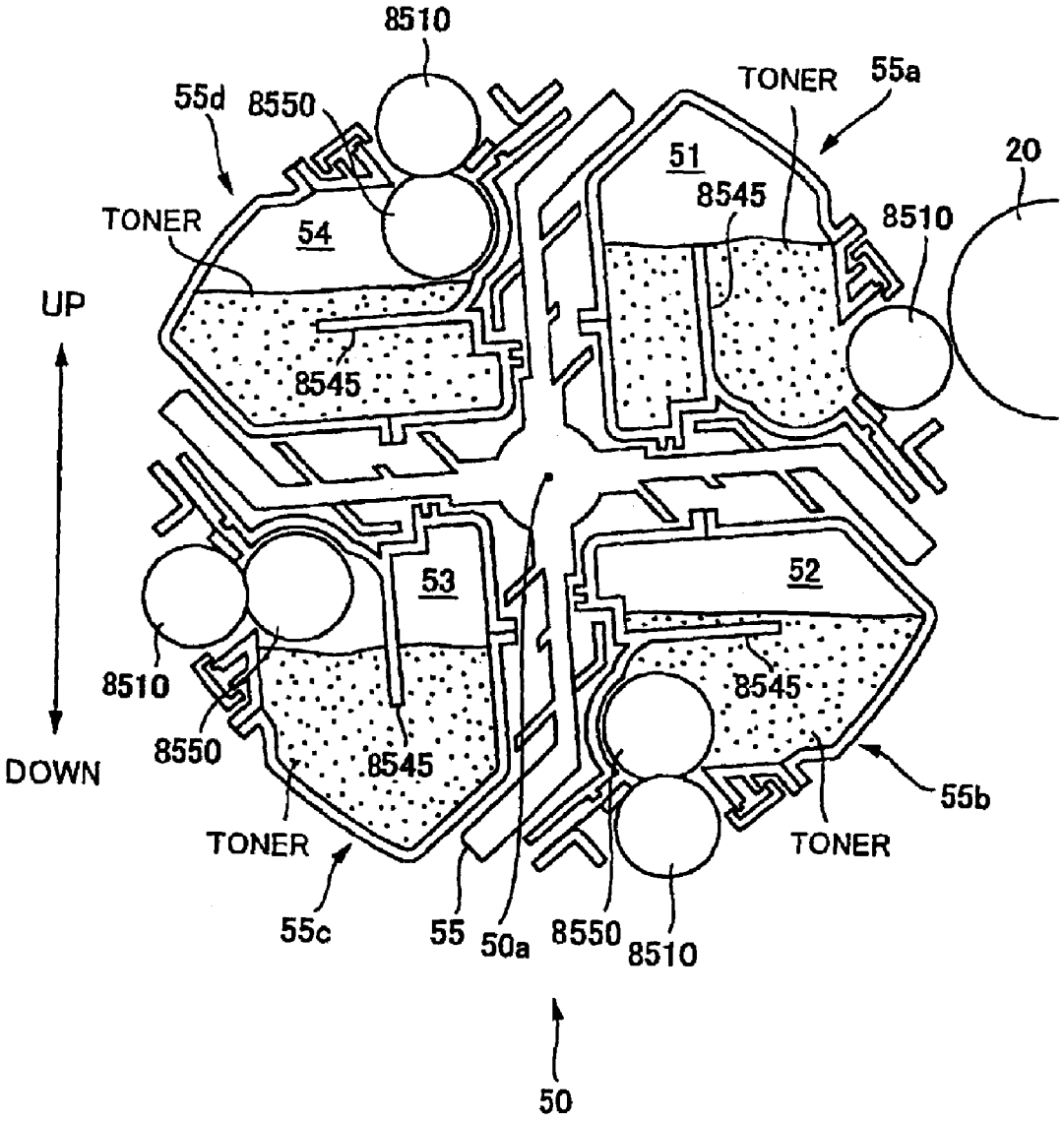
FIG. 27 is a diagram showing some main structural components of a YMCK developing device according to another example.

If the developing roller 8510 of the black developing device 51 comprises a magnet roller (not shown) inside and the toner T is attracted onto the surface of the developing roller 8510 by the magnetic force of the magnet roller, a toner supplying roller 8550 can be omitted from the black developing device 51 as shown in FIG. 27. In an image-forming apparatus comprising such a black developing device 51, since the flow of toner T towards the sealing member 8520 and the elastic member 8524 is restricted by the restriction wall 8545, escaping of the toner T from the sealing member 8520 and the elastic member 8524 can further be reduced.

Other Examples

In the foregoing embodiment, the uppermost end of he restriction wall 8545 is located above an abutting section where the sealing member 8520 abuts against the developing roller 8510. However, the structure is not limited to the above. For example, the uppermost end of the restriction wall 8545 may be located above the tip end of the sealing member 8520 and below the abutting section. However, if the uppermost end of he restriction wall 8545 is located above the abutting section where the sealing member 8520 abuts against the developing roller 8510, the toner is prevented from pressurizing the abutting section where the sealing member 8520 abuts against the developing roller 8510, because the toner T contained in the second container 8535 will be retained by the restriction wall 8545, even when the developing device is rotated by the YMCK developing device 50, and the first container 8530, the restriction wall 8545, and the second container 8535 are arranged in this order in the vertical upward direction.

Further, in the foregoing embodiment, the uppermost end of the restriction wall 8545 is located above the elastic member 8524. However, the structure is not limited to the above. For example, the uppermost end of the restriction wall 8545 may be located above the abutting section where the sealing member 8520 abuts against the developing roller 8510 and below the elastic member 8524. However, if the uppermost end of the restriction wall 8545 is located above the elastic member 8524, the toner is prevented from pressurizing the elastic member 8524 which urges the sealing member 8520, because the toner T contained in the second container 8535 will be retained by the restriction wall 8545, even in a state where the developing device is rotated by the YMCK developing device 50, and the first container 8530, the restriction wall 8545, and the second container 8535 are arranged in this order in the vertical upward direction.

Further, in the foregoing embodiment, the uppermost end of the restriction wall 8545 is located above the upper end of the sealing member 8520. However, the structure is not limited to the above. For example, the uppermost end of the restriction wall 8545 may be located above the elastic member 8524 and below an uppermost end of the sealing member 8520. However, if the uppermost end of the restriction wall 8545 is located above the upper end of the sealing member 8520, the toner is prevented from pressurizing the uppermost end of the sealing member 8520, because the toner T contained in the second container 8535 will be retained by the restriction wall 8545, even in a state where the developing device in the image-forming apparatus is rotated by the YMCK developing device 50, and the first container 8530, the restriction wall 8545, and the second container 8535 are arranged in this order in the vertical upward direction.

Further, in the foregoing embodiment, when the developing device is rotated by the YMCK developing device 50, the toner T contained in the second container 8535 is able to go across the restriction wall 8545 and move to the first container 8530. However, the structure is not limited to the above. For example, the toner T may be moved across the restriction wall 8545 using a stirring member. However, in a case where the toner T is able to go across the restriction wall 8545 and move to the first container 8530, even when the developing device is rotated by the YMCK developing device 50, and the first container 8530, the restriction wall 8545, and the second container 8535 are arranged in this order in the vertical upward direction, and some of the toner T can go over the restriction wall 8545 and move from the second container 8535 to the first container 8530, the toner T contained in the second container 8535 is effectively prevented from pressurizing the sealing member 8520 because the restriction wall 8545 is high.

Further, in the foregoing embodiment, in a state where the developing device has been rotated by the YMCK developing device 50 and is located at a position opposing the photoconductor 20, the second container 8535, the restriction wall 8545, and the developing roller 8510 are arranged in this order in the horizontal direction. However, the structure is not limited to the above. However, if the second container 8535, the restriction wall 8545, and the developing roller 8510 are arranged in this order, even when the developing device is rotated by the YMCK developing device 50, and the first container 8530, the restriction wall 8545, and the second container 8535 are arranged in this order in the vertical upward direction, and some of the toner T can go over the restriction wall 8545 and move from the second container 8535 to the first container 8530, the toner T contained in the second container 8535 is effectively prevented from pressurizing the sealing member 8520 because the restriction wall 8545 exists between the second container 8535 and the developing roller 8510.

Further, in the foregoing embodiment, the tip end of the sealing member 8520 is located above a center of rotation of the developing roller 8510. However, the structure is not limited to the above. For example, the tip end of the sealing member 8520 may be located below the center of rotation of the developing roller 8510.

Further, in the foregoing embodiment, the sealing member 8520 is a film. However, the structure is not limited to the above. For example, the sealing member 8520 may be made from a stiff material other than film. However, even if the sealing member 8520 is made from film and the toner T pressurizing the sealing member 8520 may easily escape outside because the sealing member 8520 is soft, it is possible to effectively prevent the toner T from escaping from the developing device because the toner T is restricted from pressurizing the sealing member 8520 by the restriction wall 8545.

===Others===

Above, explanation was made of an image-forming apparatus, a developing device, etc. according to the present invention based on various embodiments. However, the above-mentioned embodiments of the invention are merely examples for facilitating understanding of the present invention, and are not to limit the scope of the present invention. It is without saying that the present invention may be altered and/or modified without departing from the scope thereof, and that the present invention includes its equivalents.

In the above-explained embodiment, explanation was made of a full-color laser-beam printer of the intermediate-transferring type as an example of an image-forming apparatus. However, the present invention is applicable to various image-forming apparatuses such as full-color laser-beam printers other than the intermediate-transferring type, single-color laser-beam printers, photocopiers, facsimile machines, and the like.

Further, in the above-explained embodiment, explanation was made of a printer comprising a rotary-type developing device in which the YMCK developing device rotates and each of the developing devices selectively oppose the photoconductor. However, the printer is not limited to such a structure; a structure in which the developing devices are arranged in parallel and are slidable can be adopted.

Further, the photoconductor does not have to be limited to the so-called photoconductive roller structured by providing a photoconductive layer on the outer peripheral surface of a cylindrical, conductive base; it can be a so-called photoconductive belt structured by providing a photoconductive layer on a surface of a belt-like conductive base.

Further, in the above-mentioned embodiment, explanation was made of an example where the developing devices are provided in four colors: black, magenta, cyan, and yellow. However, the number of developing devices does not have to be limited to four, but the number can be either larger or smaller.

===Structure of Computer System Etc.===

Next, with reference to the drawings, explanation will be made of a computer system, a computer program, and a storage medium having a computer program recorded thereon, which are an example of an embodiment of the present invention.

Figure 28:
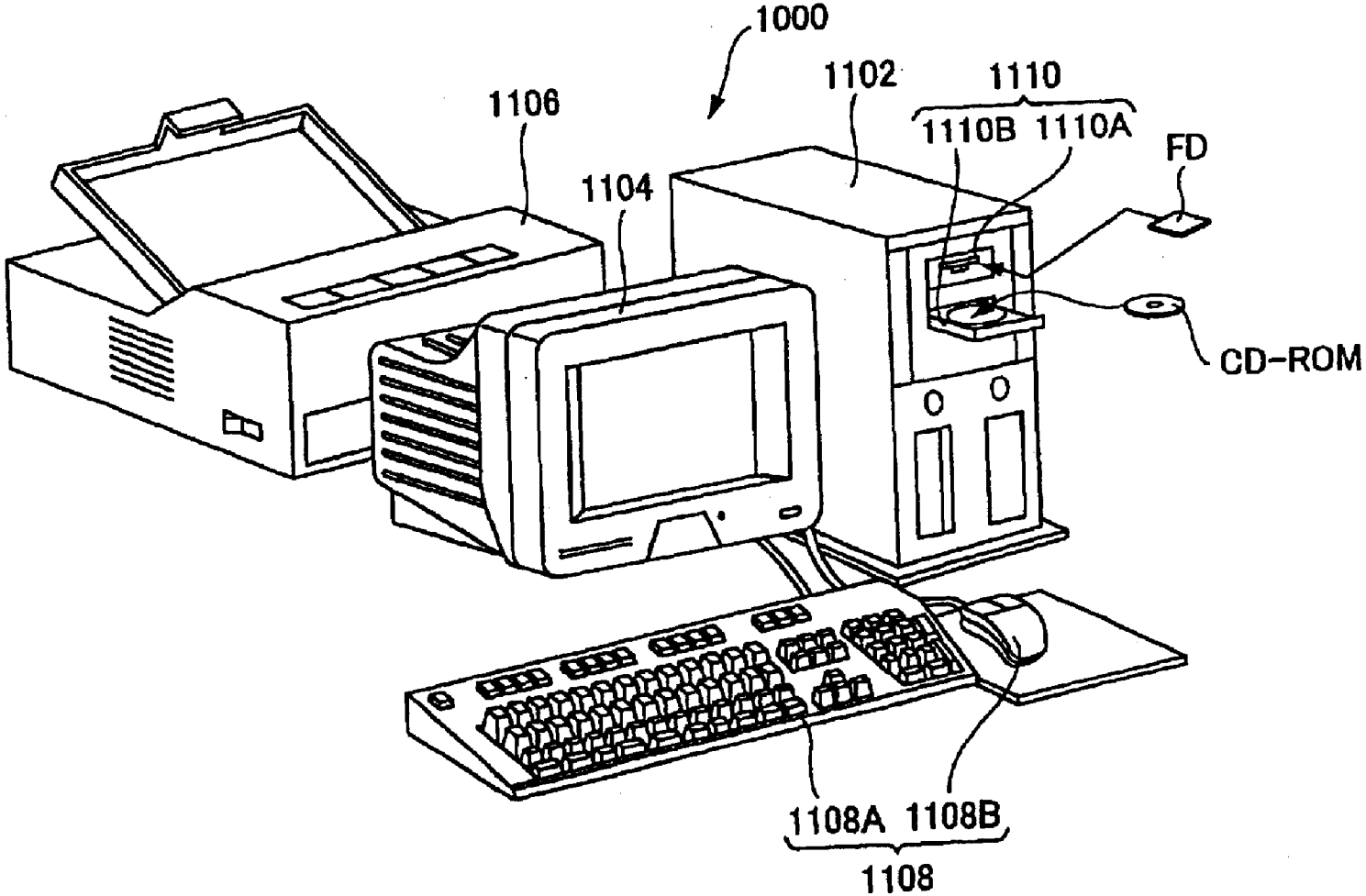
FIG. 28 is a diagram showing an external structure of a computer system.

FIG. 28 is an explanatory diagram illustrating the external structure of a computer system. The computer system 1000 includes: a computer 1102; a display device 1104; a printer 1106; an input device 1108; and a reading device 1110. In the present embodiment, the computer 1102 is housed in a casing such as a mini-tower; however the structure is not limited to this example. Although a CRT (cathode ray tube), a plasma display, or a liquid crystal display is generally used for the display device 1104, any other kind of device can be used. The printer explained above is used for the printer 1106. In the present embodiment, a keyboard 1108A and a mouse 1108B are used for the input device 1108; however, any other kind of device can be used. In the present embodiment, a flexible disk drive 1110A and a CD-ROM drive device 1110B are used for the reading device 1110; however, it is also possible to use an MO (magneto-optical) disk drive, a DVD (digital versatile disk) drive, or any other kinds of devices.

Figure 29:
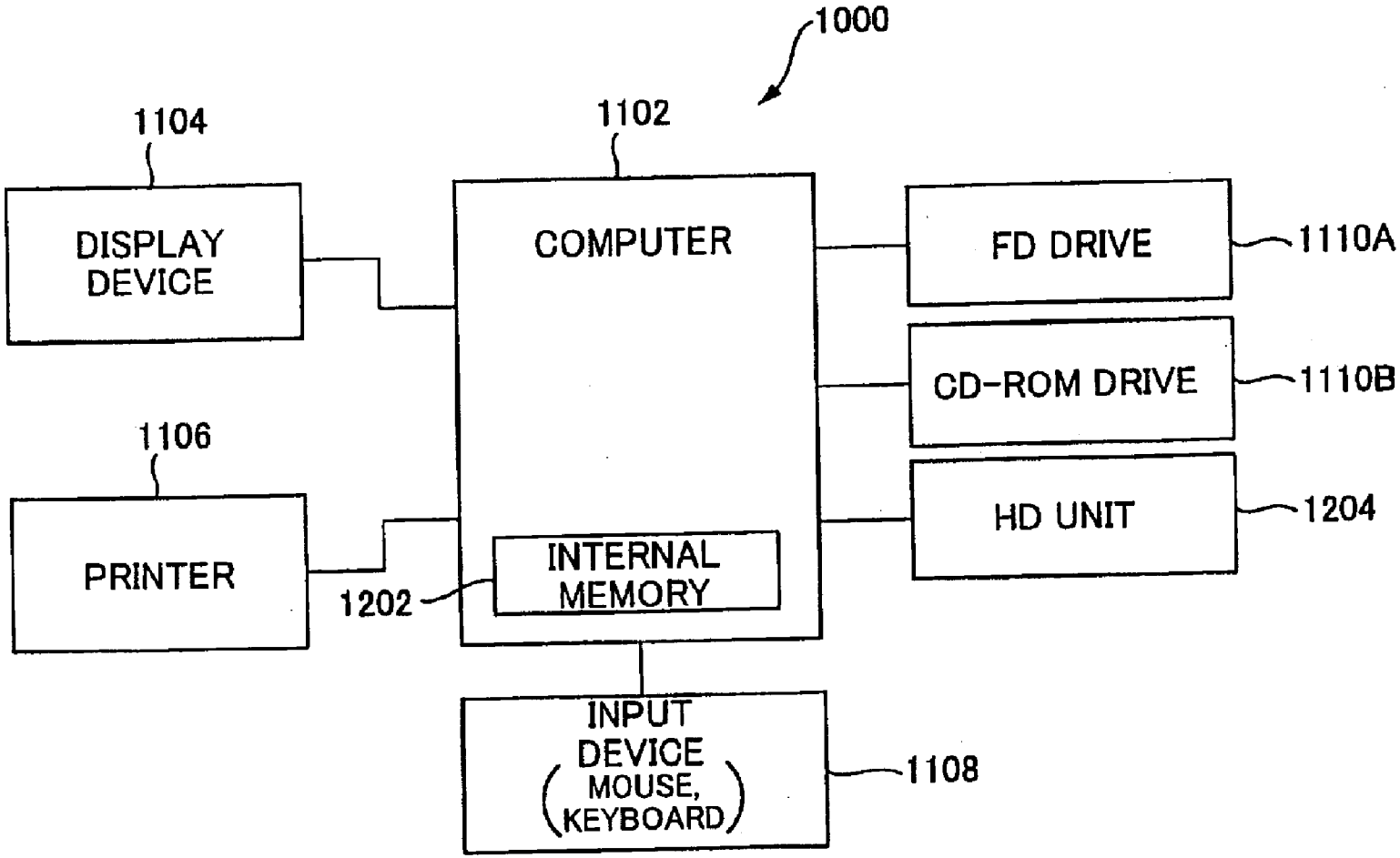
FIG. 29 is a block diagram showing the structure of the computer system shown in FIG. 28.
Figure 30:
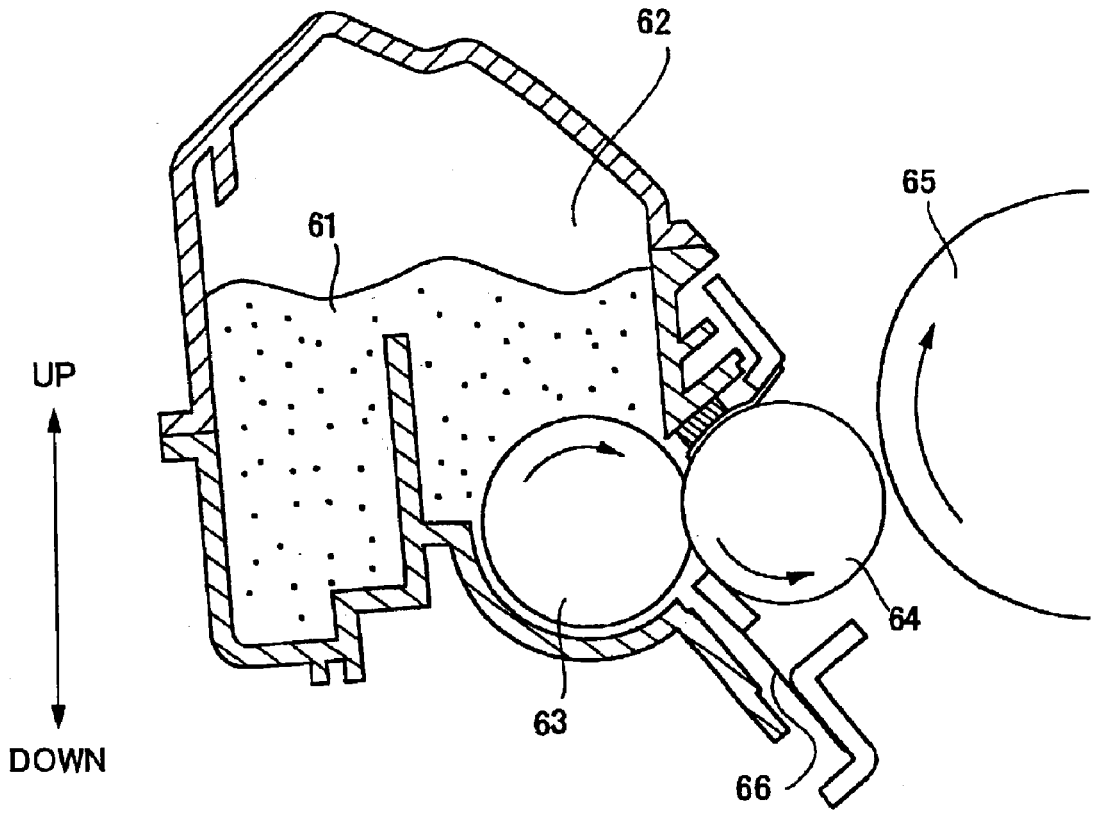
FIG. 30 is a diagram showing an example of a developing device.

FIG. 29 is a block diagram illustrating the configuration of the computer system 1000 shown in FIG. 28. FIG. 29 shows that an internal memory 1202, such as a RAM (random access memory), is provided inside the casing in which the computer 1102 is housed, and an external memory, such as a hard-disk drive unit 1204, is also provided.

In the above example, the printer 1106 is connected to the computer 1102, the display device 1104, the input device 1108, and the reading device 1110 to configure the computer system. However, the configuration is not limited to the above. For example, the computer system may be configured comprising only the computer 1102 and the printer 1106, and it does not necessarily have to comprise the display device 1104, the input device 1108, and the reading device 1110.

Further, it is also possible for the printer 1106 to comprise some of the functions or structures of the computer unit 1102, the display device 1104, the input devices 1108, and the reading device 1110. For example, it is possible to structure the printer 1106 so that is comprises an image processor for image processing, a display section for performing various kinds of displaying, and a recording media mounting section for detachably mounting a recording medium on which image data captured with a digital camera or the like are stored.

A computer system configured as above will be superior to existing computer systems as a whole.

According to the above and other embodiments of the present invention, it is possible to provide:

a developing device, an image-forming apparatus and a computer system, which are capable of stabilizing supplying of a developer to an abutting section where a developer bearing member and a developer supplying member abut against each other;

a developing unit, an image-forming apparatus, and a computer system, which are capable of preventing a developer from escaping;

a developing unit, an image-forming apparatus and a computer system, which are capable of stabilizing supplying of a developer to an abutting section where a developer supplying member abuts against a developer bearing member;

a developing device, an image-forming apparatus, and a computer system, which are capable of preventing escaping of a developer and stabilizing supplying of the developer to an abutting section (nip) where a developer bearing member and a developer supplying member abut against each other;

a developing device in which a developer supplying member can stably supply a developer to a developer bearing member, an image-forming apparatus comprising such a developing device, and a computer system;

a developing device that is capable of preventing escaping of a developer, an image-forming apparatus comprising such a developing device, and a computer system; and an image-forming apparatus and a computer system, which are capable of preventing escaping of a developer.

What is claimed is:

1. A developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at an abutting section, and is capable of supplying said developer to said developer bearing member;

a flow-path restricting member that is capable of restricting a flow path of said developer contained in said developer container, said flow path leading from right above said abutting section through said abutting section; and an electrical charging member that is capable of abutting against said developer bearing member and charging said developer that has passed said abutting section;

wherein said electrical charging member and said flow-path restricting member are different components.

2. A developing device according to claim 1, wherein said flow-path restricting member extends in a direction from said developer bearing member to said developer supplying member, and a gap exists between a tip end of said flow-path restricting member and said developer supplying member.

3. A developing device according to claim 2, wherein the tip end of said flow-path restricting member is located between said abutting section and a center of rotation of said developer supplying member in a horizontal direction.

4. A developing device according to claim 1, wherein said flow-path restricting member is a part of a frame that structures said developer container.

5. A developing device according to claim 1, wherein by rotating, said developer supplying member is capable of carrying said developer from above said abutting section towards said abutting section.

6. A developing device according to claim 5, wherein the rotating direction of said developer bearing member and the rotating direction of said developer supplying member are opposite to each other.

7. A developing device according to claim 2, wherein a sealing member that is capable of abutting against said developer bearing member and preventing said developer from escaping from said developer container is provided above the tip end of said flow-path restricting member and on the developer bearing member side.

8. A developing device comprising:

a developer container for containing developer;

a developer bearing member that is provided at a lower section of said developer container and is capable of bearing and carrying said developer; and a developer supplying member that is provided at the lower section of said developer container, is capable of abutting against said developer bearing member at an abutting section, and is capable of supplying said developer to said developer bearing member;

a flow-path restricting member that is capable of restricting a flow path of said developer contained in said developer container, said flow path leading from right above said abutting section through said abutting section; and an electrical charging member that is capable of abutting against said developer bearing member and charging said developer that has passed said abutting section;

wherein:

said electrical charging member and said flow-path restricting member are different components, said flow-path restricting member extends in a direction from said developer bearing member to said developer supplying member, a gap exists between a tip end of said flow-path restricting member and said developer supplying member, the tip end of said flow-path restricting member is located between said abutting section and a center of rotation of said developer supplying member in a horizontal direction, said flow-path restricting member is a part of a frame that structures said developer container, by rotating, said developer supplying member is capable of carrying said developer from above said abutting section towards said abutting section, the rotating direction of said developer bearing member and the rotating direction of said developer supplying member are opposite to each other, a sealing member that is capable of abutting against said developer bearing member and preventing said developer from escaping from said developer container is provided above the tip end of said flow-path restricting member and on the developer bearing member side.

9. An image-forming apparatus comprising a developing device, said developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at an abutting section, and is capable of supplying said developer to said developer bearing member; and a flow-path restricting member that is capable of restricting a flow path of said developer contained in said developer container, said flow path leading from right above said abutting section through said abutting section; and an electrical charging member that is capable of abutting against said developer bearing member and charging said developer that has passed said abutting section;

wherein said electrical charging member and said flow-path restricting member are different components.

10. A computer system comprising:

a computer;

a display device that can be connected to said computer; and an image-forming apparatus that can be connected to said computer and comprises a developing device, said developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at an abutting section, and is capable of supplying said developer to said developer bearing member; and a flow-path restricting member that is capable of restricting a flow path of said developer contained in said developer container, said flow path leading from right above said abutting section through said abutting section; and an electrical charging member that is capable of abutting against said developer that has passed said abutting section;

wherein said electrical charging member and said flow-path restricting member are different components.

11. A developing unit comprising:

a developer container for containing developer;

a developer bearing member for bearing and carrying said developer contained in said developer container; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts at an abutting section against an upper section of said developer bearing member from above said developer bearing member, and said developing unit comprises a wall portion that extends from above to a position located beyond an upper end of said abutting section.

12. A developing unit according to claim 11, wherein said wall portion intersects the radial direction of said rotating member.

13. A developing unit according to claim 11, wherein in a state where said developing unit is located at said developing position, said wall portion extends along a substantially vertical direction.

14. A developing unit according to claim 11, wherein in a state where said developing unit is located at said developing position, said developing unit comprises a second wall portion that extends upwards in an oblique direction from a lower end of said wall portion, and said sealing member is provided beneath said second wall portion.

15. A developing unit according to claim 11, wherein said developing unit comprises a developer supplying member being capable of abutting against said developer bearing member at said abutting section and supplying said developer to said developer bearing member, and in a state where said developing unit is located at said developing position, said wall portion is provided above said developer supplying member, and the lower end of said wall portion is located below a line that passes through an uppermost section of said developer bearing member and an uppermost section of said developer supplying member.

16. A developing unit according to claim 15, wherein a gap exists between said lower end of said wall portion and said developer supplying member.

17. A developing unit according to claim 11, wherein said wall portion is a part of a frame that structures said developer container.

18. A developing unit comprising:

a developer container for containing developer;

a developer bearing member for bearing and carrying said developer contained in said developer container; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position:

said sealing member abuts at an abutting section against an upper section of said developer bearing member from above said developer bearing member;

said developing unit comprises a wall portion that extends from above to a position located beyond an upper end of said abutting section;

said wall portion extends along a substantially vertical direction;

said developing unit comprises a second wall portion that extends upwards in an oblique direction from a lower end of said wall portion;

said sealing member is provided beneath said second wall portion;

said developing unit comprises a developer supplying member being capable of abutting against said developer bearing member at said abutting section and supplying said developer to said developer bearing member;

the lower end of said wall portion is located below a line that passes through an uppermost section of said developer bearing member and an uppermost section of said developer supplying member;

a gap exists between said lower end of said wall portion and said developer supplying member; and said wall portion is a part of a frame that structures said developer container.

19. A developing unit comprising:

a developer container for containing developer;

a developer bearing member for bearing and carrying said developer contained in said developer container; and a thickness restricting member for restricting a thickness of a layer of said developer borne by said developer bearing member, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position:

said thickness restricting member abuts at an abutting section against an upper section of said developer bearing member from above said developer bearing member, and said developing unit comprises a wall portion that extends from above to a position located beyond an upper end of said abutting section.

20. An image-forming apparatus comprising a developing unit, said developing unit comprising:

a developer container for containing developer;

a developer bearing member for bearing and carrying said developer contained in said developer container; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts at an abutting section against an upper section of said developer bearing member from above said developer bearing member, and said developing unit comprises a wall portion that extends from above to a position located beyond an upper end of said abutting section.

21. A computer system comprising:

a computer;

a display device that can be connected to said computer; and an image-forming apparatus that can be connected to said computer and comprises a developing unit, said developing unit comprising:

a developer container for containing developer;

a developer bearing member for bearing and carrying said developer contained in said developer container; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts at an abutting section against an upper section of said developer bearing member from above said developer bearing member, and said developing unit comprises a wall portion that extends from above to a position located beyond an upper end of said abutting section.

22. A developing unit, comprising:

a developer container for containing developer;

a developer bearing member for bearing and carrying said developer; and a developer supplying member being capable of abutting against said developer bearing member at an abutting section and supplying said developer contained in said developer container to said developer bearing member, said developing unit being capable of:

being attached to a rotating member having a plurality of unit attaching sections, being rotated by said rotating member, and developing a latent image at a developing position, said latent image being formed on a photoconductor, wherein, in a state where said developing unit is located at said developing position:

a wall portion having a predetermined length in the vertical direction is provided above said developer supplying member and on the developer supplying member side of said abutting section, and a lower end of said wall portion is located below a line that passes through an uppermost section of said developer bearing member and an upper most section of said developer supplying member.

23. A developing unit according to claim 22, wherein said wall portion intersects the radial direction of said rotating member.

24. A developing unit according to claim 22, wherein in a state where said developing unit is located at said developing position, said wall portion extends along a substantially vertical direction.

25. A developing unit according to claim 22, wherein in a state where said developing unit is located at said developing position, said wall portion is provided between said abutting section and a center of rotation of said developer supplying member in a horizontal direction.

26. A developing unit according to claim 22, wherein a gap exists between the lower end of said wall portion and said developer supplying member.

27. A developing unit according to claim 22, wherein in a state where said developing unit is located at said developing position, said developing unit comprises a second wall portion that extends upwards in an oblique direction from the lower end of said wall portion towards said developer bearing member.

28. A developing unit according to claim 22, wherein said wall portion is a part of a frame that structures said developer container.

29. A developing unit, comprising:

a developer container for containing developer;

a developer bearing member for bearing and carrying said developer; and a developer supplying member being capable of abutting against said developer bearing member at an abutting section and supplying said developer contained in said developer container to said developer bearing member, said developing unit being capable of:

being attached to a rotating member having a plurality of unit attaching sections, being rotated by said rotating member, and developing a latent image at a developing position, said latent image being formed on a photoconductor, wherein, in a state where said developing unit is located at said developing position:

a wall portion having a predetermined length in the vertical direction is provided above said developer supplying member and on the developer supplying member side of said abutting section;

said wall portion extends along a substantially vertical direction;

said wall portion is provided between said abutting section and a center of rotation of said developer supplying member in a horizontal direction;

a lower end of said wall portion is located below a line that passes through an uppermost section of said developer bearing member and an uppermost section of said developer supplying member;

a gap exists between the lower end of said wall portion and said developer supplying member;

said developing unit comprises a second wall portion that extends upwards in an oblique direction from the lower end of said wall portion towards said developer bearing member; and said wall portion is a part of a frame that structures said developer container.

30. An image-forming apparatus comprising a developing unit, said developing unit comprising:

a developer container for containing developer;

a developer bearing member for bearing and carrying said developer; and a developer supplying member being capable of abutting against said developer bearing member at an abutting section and supplying said developer contained in said developer container to said developer bearing member, said developing unit being capable of:

being attached to a rotating member having a plurality of unit attaching sections, being rotated by said rotating member, and developing a latent image at a developing position, said latent image being formed on a photoconductor, wherein, in a state where said developing unit is located at said developing position:

a wall portion having a predetermined length in the vertical direction is provided above said developer supplying member and on the developer supplying member side of said abutting section, and a lower end of said wall portion is located below a line that passes through an uppermost section of said developer bearing member and an uppermost section of said developer supplying member.

31. A computer system comprising:

a computer;

a display device that can be connected to said computer; and an image-forming apparatus that can be connected to said computer and comprises a developing unit, said developing unit comprising:

a developer container for containing developer;

a developer bearing member for bearing and carrying said developer; and a developer supplying member being capable of abutting against said developer bearing member at an abutting section and supplying said developer contained in said developer container to said developer bearing member, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position:

a wall portion having a predetermined length in the vertical direction is provided above said developer supplying member and on the developer supplying member side of said abutting section, and a lower end of said wall portion is located below a line that passes through an uppermost section of said developer bearing member and an uppermost section of said developer supplying member.

32. A developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at a first abutting section, and is capable of supplying said developer to said developer bearing member;

a sealing member that is capable of abutting against an upper section of said developer bearing member at a second abutting section and preventing said developer from escaping from said developer container; and a flow-path restricting member that is capable of restricting a flow path of said developer contained in said developer container and comprises a first wall portion that covers an area above said first abutting section, and a second wall portion that extends from above to a position located beyond an upper end of said second abutting section.

33. A developing device according to claim 32, wherein said flow-path restricting member is capable of restricting a flow path of said developer contained in said developer container that leads from right above said first abutting section to said first abutting section.

34. A developing device according to claim 32, wherein a tip end of said flow-path restricting member is formed by a lower end of said first wall portion and a lower end of said second wall portion, and a gap exists between said tip end and said developer supplying member.

35. A developing device according to claim 34, wherein said tip end is located below a line that passes through an uppermost section of said developer bearing member and an uppermost section of said developer supplying member.

36. A developing device according to claim 34, wherein said first wall portion is formed extending upwards in an oblique direction from said tip end towards said developer bearing member.

37. A developing device according to claim 34, wherein a tip end of said flow-path restricting member is formed by a lower end of said first wall portion and a lower end of said second wall portion, said first wall portion and said second wall portion form an acute angle, and a space for storing said developer is provided between said first wall portion and said developer bearing member.

38. A developing device according to claim 37, wherein said tip end of said flow-path restricting member is located between said first abutting section and a center of rotation of said developer supplying member in a horizontal direction.

39. A developing device according to claim 32, wherein said flow-path restricting member is a part of a frame that structures said developer container.

40. A developing device according to claim 32, wherein by rotating, said developer supplying member is capable of carrying said developer from above said first abutting section towards said first abutting section.

41. A developing device according to claim 32, wherein the rotating direction of said developer bearing member and the rotating direction of said developer supplying member are opposite to each other.

42. A developing device according to claim 32, wherein said flow-path restricting member is provided on the developer supplying member side of said sealing member.

43. A developing device according to claim 32, wherein said developing device is capable of being attached to a rotating member having a plurality of unit attaching sections, being rotated by said rotating member, and developing a latent image at a developing position, said latent image being formed on a photoconductor.

44. A developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at a first abutting section, and is capable of supplying said developer to said developer bearing member;

a sealing member that is capable of abutting against an upper section of said developer bearing member at a second abutting section and preventing said developer from escaping from said developer container; and a flow-path restricting member that is capable of restricting a flow path of said developer contained in said developer container and comprises a first wall portion that covers an area above said first abutting section, and a second wall portion that extends from above to a position located beyond an upper end of said second abutting section, wherein, said flow-path restricting member is capable of restricting a flow path of said developer contained in said developer container that leads from right above said first abutting section to said first abutting section;

a tip end of said flow-path restricting member is formed by a lower end of said first wall portion and a lower end of said second wall portion;

a gap exists between said tip end and said developer supplying member;

said tip end is located below a line that passes through an uppermost section of said developer bearing member and an uppermost section of said developer supplying member;

said first wall portion is formed extending upwards in an oblique direction from said tip end towards said developer bearing member;

said first wall portion and said second wall portion form an acute angle;

said tip end of said flow-path restricting member is located between said first abutting section and a center of rotation of said developer supplying member in a horizontal direction;

said flow-path restricting member is a part of a frame that structures said developer container;

by rotating, said developer supplying member is capable of carrying said developer from above said first abutting section towards said first abutting section;

the rotating direction of said developer bearing member and the rotating direction of said developer supplying member are opposite to each other;

said flow-path restricting member is provided on the developer supplying member side of said sealing member; and said developing device is capable of being attached to a rotating member having a plurality of unit attaching sections, being rotated by said rotating member, and developing a latent image at a developing position, said latent image being formed on a photoconductor.

45. An image-forming apparatus comprising a developing device, said developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at a first abutting section, and is capable of supplying said developer to said developer bearing member;

a sealing member that is capable of abutting against an upper section of said developer bearing member at a second abutting section and preventing said developer from escaping from said developer container; and a flow-path restricting member that is capable of restricting a flow path of said developer contained in said developer container and comprises a first wall portion that covers an area above said first abutting section, and a second wall portion that extends from above to a position located beyond an upper end of said second abutting section.

46. A computer system comprising:

a computer;

a display device that can be connected to said computer; and an image-forming apparatus that can be connected to said computer and comprises a developing device, said developing device comprising:

a developer container for containing developer;

a developer bearing member that is provided at a lower section of said developer container and is capable of bearing and carrying said developer;

a developer supplying member that is provided at the lower section of said developer container, is capable of abutting against said developer bearing member at a first abutting section, and is capable of supplying said developer to said developer bearing member;

a sealing member that is capable of abutting against an upper section of said developer bearing member at a second abutting section and preventing said developer from escaping from said developer container; and a flow-path restricting member that is capable of restricting a flow path of said developer contained in said developer container and comprises a first wall portion that covers an area above said first abutting section, and a second wall portion that extends from above to a position located beyond an upper end of said second abutting section.

47. A developing unit comprising:

a developer container for containing developer;

a developer bearing member for bearing and carrying said developer contained in said developer container;

a developer supplying member for supplying said developer to said developer bearing member; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts against said developer bearing member from above said developer bearing member, and an uppermost section of said developer supplying member is located above a lower end of said sealing member.

48. A developing unit according to claim 47, wherein in a state where said developing unit is located at said developing position, said sealing member abuts at an abutting section against said developer bearing member from above said developer bearing member, and the uppermost section of said developer supplying member is located above a lower end of said abutting section.

49. A developing unit according to claim 47, wherein the diameter of a developer supplying roller, serving as said developer supplying member, is larger than the diameter of a developing roller, serving as said developer bearing member.

50. A developing unit according to claim 47, wherein in a state where said developing unit is located at said developing position, said developing unit comprises a thickness restricting member that is capable of abutting against a lower section of said developer bearing member from beneath said developer bearing member and restricting a thickness of a layer of said developer bore by said developer bearing member, and a lowermost section of said developer supplying member is located below an upper end of an abutting section where said developer bearing member and said thickness restricting member abut against each other.

51. A developing unit according to claim 47, wherein when said developing unit is attached to said unit attaching section, said developer supplying member is located closer to a center of rotation of said rotating member than said developer bearing member.

52. A developing unit according to claim 47, wherein in a state where said developing unit is located at said developing position, said developing unit comprises a wall portion that extends to a position located beyond an upper end of the abutting section where said developer bearing member and said sealing member abut against each other and is arranged on the developer container side of said sealing member.

53. A developing unit according to claim 52, wherein in a state where said developing unit is located at said developing position, said wall portion is provided above said developer supplying member and a lower end of said wall portion is located below a line that passes through an uppermost section of said developer bearing member and the uppermost section of said developer supplying member.

54. A developing unit according to claim 52, wherein a gap exists between the lower end of said wall portion and said developer supplying member.

55. A developing unit comprising:

a developer container for containing developer;

a developer bearing member for bearing and carrying said developer contained in said developer container;

a developer supplying member for supplying said developer to said developer bearing member; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts against said developer bearing member from above said developer bearing member at an abutting section, an uppermost section of said developer supplying member is located above a lower end of said sealing member, the uppermost section of said developer supplying member is located above a lower end of said abutting section, the diameter of a developer supplying roller, serving as said developer supplying member, is larger than the diameter of a developing roller, serving as said developer bearing member, said developing unit comprises a thickness restricting member that is capable of abutting against the lower section of said developer bearing member from below said developer bearing member and restricting a thickness of a layer of said developer bore by said developer bearing member, a lowermost section of said developer supplying member is located below an upper end of the abutting section where said developer bearing member and said thickness restricting member abut against each other, said developer supplying member is located closer to a center of rotation of said rotating member than said developer bearing member, said developing unit comprises a wall portion that extends to a position located beyond an upper end of the abutting section where said developer bearing member and said sealing member abut against each other and is arranged on the developer container side of said sealing member, said wall portion is provided above said developer supplying member, a lower end of said wall portion is located below a line that passes through an uppermost section of said developer bearing member and the uppermost section of said developer supplying member, and a gap exists between the lower end of said wall portion and said developer supplying member.

56. A developing unit comprising:

a developer container for containing developer;

a developer bearing member for bearing and carrying said developer contained in said developer container;

a developer supplying member for supplying said developer to said developer bearing member; and a thickness restricting member for restricting a thickness of a layer of said developer bore by said developer bearing member, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said thickness restricting member abuts against said developer bearing member from above said developer bearing member, and an uppermost section of said developer supplying member is located above a lower end of said thickness restricting member.

57. An image-forming apparatus comprising a developing unit, said developing unit comprising:

a developer container for containing developer;

a developer bearing member for bearing and carrying said developer contained in said developer container;

a developer supplying member for supplying said developer to said developer bearing member; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts against said developer bearing member from above said developer bearing member, and an uppermost section of said developer supplying member is located above a lower end of said sealing member.

58. A computer system comprising:

a computer;

a display device that can be connected to said computer; and an image-forming apparatus that can be connected to said computer and comprises a developing unit, said developing unit comprising:

a developer container for containing developer;

a developer bearing member for bearing and carrying said developer contained in said developer container;

a developer supplying member for supplying said developer to said developer bearing member; and a sealing member for preventing said developer from escaping from said developer container, said developing unit being capable of being attached to a rotating member having a plurality of unit attaching sections, being rotated by said rotating member, and developing a latent image at a developing position, said latent image being formed on a photoconductor, wherein, in a state where said developing unit is located at said developing position, said sealing member abuts against said developer bearing member from above said developer bearing member, and an uppermost section of said developer supplying member is located above a lower end of said sealing member.

59. A developing device comprising:

a developer container for containing developer;

a rotatable developer bearing member for bearing said developer;

a developer supplying member that is provided in said container, is capable of contacting said developer bearing member, and is capable of supplying said developer to said developer bearing member by rotating downwards, passing by a contacting section where said developer supplying member contacts said developer bearing member;

a supply-amount restricting member that is provided in said container and is capable of restricting an amount of said developer supplied from above to said contacting section where said developer supplying member and said developer bearing member contact each other; and a developer passage that is structured by an inner wall surface of said container and an outer surface of said developer supplying member and through which said developer having passed said contacting section in the downward direction passes, wherein, a shortest distance between the outer surface of said developer supplying member and said supply-amount restricting member is shorter than a shortest distance between the outer surface of said developer supplying member and the inner wall surface of said container, which structures said developer passage.

60. A developing device according to claim 59, wherein the rotating direction of said developer bearing member is in the opposite direction to the rotating direction of said developer supplying member.

61. A developing device according to claim 60, wherein the circumferential velocity of said developer supplying member is larger than the circumferential velocity of said developer bearing member.

62. A developing device according to claim 59, wherein said supply-amount restricting member protrudes towards said developer supplying member.

63. A developing device according to claim 59, wherein said supply-amount restricting member is a part of a wall of said container.

64. A developing device according to claim 59, wherein said supply-amount restricting member has a first wall surface on the developer supplying member side and a second wall surface on the developer bearing member side, said first wall surface and said second wall surface form an acute angle, and a blocking member is provided between said second wall surface and said developer bearing member, said blocking member being capable of occupying a space between said second wall surface and said developer bearing member.

65. A developing device according to claim 64, wherein said blocking member comprises a sealing member that is capable of contacting said developer bearing member, and an elastic member that is capable of occupying a gap between said second wall surface and said sealing member and pressing said sealing member onto said developer bearing member.

66. A developing device according to claim 59, wherein among four spaces formed by a horizontal plane and a vertical plane that pass through a center of rotation of said developer supplying member, an end of said supply-amount restricting member exists in a space above said developer bearing member and on the developer bearing member side.

67. A developing device according to claim 59, wherein a spacing between an end of said supply-amount restricting member and the outer surface of said developer supplying member is constant in the direction of an axis of rotation of said developer supplying member.

68. A developing device according to claim 67, wherein a shortest distance of the spacing between said end of said supply-amount restricting member and the outer surface of said developer supplying member is equal to or below 3 mm.

69. A developing device according to claim 59, wherein said developer passage is provided from below said contacting section, at which said developer bearing member and said developer supplying member contact with each other, along a circumferential direction of said developer supplying member, and towards the opposite side of said developer bearing member in relation to a center of rotation of said developer supplying member.

70. A developing device according to claim 59, wherein the inner wall surface of said container that structures in part said developer passage is provided maintaining a constant spacing with the outer surface of said developer supplying member along a circumferential direction of said developer supplying member.

71. A developing device according to claim 70, wherein said constant spacing is in a range from 0.5 mm to 3 mm.

72. A developing device comprising a developer container for containing developer;

a rotatable developer bearing member for bearing said developer;

a developer supplying member being provided in said container, being capable of contacting said developer bearing member, being capable of supplying said developer to said developer bearing member by rotating downwards, passing by a contacting section where said developer supplying member contacts said developer bearing member, whose rotating direction is in the opposite direction to the rotating direction of said developer bearing member, and whose circumferential velocity is larger than the circumferential velocity of said developer bearing member;

a supply-amount restricting member being provided in said container, being capable of restricting an amount of said developer supplied from above to said contacting section where said developer supplying member and said developer bearing member contact each other, protruding towards said developer supplying member, being a part of a wall of said container, having a first wall surface on the developer supplying member side and a second wall surface on the developer bearing member side, wherein said first wall surface and said second wall surface form an acute angle, a blocking member is provided between said second wall surface and said developer bearing member, said blocking member being capable of occupying a space between said second wall surface and said developer bearing member, said blocking member comprises a sealing member that is capable of contacting said developer bearing member, and an elastic member that is capable of occupying a gap between said second wall surface and said sealing member and pressing said sealing member onto said developer bearing member, an end of said supply-amount restricting member exists in a space above said developer bearing member and on the developer bearing member side among four spaces formed by a horizontal plane and a vertical plane that pass through a center of rotation of said developer supplying member, a spacing between the end of said supply-amount restricting member and an outer surface of said developer supplying member is constant in the direction of an axis of rotation of said developer supplying member, and a shortest distance of the spacing between said end of said supply-amount restricting member and the outer surface of said developer supplying member is equal to or below 3 mm; and a developer passage being structured by an inner wall surface of said container and the outer surface of said developer supplying member and through which said developer having passed said contacting section in the downward direction passes, being provided from below said contacting section, at which said developer bearing member and said developer supplying member contact with each other, along a circumferential direction of said developer supplying member, and towards the opposite side of said developer bearing member in relation to the center of rotation of said developer supplying member, wherein the inner wall surface of said container that structures in part said developer passage is provided maintaining a constant spacing with the outer surface of said developer supplying member along the circumferential direction of said developer supplying member, and said constant spacing is in a range from 0.5 mm to 3 mm, wherein, a shortest distance between the outer surface of said developer supplying member and said supply-amount restricting member is shorter than a shortest distance between the outer surface of said developer supplying member and the inner wall surface of said container, which structures said developer passage.

73. An image-forming apparatus comprising:

a photoconductor; and a developing device for developing a latent image formed on said photoconductor, said developing device comprising:

a developer container for containing developer;

a rotatable developer bearing member for bearing said developer;

a developer supplying member being provided in said container, being capable of contacting said developer bearing member, being capable of supplying said developer to said developer bearing member by rotating downwards, passing by a contacting section where said developer supplying member contacts said developer bearing member, and whose circumferential velocity is larger than the circumferential velocity of said developer bearing member;

a supply-amount restricting member that is provided in said container and is capable of restricting an amount of said developer supplied from above to said contacting section where said developer supplying member and said developer bearing member contact each other; and a developer passage that is structured by an inner wall surface of said container and an outer surface of said developer supplying member and through which said developer having passed said contacting section in the downward direction passes, wherein, a shortest distance between the outer surface of said developer supplying member and said supply-amount restricting member is shorter than a shortest distance between the outer surface of said developer supplying member and the inner wall surface of said container, which structures said developer passage.

74. A computer system comprising:

a computer; and an image-forming apparatus that can be connected to said computer, said image-forming apparatus comprising:

a photoconductor; and a developing device for developing a latent image formed on said photoconductor, said developing device comprising:

a developer container for containing developer;

a rotatable developer bearing member for bearing said developer;

a developer supplying member being provided in said container, being capable of contacting said developer bearing member, being capable of supplying said developer to said developer bearing member by rotating downwards, passing by a contacting section where said developer supplying member contacts said developer bearing member, and whose circumferential velocity is larger than the circumferential velocity of said developer bearing member;

a supply-amount restricting member that is provided in said container and is capable of restricting an amount of said developer supplied from above to said contacting section where said developer supplying member and said developer bearing member contact each other; and a developer passage that is structured by an inner wall surface of said container and an outer surface of said developer supplying member and through which said developer having passed said contacting section in the downward direction passes, wherein, a shortest distance between the outer surface of said developer supplying member and said supply-amount restricting member is shorter than a shortest distance between the outer surface of said developer supplying member and the inner wall surface of said container, which structures said developer passage.

75. A developing device comprising:

a first container for containing developer;

a second container for containing said developer;

a restriction wall that is capable of restricting movement of said developer between said first container and said second container and in which one side of the wall structures a part of an inner wall of said first container and another side of the wall structures a part of an inner wall of said second container;

a developer bearing member provided in said first container;

a rotatable developer supplying member that is provided in said first container and is capable of supplying said developer to said developer bearing member; and a sealing member that is provided above a center of rotation of said developer supplying member and is capable of preventing said developer from escaping from said first container, wherein, in a state where said developing device can develop a latent image formed on a photoconductor, a gap existing on a plane that passes through a center of rotation of said developer supplying member and forms an angle θ with a horizontal plane in a direction opposite to the rotating direction of said developer supplying member, said horizontal plane being taken as a reference and extending from the center of rotation of said developer supplying member towards the opposite side of said photoconductor, and existing between said developer supplying member and the inner wall of said first container takes a maximum value when $\theta=0°$ within a range of $0° \leqq \theta \leqq 90°$.

76. A developing device according to claim 75, wherein an upper end of said restriction wall is located above an uppermost section of said developer supplying member.

77. A developing device according to claim 75, wherein said restriction wall extends upwards from below.

78. A developing device according to claim 75, wherein said developer supplying member abuts against said developer bearing member, and the rotating direction of said developer supplying member is the direction going downwards through an abutting position where said developer supplying member and said developer bearing member abut against each other.

79. A developing device according to claim 75, wherein said developer supplying member is an elastic member formed by a foamed material.

80. A developing device according to claim 75, wherein as θ increases within said range of $0° \leqq \theta \leqq 90°$, said gap does not become larger in association with the increase of θ.

81. A developing device according to claim 75, wherein within said range of $0° \leqq \theta \leqq 90°$, while θ increases from 0° up to a predetermined angle, said gap becomes gradually smaller in association with the increase of θ, and while θ increases from said predetermined angle up to 90°, said gap has a constant value.

82. A developing device according to claim 81, wherein said inner wall of said first container structuring in part said gap is formed to have a curved section while θ increases from 0° up to said predetermined angle, and a gap structured by said curved section and said developer supplying member becomes gradually smaller in association with the increase of θ.

83. A developing device according to claim 75, wherein a tip end of said sealing member is located above the center of rotation of said developer supplying member.

84. A developing device according to claim 75, wherein said sealing member abuts against said developer bearing member with a predetermined breadth, and a lowermost point of said predetermined breadth is located above the center of rotation of said developer supplying member.

85. A developing device according to claim 75, wherein said sealing member is a film and abuts against said developer bearing member by being urged by an elastic member.

86. A developing device comprising:

a first container for containing developer;

a second container for containing said developer;

a restriction wall that is capable of restricting movement of said developer between said first container and said second container and in which one side of the wall structures a part of an inner wall of said first container and another side of the wall structures a part of an inner wall of said second container;

a developer bearing member provided in said first container;

a rotatable developer supplying member that is provided in said first container and is capable of supplying said developer to said developer bearing member; and a sealing member that is provided above a center of rotation of said developer supplying member and is capable of preventing said developer from escaping from said first container, wherein, in a state where said developing device can develop a latent image formed on a photoconductor, a gap existing on a plane that passes through a center of rotation of said developer supplying member and forms an angle θ with a horizontal plane in a direction opposite to the rotating direction of said developer supplying member, said horizontal plane being taken as a reference and extending from the center of rotation of said developer supplying member towards the opposite side of said photoconductor, and existing between said developer supplying member and the inner wall of said first container takes a maximum value when $\theta=0°$ within a range of $0° \leqq \theta \leqq 90°$;

an upper end of said restriction wall is located above an uppermost section of said developer supplying member;

said restriction wall extends upwards from below;

said developer supplying member abuts against said developer bearing member;

the rotating direction of said developer supplying member is the direction going downwards through an abutting position where said developer supplying member and said developer bearing member abut against each other;

said developer supplying member is an elastic member formed by a foamed material;

within said range of $0° \leqq \theta \leqq 90°$, while θ increases from 0° up to a predetermined angle, said gap becomes gradually smaller in association with the increase of θ, and while θ increases from said predetermined angle up to 90°, said gap has a constant value;

said inner wall of said first container structuring in part said gap is formed to have a curved section while θ increases from 0° up to said predetermined angle;

a gap structured by said curved section and said developer supplying member becomes gradually smaller in association with the increase of θ;

a tip end of said sealing member is located above the center of rotation of said developer supplying member; and said sealing member is a film and abuts against said developer bearing member by being urged by an elastic member.

87. An image-forming apparatus comprising:

a photoconductor; and a developing device, said developing device comprising:

a first container for containing developer;

a second container for containing said developer;

a restriction wall that is capable of restricting movement of said developer between said first container and said second container and in which one side of the wall structures a part of an inner wall of said first container and another side of the wall structures a part of an inner wall of said second container;

a developer bearing member provided in said first container;

a rotatable developer supplying member that is provided in said first container and is capable of supplying said developer to said developer bearing member; and a sealing member that is provided above a center of rotation of said developer supplying member and is capable of preventing said developer from escaping from said first container, wherein, in a state where said developing device can develop a latent image formed on said photoconductor, a gap existing on a plane that passes through a center of rotation of said developer supplying member and forms an angle θ with a horizontal plane in a direction opposite to the rotating direction of said developer supplying member, said horizontal plane being taken as a reference and extending from the center of rotation of said developer supplying member towards the opposite side of said photoconductor, and existing between said developer supplying member and the inner wall of said first container takes a maximum value when $\theta=0°$ within a range of $0° \leqq \theta \leqq 90°$.

88. A computer system comprising:

a computer; and an image-forming apparatus that can be connected to said computer, said image-forming apparatus comprising:

a photoconductor; and a developing device, said developing device comprising:

a first container for containing developer;

a second container for containing said developer;

a restriction wall that is capable of restricting movement of said developer between said first container and said second container and in which one side of the wall structures a part of an inner wall of said first container and another side of the wall structures a part of an inner wall of said second container;

a developer bearing member provided in said first container;

a rotatable developer supplying member that is provided in said first container and is capable of supplying said developer to said developer bearing member; and a sealing member that is provided above a center of rotation of said developer supplying member and is capable of preventing said developer from escaping from said first container, wherein, in a state where said developing device can develop a latent image formed on said photoconductor, a gap existing on a plane that passes through a center of rotation of said developer supplying member and forms an angle θ with a horizontal plane in a direction opposite to the rotating direction of said developer supplying member, said horizontal plane being taken as a reference and extending from the center of rotation of said developer supplying member towards the opposite side of said photoconductor, and existing between said developer supplying member and the inner wall of said first container takes a maximum value when $\theta=0°$ within a range of $0° \leqq \theta \leqq 90°$.

89. An image-forming apparatus comprising:

a photoconductor; and a rotating device that is capable of making a plurality of developing devices attached to said rotating device rotate and locating each of said developing devices at a position where said developing device opposes said photoconductor, each of said developing devices comprising:

a first container for containing developer;

a second container for containing said developer;

a restriction wall for restricting movement of said developer between said first container and said second container;

a developer bearing member for bearing said developer; and a sealing member that is capable of abutting against said developer bearing member and preventing said developer from escaping from said first container, wherein, in a state where said developing device has been rotated by said rotating device and is located at a position opposing said photoconductor, an uppermost end of said restriction wall is located above a tip end of said sealing member.

90. An image-forming apparatus according to claim 89, wherein in a state where said developing device has been rotated by said rotating device and is located at a position opposing said photoconductor, the uppermost end of said restriction wall is located above an abutting section where said sealing member abuts against said developer bearing member.

91. An image-forming apparatus according to claim 89, wherein said sealing member abuts against said developer bearing member by being urged by an elastic member, and in a state where said developing device has been rotated by said rotating device and is located at a position opposing said photoconductor, the uppermost end of said restriction wall is located above said elastic member.

92. An image-forming apparatus according to claim 89, wherein in a state where said developing device has been rotated by said rotating device and is located at a position opposing said photoconductor, the uppermost end of said restriction wall is located above an uppermost end of said sealing member.

93. An image-forming apparatus according to claim 89, wherein when said developing device is rotated by said rotating device, said developer contained in said second container is able to go across said restriction wall and move to said first container.

94. An image-forming apparatus according to claim 89, wherein in a state where said developing device has been rotated by said rotating device and is located at a position opposing said photoconductor, said second container, said restriction wall, and said developer bearing member are arranged in this order in a horizontal direction.

95. An image-forming apparatus according to claim 93, wherein the tip end of said sealing member is located above a center of rotation of said developer bearing member.

96. An image-forming apparatus according to claim 89, wherein said sealing member is a film and abuts against said developer bearing member by being urged by an elastic member.

97. An image-forming apparatus comprising:

a photoconductor; and a rotating device that is capable of making a plurality of developing devices attached to said rotating device rotate and locating each of said developing devices at a position where said developing device opposes said photoconductor;

each of said developing devices comprising:

a first container for containing developer;

a second container for containing said developer;

a restriction wall for restricting movement of said developer between said first container and said second container;

a developer bearing member for bearing said developer; and a sealing member that is capable of abutting against said developer bearing member and preventing said developer from escaping from said first container, wherein, when said developing device is rotated by said rotating device, said developer contained in said second container is able to go across said restriction wall and move to said first container; and in a state where said developing device has been rotated by said rotating device and is located at a position opposing said photoconductor, an uppermost end of said restriction wall is located above an uppermost end of said sealing member, said second container, said restriction wall, and said developer bearing member are arranged in this order in a horizontal direction, a tip end of said sealing member is located above a center of rotation of said developer bearing member, and said sealing member is a film and abuts against said developer bearing member by being urged by an elastic member.

98. A computer system comprising:

a computer; and an image-forming apparatus that can be connected to said computer, said image-forming apparatus comprising:

a photoconductor; and a rotating device that is capable of making a plurality of developing devices attached to said rotating device rotate and locating each of said developing devices at a position where said developing device opposes said photoconductor, each of said developing devices comprising:

a first container for containing developer;

a second container for containing said developer;

a restriction wall for restricting movement of said developer between said first container and said second container;

a developer bearing member for bearing said developer; and a sealing member that is capable of abutting against said developer bearing member and preventing said developer from escaping from said first container, wherein, in a state where said developing device has been rotated by said rotating device and is located at a position opposing said photoconductor, an uppermost end of said restriction wall is located above a tip end of said sealing member.

* * * * *